US008020904B2

(12) United States Patent
Flory et al.

(10) Patent No.: US 8,020,904 B2
(45) **Date of Patent: *Sep. 20, 2011**

(54) INTEGRATED TILT/SASH LOCK ASSEMBLY

(75) Inventors: Edward C. Flory, Crown Point, IN (US); Jason L. Annes, Chicago, IL (US); Dean Pettit, St. John, IN (US)

(73) Assignee: Newell Operating Company, Huntersville, NC (US)

( * ) Notice: Subject to any disclaimer, the term of this patent is extended or adjusted under 35 U.S.C. 154(b) by 1000 days.

This patent is subject to a terminal disclaimer.

(21) Appl. No.: 11/493,383

(22) Filed: Jul. 26, 2006

(65) Prior Publication Data

US 2007/0209281 A1 Sep. 13, 2007

Related U.S. Application Data

(63) Continuation-in-part of application No. 11/274,753, filed on Nov. 15, 2005, now Pat. No. 7,481,470, which is a continuation of application No. 10/290,092, filed on Nov. 7, 2002, now Pat. No. 7,070,211, and a continuation-in-part of application No. 11/351,354, filed on Feb. 10, 2006, now abandoned.

(60) Provisional application No. 60/413,930, filed on Sep. 25, 2002, provisional application No. 60/411,839, filed on Sep. 19, 2002, provisional application No. 60/403,565, filed on Aug. 14, 2002, provisional application No. 60/376,582, filed on Apr. 30, 2002, provisional application No. 60/370,318, filed on Apr. 5, 2002, provisional application No. 60/347,823, filed on Nov. 7, 2001, provisional application No. 60/651,802, filed on Feb. 10, 2005, provisional application No. 60/703,277, filed on Jul. 28, 2005.

(51) Int. Cl.
*E05C 3/04* (2006.01)
*E05B 17/00* (2006.01)

(52) U.S. Cl. ..... 292/241; 292/346; 292/DIG. 20; 292/DIG. 47; 292/DIG. 57

(58) Field of Classification Search ..... 292/241, 292/346, DIG. 51, DIG. 20, DIG. 47
See application file for complete search history.

(56) References Cited

U.S. PATENT DOCUMENTS 166,842 A 8/1875 Berryman (Continued)

FOREIGN PATENT DOCUMENTS

GB 341207 1/1931

(Continued)

OTHER PUBLICATIONS

P. 21, Home Protection Hardware Catalog Pricelist, dated Jul. 1986.

*Primary Examiner* — Carlos Lugo
(74) *Attorney, Agent, or Firm* — Taft Stettinius & Hollister LLP

(57) ABSTRACT

An integrated sash lock and tilt latch assembly is mounted in a sash window having a top rail, a base, and two stiles connected together at their extremities. The integrated assembly contains a sash lock mechanism, a tilt latch mechanism, and a connector. The sash lock mechanism includes an actuator movable to adjust the assembly among a locked position, an unlocked position, and a tiltable position, and a rotor coupled to the actuator. The tilt latch mechanism includes a tilt latch housing supported by the top rail and a latch bolt slidably supported by the tilt latch housing and moveable between an extended position and a retracted position. At least a portion of the tilt latch housing has a generally circular cross-section. The connector has a first end of operably coupled to the latch bolt and a second end operably coupled to the sash lock mechanism.

20 Claims, 41 Drawing Sheets

U.S. PATENT DOCUMENTS 176,360 A 6/1876 Cooper
178,360 A 6/1876 Cooper
201,146 A 3/1878 Adler
336,302 A * 2/1886 Dudgeon ..... 292/36
346,788 A 8/1886 Teufel
376,252 A 1/1888 McIntyre
410,728 A 9/1889 Brown
480,148 A 8/1892 Theby
509,941 A 12/1893 Perry
512,593 A 1/1894 Webster et al.
526,118 A 9/1894 Sharp
551,242 A 12/1895 Wallace
590,225 A 9/1897 Hill
722,162 A 3/1903 St. Louis
759,642 A 5/1904 Sparks
878,206 A 2/1908 Johnson
948,628 A 2/1910 Jefferis
966,063 A 8/1910 Toothaker
980,131 A 12/1910 Shean
998,642 A 7/1911 Shean
1,006,211 A 10/1911 Hermon
1,041,803 A 10/1912 Kilburn
1,051,918 A 2/1913 Rowley
1,059,999 A 4/1913 James et al.
1,141,437 A 6/1915 Unterlender
1,243,115 A 10/1917 Shur
1,253,810 A 1/1918 Gianninoto
1,270,740 A 6/1918 Keyes
1,393,628 A 10/1921 Leichter
1,550,532 A 8/1925 French
1,552,690 A 9/1925 Frantz
1,704,946 A 3/1929 Lindgren
1,712,792 A 5/1929 Hansen
1,715,957 A 6/1929 Stein
1,794,171 A 2/1931 Grutel
1,964,114 A 12/1931 Gerlach et al.
1,864,253 A 6/1932 McIntyre
1,869,274 A 7/1932 Phillips
1,901,974 A 3/1933 Macy
1,922,062 A 8/1933 Sullivan
2,095,057 A 10/1937 Corrado
2,122,661 A 7/1938 Rightmyer
2,126,995 A 8/1938 Kingdon
2,272,145 A 2/1942 Anderson et al.
2,369,584 A 2/1945 Lundholm
2,452,521 A 10/1948 Johnson et al.
2,500,849 A 3/1950 Menns
2,537,736 A 1/1951 Carlson
2,766,492 A 10/1956 Day et al.
2,818,919 A 1/1958 Sylvan
3,027,188 A 3/1962 Eichstadt
3,187,526 A 6/1965 Moler
3,362,740 A 1/1968 Burns
3,438,153 A 4/1969 Lemme
3,599,452 A 8/1971 Maruyama et al.
3,683,652 A 8/1972 Halopoff et al.
3,811,718 A 5/1974 Bates
3,919,808 A 11/1975 Simmons
3,953,061 A * 4/1976 Hansen et al. ..... 292/5
4,015,454 A * 4/1977 Struble ..... 70/2
4,068,871 A 1/1978 Mercer
4,151,682 A 5/1979 Schmidt
4,165,894 A 8/1979 Wojciechowski
4,227,345 A 10/1980 Durham, Jr.
4,253,688 A 3/1981 Hosooka
4,303,264 A 12/1981 Uehara
4,305,612 A 12/1981 Hunt et al.
4,392,329 A 7/1983 Suzuki
4,470,277 A 9/1984 Uyeda
4,475,311 A 10/1984 Gibson
4,525,952 A 7/1985 Cunningham et al.
4,580,366 A 4/1986 Hardy
4,587,759 A 5/1986 Gray
4,624,073 A 11/1986 Randall
4,639,021 A 1/1987 Hope
4,643,005 A 2/1987 Logas
4,801,164 A * 1/1989 Mosch ..... 292/204
4,827,685 A 5/1989 Schmidt
4,893,849 A 1/1990 Schlack
4,922,658 A 5/1990 Coddens
4,949,506 A 8/1990 Durham, Jr.
4,961,286 A 10/1990 Bezubic
5,072,464 A 12/1991 Draheim et al.
5,076,015 A 12/1991 Manzalini
5,087,087 A 2/1992 Vetter et al.
5,087,088 A 2/1992 Milam
5,090,750 A 2/1992 Lindqvist
5,127,685 A 7/1992 Dallaire et al.
5,139,291 A 8/1992 Schultz
5,143,412 A 9/1992 Lindqvist
5,161,839 A * 11/1992 Piltingsrud et al. ..... 292/241
5,165,737 A 11/1992 Riegelman
5,183,310 A 2/1993 Shaughnessy
5,244,238 A 9/1993 Lindqvist
5,274,955 A 1/1994 Dallaire et al.
5,341,752 A 8/1994 Hambleton
5,398,447 A 3/1995 Morse
5,437,484 A 8/1995 Yamada
5,454,609 A 10/1995 Slocomb et al.
5,474,346 A * 12/1995 Fann et al. ..... 292/337
5,560,149 A 10/1996 Lafevre
5,636,475 A 6/1997 Nidelkoff
5,688,000 A 11/1997 Dolman
5,715,631 A 2/1998 Kailian et al.
5,769,472 A * 6/1998 Small ..... 292/337
5,791,700 A 8/1998 Biro
5,829,196 A 11/1998 Maier
5,873,199 A 2/1999 Meunier et al.
5,901,499 A 5/1999 Delaske et al.
5,911,763 A 6/1999 Quesada
5,970,656 A 10/1999 Maier
5,992,907 A 11/1999 Sheldon et al.
6,086,121 A 7/2000 Buckland
6,135,510 A 10/2000 Diginosa
6,139,071 A 10/2000 Hopper
6,142,541 A 11/2000 Rotondi
6,155,615 A 12/2000 Schultz
6,161,335 A 12/2000 Beard et al.
6,176,041 B1 1/2001 Roberts
6,178,696 B1 1/2001 Liang
6,183,024 B1 2/2001 Schultz et al.
6,209,931 B1 4/2001 Stoutenborough et al.
6,217,087 B1 4/2001 Fuller
6,230,443 B1 5/2001 Schultz
6,257,303 B1 7/2001 Coubray et al.
6,279,266 B1 8/2001 Searcy
6,422,287 B1 7/2002 Wilke
6,546,671 B2 4/2003 Mitchell et al.
6,554,330 B2 * 4/2003 Wen-Bin et al. ..... 292/346
6,565,133 B1 5/2003 Timothy
6,588,150 B1 7/2003 Wong et al.
6,592,155 B1 7/2003 Lemley et al.
6,607,221 B1 8/2003 Elliott
6,817,142 B2 11/2004 Marshik
6,871,885 B2 3/2005 Goldenberg et al.
6,877,784 B2 * 4/2005 Kelley et al. ..... 292/241
6,957,513 B2 * 10/2005 Pettit et al. ..... 49/185
7,013,603 B2 * 3/2006 Eenigenburg et al. ..... 49/185
7,070,211 B2 * 7/2006 Polowinczak et al. ..... 292/139
7,070,215 B2 * 7/2006 Kelley et al. ..... 292/241
D553,947 S * 10/2007 Flory ..... D8/331
7,275,773 B1 * 10/2007 Weathersby et al. ..... 292/337
7,322,619 B2 * 1/2008 Nolte et al. ..... 292/175
7,412,800 B2 * 8/2008 Maier ..... 49/185
7,481,470 B2 * 1/2009 Eenigenburg et al. ..... 292/241
7,490,873 B1 * 2/2009 Ricke et al. ..... 292/5
7,510,221 B2 * 3/2009 Eenigenburg et al. ..... 292/240
7,607,262 B2 * 10/2009 Pettit et al. ..... 49/185
2003/0084614 A1 * 5/2003 Pettit et al. ..... 49/185
2003/0110698 A1 * 6/2003 Polowinczak et al. ..... 49/181
2007/0029810 A1 * 2/2007 Nolte et al. ..... 292/32

FOREIGN PATENT DOCUMENTS

GB 2026594 2/1980

* cited by examiner

FIG.2
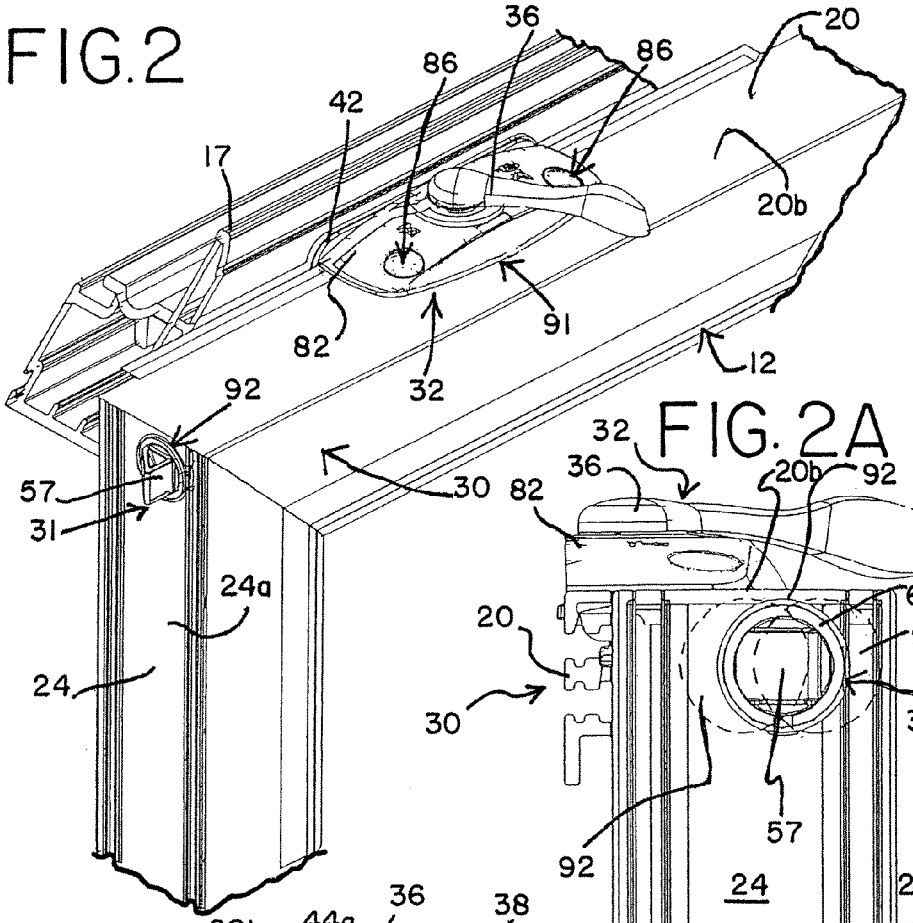
FIG. 2A
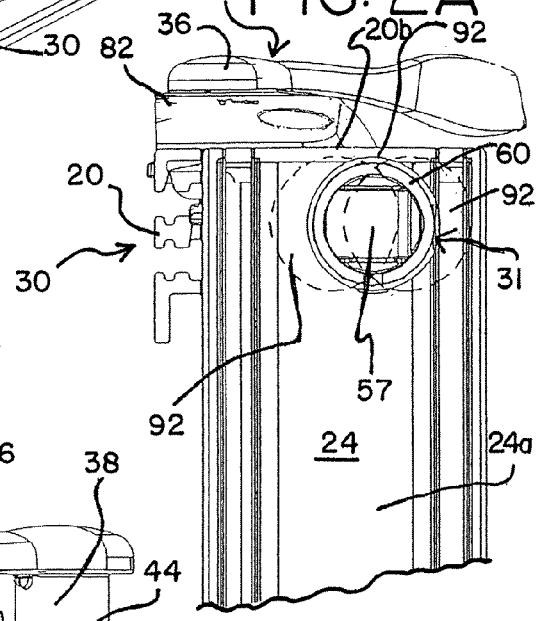
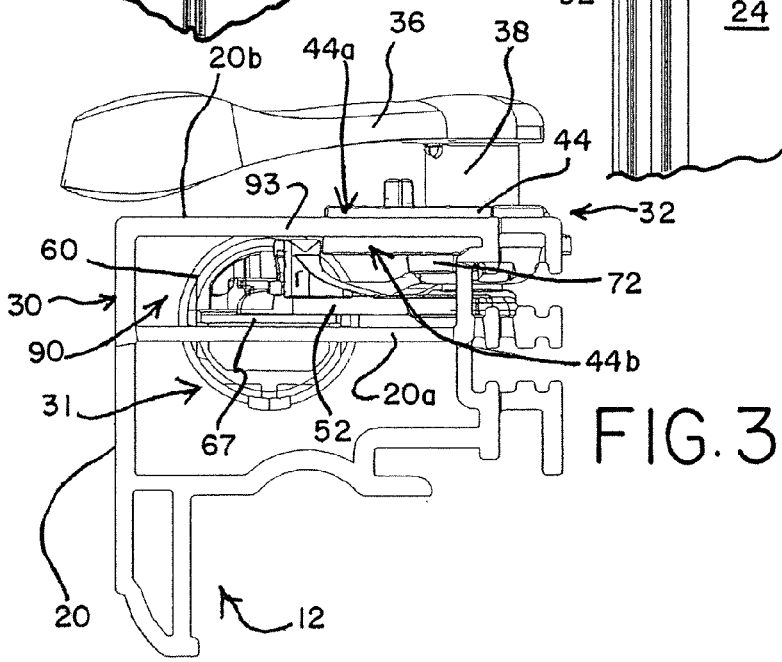
FIG. 3

12
20
20b
200
31
24a
24
60
50
57
46
201b
95a
201a
53
55a
55
56
52
48a
48b
64a
64b
62
57a
57b
201
WB
WT
EW

INTEGRATED TILT/SASH LOCK ASSEMBLY

CROSS-REFERENCE TO RELATED APPLICATIONS

This application is a continuation-in-part of U.S. patent application Ser. No. 11/274,753, filed Nov. 15, 2005, now issued as U.S. Pat. No. 7,481,470, which is a continuation of U.S. patent application Ser. No. 10/290,092, filed Nov. 7, 2002, now issued as U.S. Pat. No. 7,070,211, and which is a nonprovisional filing of U.S. Provisional Application Ser. No. 60/413,930, filed Sep. 25, 2002, U.S. Provisional Application Ser. No. 60/411,839, filed Sep. 19, 2002, U.S. Provisional Application Ser. No. 60/403,565, filed Aug. 14, 2002, U.S. Provisional Application Ser. No. 60/376,582, filed Apr. 30, 2002, U.S. Provisional Application Ser. No. 60/370,318, filed Apr. 5, 2002, and U.S. Provisional Application Ser. No. 60/347,823, filed Nov. 7, 2001, to all of which priority is also claimed in this application; and this application is also a continuation-in-part of U.S. patent application Ser. No. 11/351,354, filed Feb. 10, 2006, now abandoned which claims priority to U.S. Provisional Application Ser. No. 60/651,802, filed Feb. 10, 2005, to which priority is also claimed in this application; and this application further claims the benefit of and priority to U.S. Provisional Application Ser. No. 60/703,277, filed Jul. 28, 2005, all of which are incorporated by reference herein and made part hereof.

TECHNICAL FIELD

The present invention relates to sash window hardware and, more particularly, to an integrated sash lock and tilt-latch for use in sash windows.

BACKGROUND OF THE INVENTION

A pivotal sash window adapted for installation in a master frame of a sash window assembly is well-known. The pivotal sash window assembly typically has opposed, vertically extending jambs or guide rails to enable vertical reciprocal sliding movement of the sash window in the master frame while cooperatively engaged with the guide rails. The sash window also has a top sash rail, a base or lower rail and a pair of stiles or side rails cooperatively connected together at adjacent extremities thereof to form a sash frame, usually a rectangular frame.

Hardware is associated with the sash window assembly, such as a sash lock that provides a locking mechanism between an upper sash window and a lower sash window, as well as tilt-latches that releasably engage the guide rails to allow the sash window to pivot from the master frame. Mechanisms have been developed that combine the sash lock mechanism and the tilt-latch mechanism. While such combined mechanisms provide a number of advantageous features, they nevertheless have certain limitations. The present invention seeks to overcome certain of these limitations and other drawbacks of the prior art, and to provide new features not heretofore available.

SUMMARY OF THE INVENTION

The present invention provides an integrated sash lock and tilt-latch assembly for a sash window assembly. The sash window assembly has a sash window slideable within a master frame. The sash window has a top rail, a base, and two stiles connected together at their extremities. The integrated assembly includes a sash lock mechanism, a tilt latch mechanism, and a connector connecting the sash lock mechanism and the tilt latch mechanism. The tilt latch mechanism includes a tilt latch housing, a latch bolt, and a spring biasing the latch bolt outwardly from the housing. The latch bolt is slidably supported by the tilt latch housing and moveable between an extended position and a retracted position. The integrated assembly is moveable among a locked position, an unlocked position and a tiltable position. The sash lock mechanism is adapted to engage a keeper in the locked position, the sash lock mechanism is adapted to be disengaged from the keeper in the unlocked position, and the latch bolt is placed in the retracted position in the tiltable position.

According to one aspect of the invention, at least a portion of the tilt latch housing has a generally circular cross-section.

According to another aspect of the invention, the sash lock mechanism includes an actuator movable to adjust the assembly among a locked position, an unlocked position, and a tiltable position, a sash lock housing adapted to be supported on a top surface of the top rail, and a rotor coupled to the actuator. The sash lock housing has an opening receiving the actuator therethrough, and the sash lock housing supports the rotor such that a portion of the rotor is above a bottom surface of the sash lock housing and a portion of the rotor is below the bottom surface of the sash lock housing.

According to another aspect of the invention, the sash lock mechanism further includes a pawl operably associated with the actuator. The pawl operably engages the rotor and an end of the connector is connected to the pawl. The pawl includes a base having a tab and an appending member extending therefrom, wherein the rotor abuttingly engages the tab and the end of the connector is connected to the appending member.

According to another aspect of the invention, the actuator is moveable among a first position wherein the rotor does not abuttingly engage the pawl and the assembly is in the locked position, a second position wherein the rotor abuttingly engages the pawl and the assembly is in the unlocked position, and a third position wherein the rotor abuttingly engages the pawl and the assembly is in the tiltable position. The abutting engagement of the rotor and the pawl causes the rotor and the pawl to rotate together between the second position and the third position.

According to another aspect of the invention, the actuator is moveable through a first range of angular movement, wherein movement of the actuator rotates the rotor, and a second range of angular movement, wherein the rotor abuttingly engages the pawl such that movement of the actuator rotates the rotor and the pawl together.

According to another aspect of the invention, the rotor has a locking member and an eccentric portion. The keeper receives at least a portion of the locking member in the locked position, and the eccentric portion of the rotor engages the keeper when the actuator is attempted to be moved from the unlocked position to the tiltable position and the sash window assembly is in a closed position.

According to another aspect of the invention, the nose of the latch bolt has a width that is greater than a width of a bulk portion of the latch bolt.

According to another aspect of the invention, the tilt latch housing has a flange and a tab, and a gap is defined between the flange and the tab. The gap is adapted to receive a portion of the sash window.

According to another aspect of the invention, the first end of the connector is operably coupled to the sash lock mechanism and the second end of the connector is received within a recess of the latch bolt to operably couple the connector to the latch bolt. The second end of the connector has at least one flexible bracing arm that engages the latch bolt and exerts a torque on the connector to resist vertical movement and pivoting of the connector while permitting lateral movement and pivoting of the connector.

According to another aspect of the invention, the connector has a substantially rigid elongated body member, and the connector is operably connected to the latch bolt via a snap fit connection.

According to another aspect of the invention, the connector is selected from a group consisting of a plurality of connectors having different lengths.

According to another aspect of the invention, the tilt latch housing is adapted to be mounted within the lower sash window without a need for a fastener.

According to another aspect of the invention, the sash lock mechanism is adapted to be supported by a top rail of the sash window at a first location, and the tilt-latch mechanism is positioned at a second location remote from the first location.

According to another aspect of the invention, the tilt latch housing has a generally circular end opening, and the latch bolt is substantially rounded. A portion of the latch bolt extends from the end opening in the extended position, and the latch bolt and the opening each have cooperatively-engaging beveled edges to prevent rotation of the latch bolt within the housing.

The present invention also provides a window assembly including a master frame, an upper sash window slidable within master frame, a lower sash window slidable within the master frame, the lower sash window having a top rail, a bottom rail, and two stiles connecting the top rail and the bottom rail, and an integrated sash lock and tilt latch assembly as described above.

According to one aspect of the invention, the rotor is positioned such that a portion of the rotor is positioned above a top surface of the top rail of the lower sash window and a portion of the rotor is adapted to be positioned below the top surface of the top rail of the lower sash window.

According to another aspect of the invention, the tilt latch housing is received in an opening located entirely within the stile such that no portion of the tilt latch housing extends externally through the top rail of the lower sash window.

According to another aspect of the invention, the tilt latch housing has a member extending therefrom, the member resting upon an internal wall of the top rail to stabilize the tilt latch housing.

The present invention also provides a window assembly including a master frame, an upper sash window slidable within master frame, a lower sash window slidable within the master frame, the lower sash window having a horizontal top rail, a horizontal bottom rail, and two vertical stiles connecting the top rail and the bottom rail, and a tilt latch mechanism. Each stile has a vertical outer surface and the top rail has a horizontal outer surface. One of the stiles has an opening located entirely below the horizontal outer surface of the top rail. The tilt latch mechanism includes a housing and a moveable latch bolt disposed within the housing. The tilt latch mechanism is mounted within the lower sash window such that the housing is received in the opening in the stile.

The present invention also provides a tilt-latch housing for a tilt-latch for a sash window assembly having a sash window supported within a master frame. The tilt-latch housing includes a body adapted to be supported by the sash window, at least a portion of the body having a generally circular cross-section.

According to one aspect of the invention, the tilt-latch housing includes a first engaging member adapted to engage an outer surface of the sash window and a second engaging member adapted to engage an inner surface of the sash window.

According to another aspect of the invention, the tilt-latch housing further includes a plurality of flexible tabs adapted to engage an inner surface of the lower sash window to retain the tilt latch mechanism within the lower sash window. The plurality of flexible tabs are arranged into at least one substantially linear row.

The present invention further provides a tilt latch mechanism for use with a sash window assembly having a sash window supported within a master frame, the sash window having a top rail, a bottom rail, and two stiles. The tilt latch mechanism includes a tilt latch housing adapted to be supported by the sash window and having a first opening and a second opening spaced from the first opening. The tilt latch mechanism also includes a latch bolt having a first connecting structure and a second connecting structure. The first connecting structure is adapted to be connected to the first actuator in the first configuration to move the latch bolt, and the second connecting structure is adapted to be connected to the second actuator in the second configuration to move the latch bolt. The first opening is adapted to receive a first actuator, in a first configuration, to connect to the latch bolt to move the latch bolt between the extended position and the retracted position, and the second opening is adapted to receive a second actuator, in a second configuration different from the first configuration, to connect to the latch bolt to move the latch bolt between the extended position and the retracted position.

According to one aspect of the invention, the first actuator is a connector operably connected to a sash lock mechanism. The first connecting structure includes a recess adapted to receive an end of the connector.

According to another aspect of the invention, the second actuator is a finger actuator adapted to be manipulated by a finger of a user. The second connecting structure includes a receiver located on a top of the latch bolt and adapted to receive a portion of the finger actuator.

These and other objects and advantages will be made apparent from the following description of the drawings and detailed description of the invention.

BRIEF DESCRIPTION OF THE DRAWINGS

To understand the present invention, it will now be described by way of example, with reference to the accompanying drawings in which:

FIG. 2 is a perspective view of a portion of a sash window assembly incorporating the integrated tilt latch and sash lock assembly of the present invention;

FIG. 2A is a side view of the sash window assembly and integrated tilt latch and sash lock assembly and top sash member of FIG. 2;

FIG. 3 is a side view of the integrated tilt latch and sash lock assembly of FIG. 2, mounted in a top sash member;

DETAILED DESCRIPTION

Figure 1:
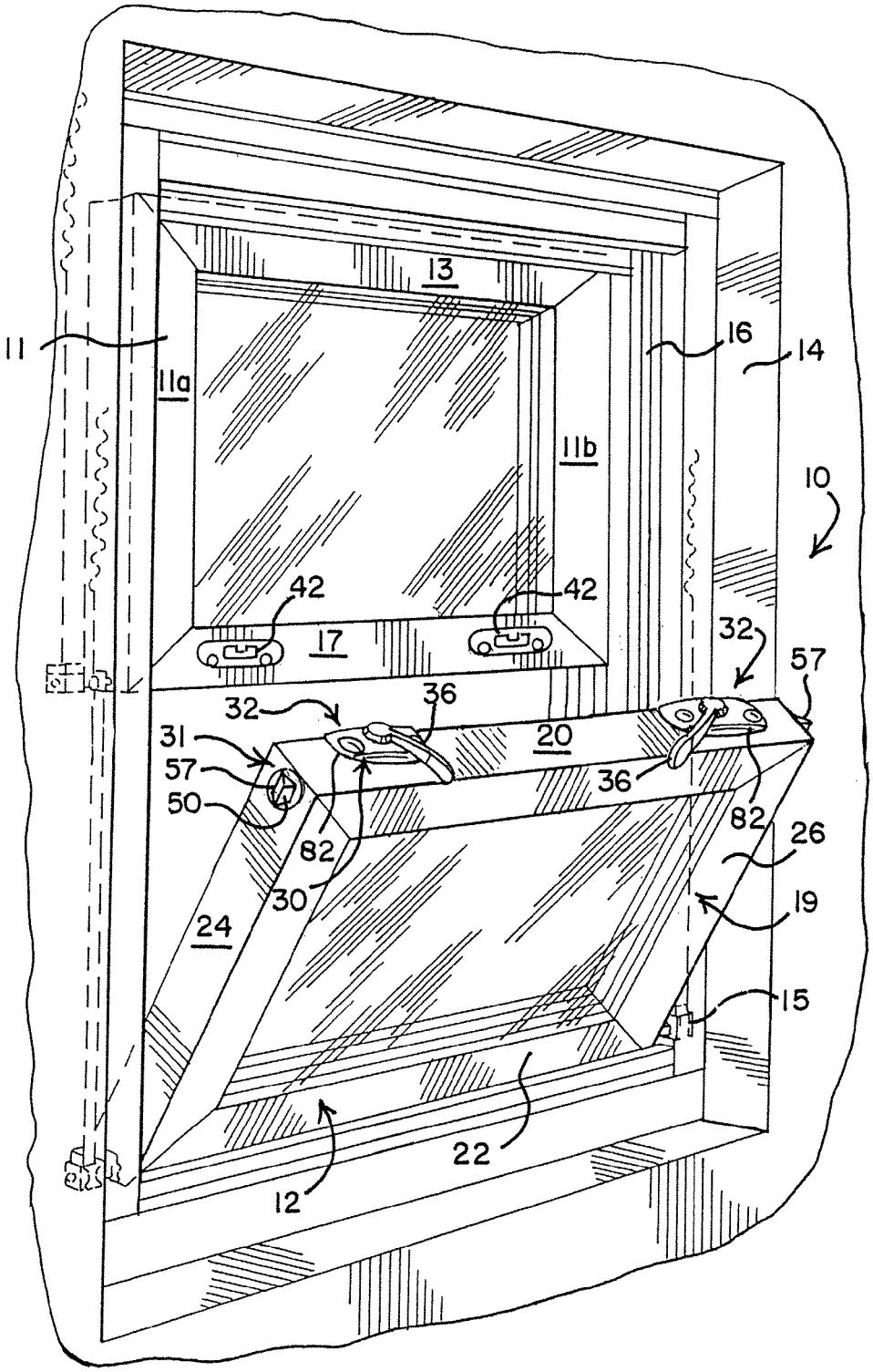
FIG. 1 is a perspective view of a sash window assembly incorporating an integrated tilt latch and sash lock assembly of the present invention.

While this invention is susceptible of embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

A sash window assembly 10 is shown in FIG. 1. The sash window assembly 10 is a double-hung window assembly having a pivotal bottom sash window 12 installed in a master frame 14. The bottom sash window 12 is pivotally mounted to the master frame 14 by a pivot-corner/balance shoe assembly 15. The master frame 14 has opposed, vertically extending guide rails 16 or jambs 16. The bottom sash window 12 has a top sash rail 20, a base 22 or bottom sash rail 22 and a pair of stiles 24,26 or side rails 24,26, cooperatively connected together at adjacent extremities thereof to form a sash frame 19, which is typically rectangular, although other shapes are possible. The sash frame 19 with which the integrated assembly 30 described herein is employed is typically made from vinyl extrusions known in the art. While the present invention can be used with any type of frame 19, the present invention is most preferably used with a window assembly 10 having a frame 19 made of vinyl. Further, it is contemplated that the frame 19 could be made from wood, masonite or press board, or from extrusions or pulltrusions that are filled with fiberglass, epoxy, plastic, or wood chips, or from other materials, including aluminum. The window assembly 10 also preferably has a top sash window 11, which is similar in structure to the bottom sash window 12, having a top rail 13, a bottom rail 17, and two stiles 11*a*,11*b*.

In accordance with one embodiment of the invention, the sash window 12 includes an integrated tilt latch and sash lock assembly 30. The integrated assembly 30 provides a sash locking operation. Additionally, the integrated assembly 30 provides a tilt-latch operation. While the integrated assembly 30 will be described herein with respect to a single integrated assembly 30, the integrated assembly 30 can also be used in connection with a dual integrated assembly. In such an instance, the second half of the integrated assembly will be substantially the same as that half of the integrated assembly 30 described herein. Also, as can be understood from FIG. 1, a preferred embodiment of the invention has a left-side integrated assembly 30 and a right-side integrated assembly 30. It is understood that the description herein is applicable to both a left-side integrated assembly 30 and a right-side integrated assembly 30. It is further understood that the features of the integrated assembly 30 may be incorporated into a single integrated assembly having a single sash lock mechanism and two tilt latch mechanisms.

Figure 45:
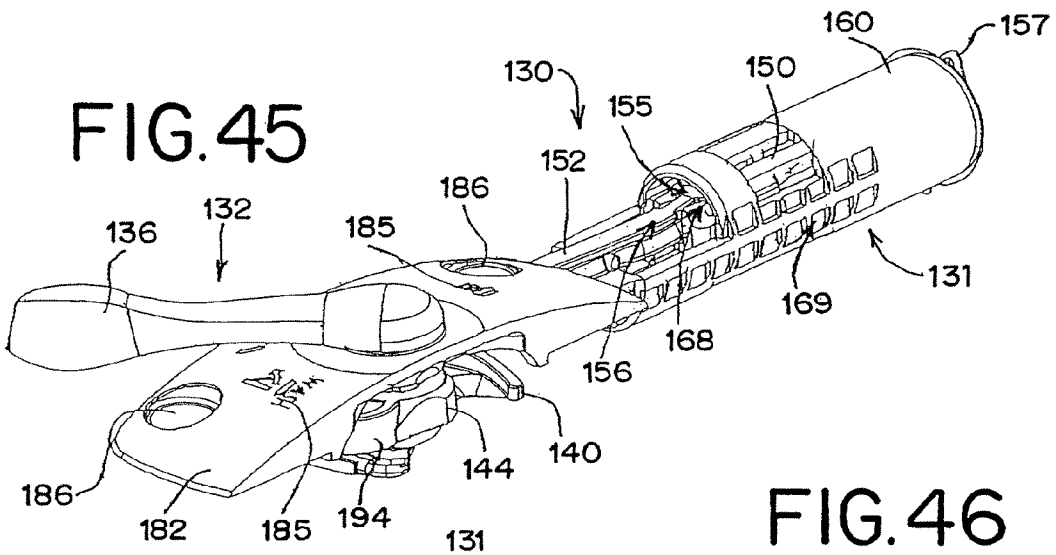
FIG. 45 is a rear perspective view of a second embodiment of an integrated tilt latch and sash lock assembly of the present invention, shown in an unlocked position.
Figure 46:
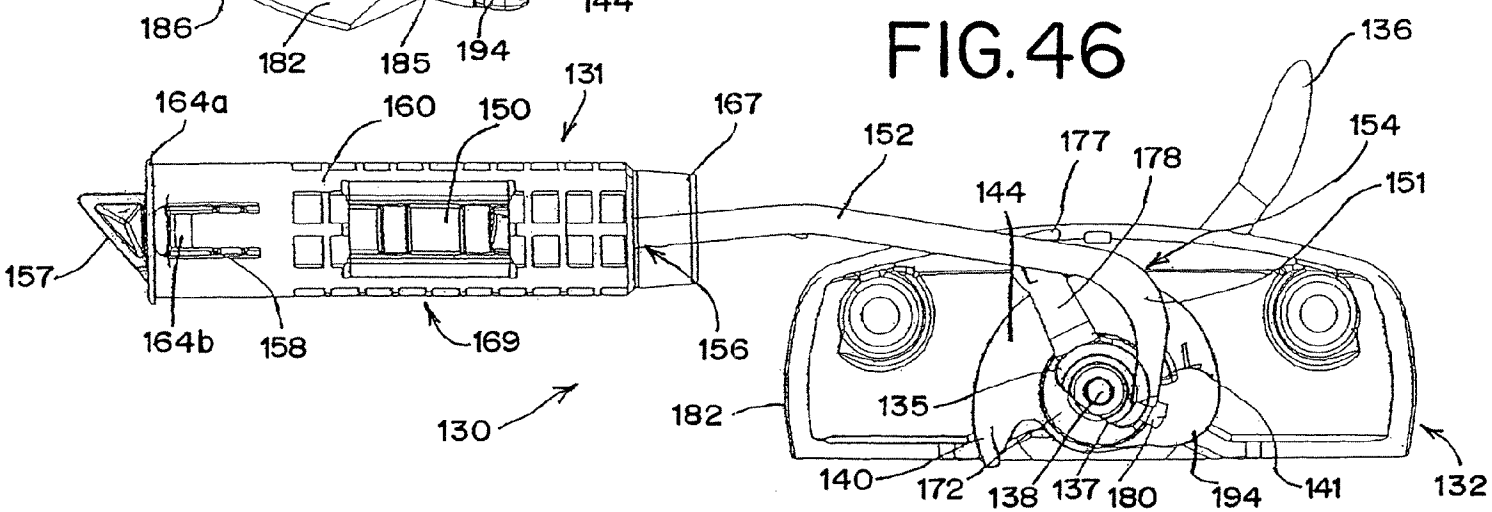
FIG. 46 is a bottom view of the integrated tilt latch and sash lock assembly of FIG. 45.
Figure 47:
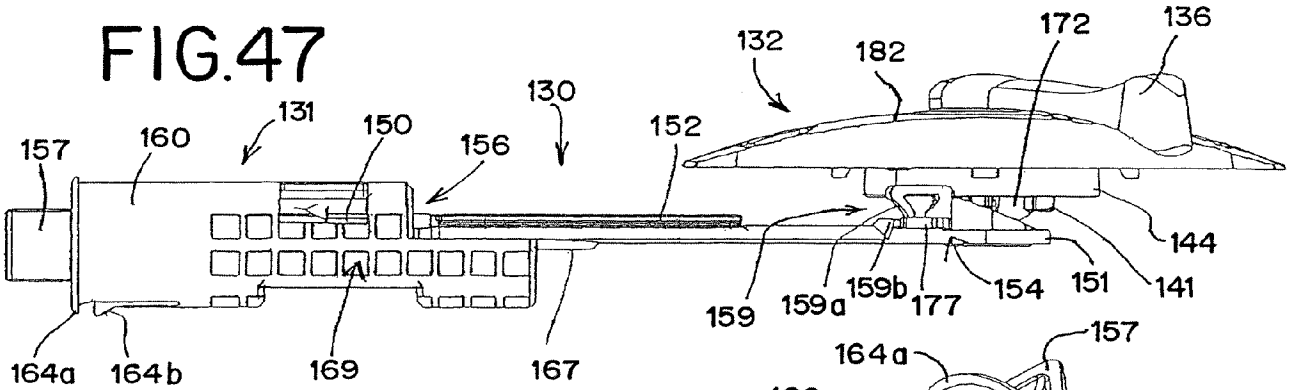
FIG. 47 is a front view of the integrated tilt latch and sash lock assembly of FIG. 45.
Figure 48:
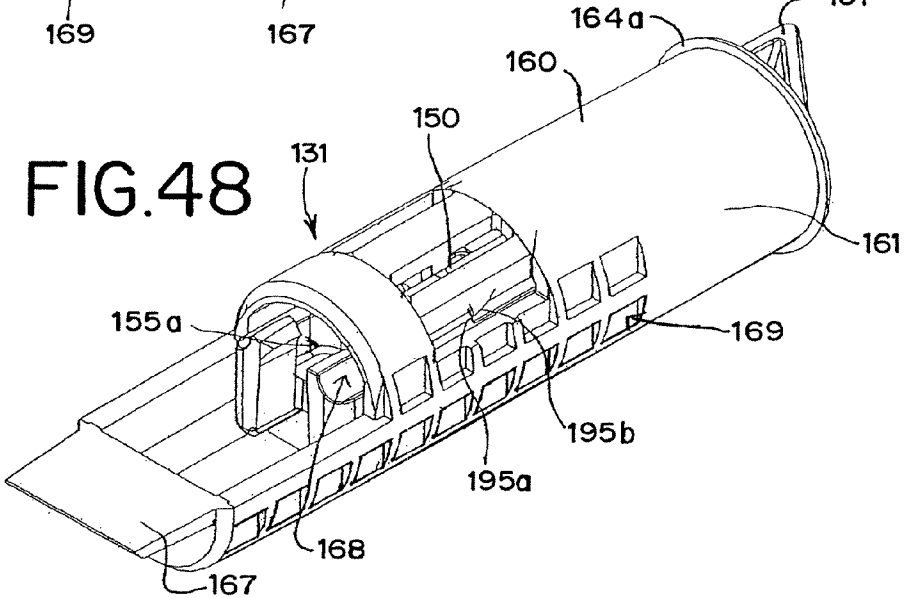
FIG. 48 is a perspective view of a tilt latch mechanism of the integrated tilt latch and sash lock assembly of FIG. 45.
Figure 49:
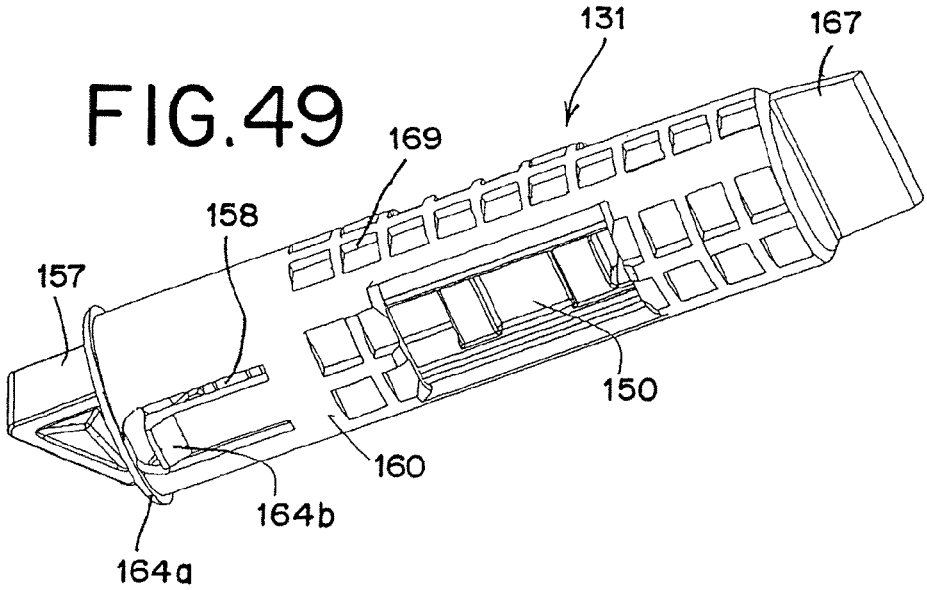
FIG. 49 is a bottom perspective view of the tilt latch mechanism of FIG. 48.
Figure 50:
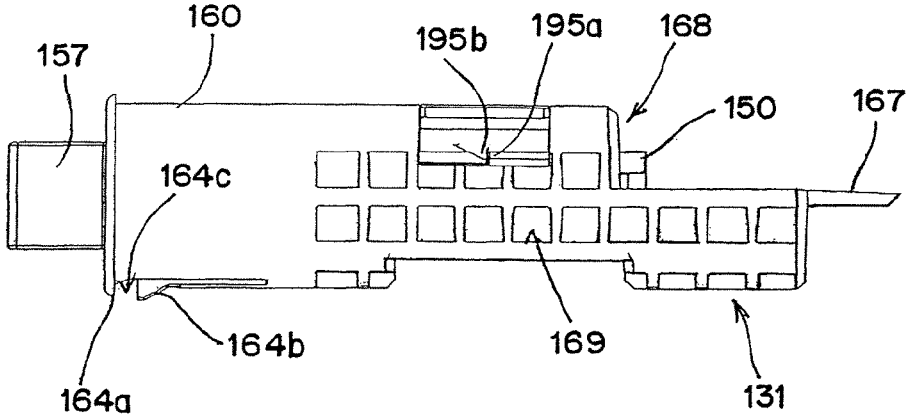
FIG. 50 is a front view of the tilt latch mechanism of FIG. 48.

Referring to FIGS. 1-3, the integrated tilt latch and sash lock assembly 30 generally includes a sash lock mechanism 32 and a tilt latch mechanism 31 that are interconnected by a connector 52, and a keeper or locking bracket 42. The left-side integrated assembly 30 shown in FIGS. 2-3 is supported by, and mounted partially within, the top sash rail 20 and the left stile 24. Generally, the sash lock mechanism 32 and the keeper 42 provide the sash locking operation, the tilt latch mechanism 31 provides the tilt-latch operation, and the connector 52 connects the sash lock mechanism 32 and the tilt latch mechanism 31. One preferred embodiment of the integrated assembly 30 is illustrated in FIGS. 4-44, and another preferred embodiment of the integrated assembly 30 is shown in FIGS. 45-47. The integrated assembly 30 is moveable between a locked position, an unlocked position, and a tiltable position. In the locked position, the tilt latch mechanism 31 prevents the sash window 12 from tilting and the sash lock mechanism 32 prevents the sash window 12 from sliding within the master frame 14. In the unlocked position, the tilt latch mechanism 31 still prevents the sash window 12 from tilting, but the sash lock mechanism 32 is released, leaving the sash window 12 free to slide within the master frame 14. In the tiltable position, the tilt latch mechanism 31 is released, and the sash window 12 may be tilted as shown in FIG. 1. The operation of the integrated assembly 30 is described in greater detail below.

Figure 3A:
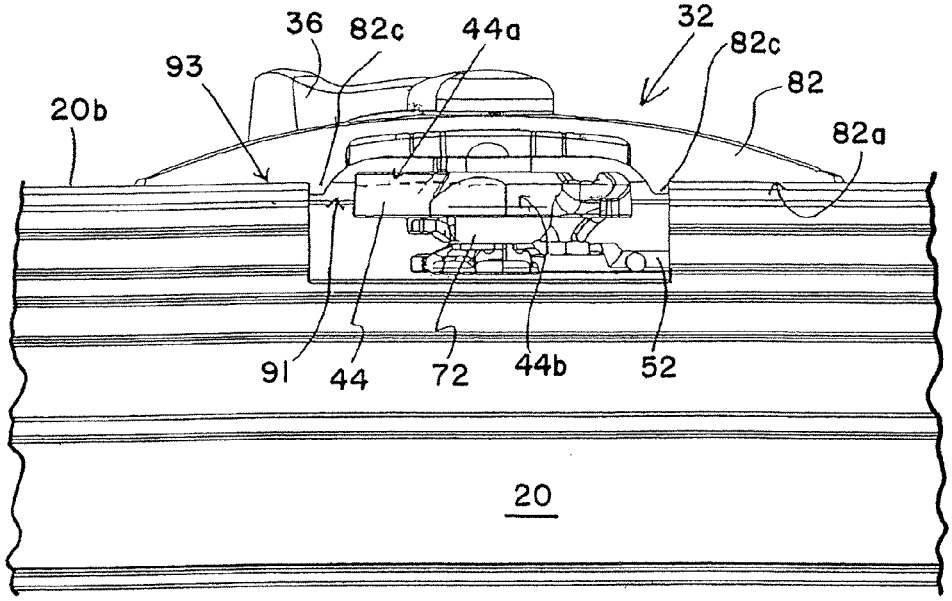
FIG. 3A is a rear view of the integrated tilt latch and sash lock assembly and top sash member of FIG. 3.
Figure 15:
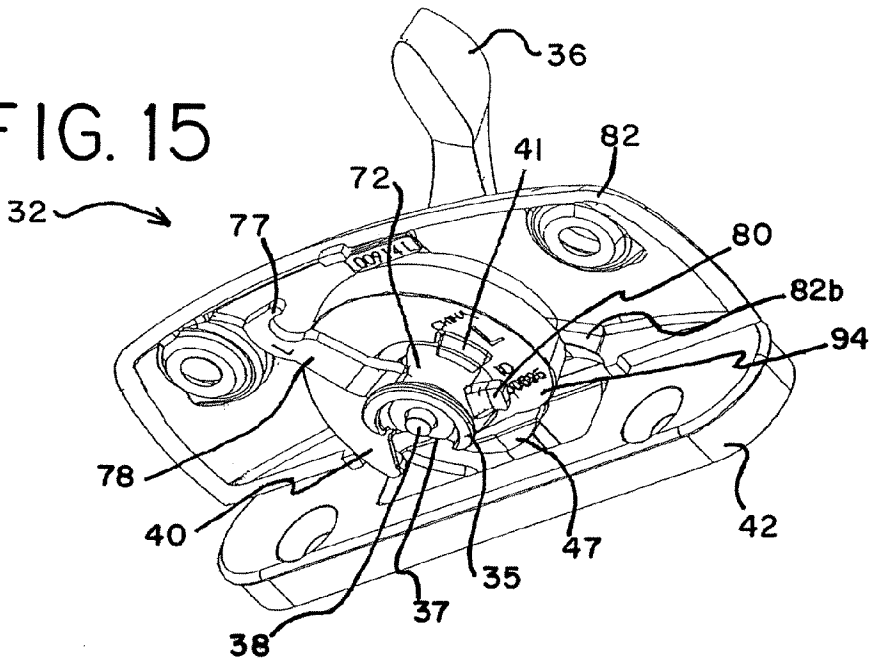
FIG. 15 is a bottom perspective view of a sash lock mechanism and a keeper of the integrated tilt latch and sash lock assembly of FIG. 4, shown in the unlocked position.
Figure 29:
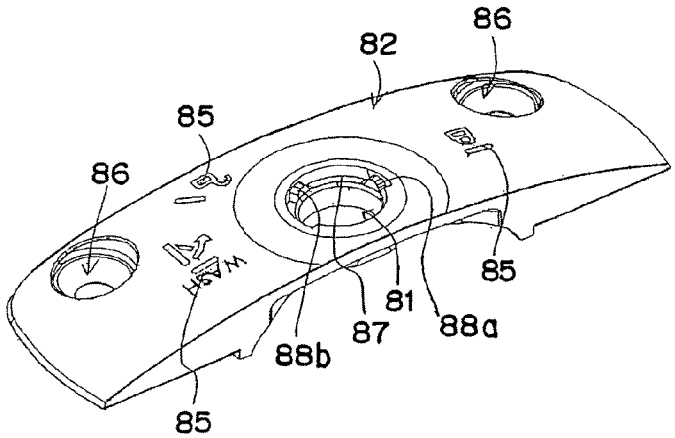
FIG. 29 is a perspective view of a housing of the sash lock mechanism of FIG. 15.
Figure 29A:
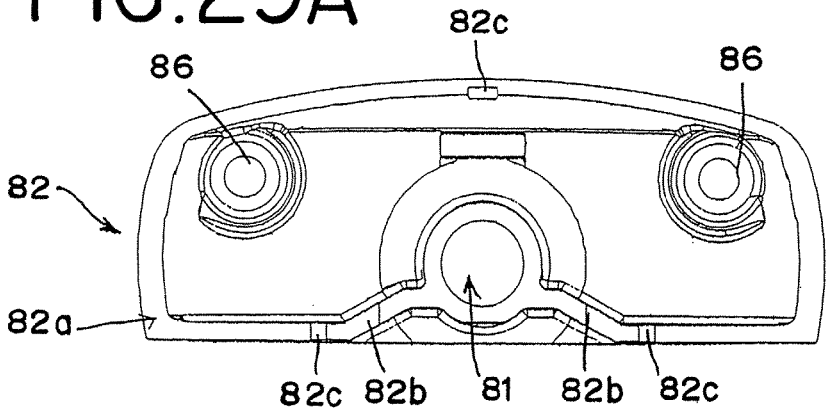
FIG. 29A is a bottom view of the housing of FIG. 29.

As shown in FIGS. 4-20 the sash lock mechanism 32 includes an actuator arm or handle 36 connected to a cam or rotor 44 which is operably connected to a pawl 72, and a housing 82 supporting the other components of the sash lock mechanism 32. The housing 82 is adapted to be mounted on the top sash rail 20 to mount the sash lock mechanism 32 to the sash window assembly 10, and is shown in greater detail in FIG. 29. The housing 82 is preferably made of cast metal and has a curvilinear surface. The housing 82 has an opening 81 therein and indicia 85 on the top surface thereof, as well as a pair of screw apertures 86 for insertion of fasteners to connect the housing 82 to the top sash rail 20. Additionally, as shown in FIG. 29, the housing 82 has an annular ledge 87 having two protrusions 88 positioned at points around the ledge 87. The inside of the housing 82 also has an added beam rail 82*b*, to provide more structural support to the housing 82, as shown in FIGS. 15 and 29A. Further, as illustrated in FIGS. 3A and 29A, the housing 82 has several tabs 82*c* that abut the inner surfaces of the sash lock opening 91 in the top sash rail 20 to hold the housing 82 in place when mounted on the top sash rail 20.

Figure 28:
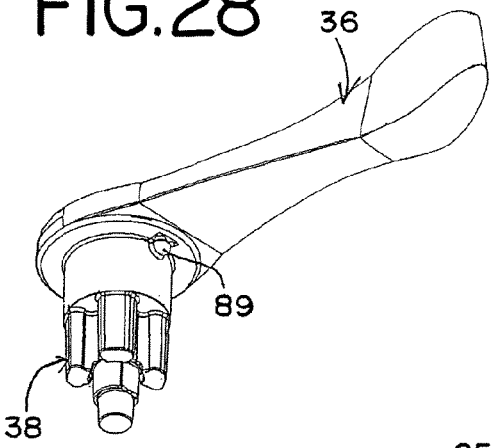
FIG. 28 is a bottom perspective view of an actuator handle of the sash lock mechanism of FIG. 15.

The actuator handle 36 has a shaft 38 extending through the opening 81 in the housing 82 and connected to the cam 44. Preferably, the shaft 38 is received within a complementarily-shaped shaft opening 39 in the cam 44, so that movement of the actuator handle 36 effects rotation of the cam 44. Additionally, a projection 89 is located at the base of the shaft 38, as shown in FIG. 28. When the shaft 38 is inserted into the opening 81 in the housing 82, the projection 89 engages the protrusions 88 on the ledge 87 of the housing 82 during rotation of the actuator handle 36, creating a tactile "feel" and indicating positions of the actuator handle 36, as described in greater detail below. The actuator handle 36 is adapted to be manipulated by a user to move the integrated assembly 30 between the locked position, the unlocked position, and the tiltable position, and thus, the actuator handle 36 preferably has a locked position, an unlocked position, and a tiltable position. The indicia 85 on the housing indicate when the actuator handle 36 is in each of the three positions.

Figure 26:
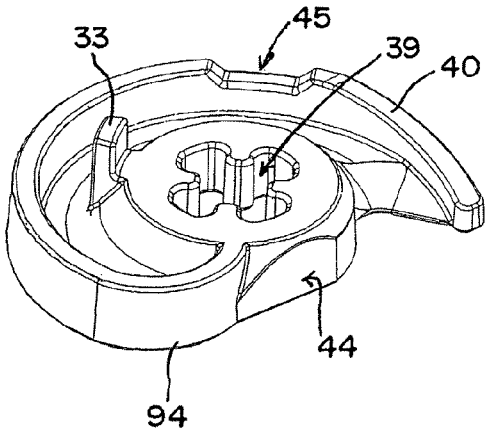
FIG. 26 is a perspective view of a cam of the sash lock mechanism of FIG. 15.
Figure 27:
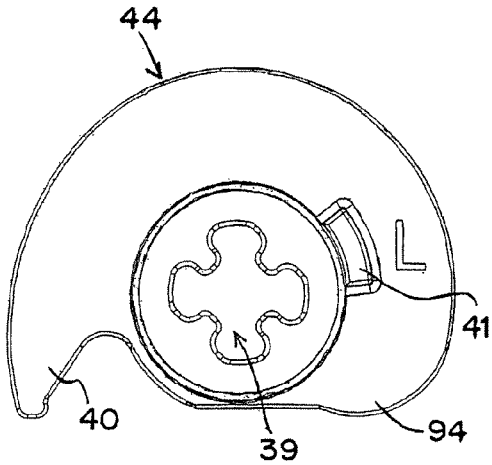
FIG. 27 is a bottom view of the cam of FIG. 26.

A preferred embodiment of the cam 44 is illustrated in greater detail in FIGS. 26-27. The cam 44 is rotatably supported within and below the housing 82 and includes a locking member 40 configured to engage the keeper 42 to lock the sash window 12. The cam 44 is rotated by movement of the actuator handle 36 between a locked position, wherein the locking member 40 of the cam 44 engages the keeper 42 to lock the window 12 in place, and an unlocked position, wherein the locking member 40 of the cam 44 is disengaged from the keeper 42, allowing the window 12 to slide. The cam 44 also includes an abutment member 41 depending from the bottom surface thereof and a stub 33 extending from the top surface thereof. The stub 33 abuts the housing 82 at the ends of the range of rotation of the cam 44, thereby defining and limiting the range of rotation. The abutment member 41 engages the pawl 72, as described in greater detail below. Further, the cam 44 has a means 94 for selectively preventing movement of the integrated assembly 30 to the tiltable position, which generally takes the form of an extending member 94 extending from the cam 44. The extending member 94 may also be referred to as a leg 94 or an abutment member 94 for abutting the keeper 42. In a preferred embodiment, illustrated in FIGS. 26-27, the extending member 94 is an enlarged or eccentric portion 94 of the cam 44 that is rotationally opposite of the locking member 40. When the integrated assembly 30 is in the unlocked position, and a user wishes to move the actuator handle 36 to the tiltable position, the eccentric portion 94 abuts a portion of the keeper 42, preventing rotation of the cam 44. In order to rotate the actuator handle 36 and cam 44 further, the user must lift the sash window 12 slightly, to allow the eccentric portion 94 to clear the keeper 42, and the actuator handle 36 can thus be moved to the tiltable position. Still further, the cam 44 and the keeper 42 preferably have complementary engaging structures that engage each other when the cam 44 is in the locked position to provide a more secure locking connection and create a tactile feel to alert the user that the cam 44 is in the locked position. As shown in FIGS. 15, 15B, 18, and 45, the cam 44 has a notch 45 on or near the locking member 40 that receives a projection 43 on the keeper 42 when the cam 44 is in the locked position to accomplish this function.

Figure 15A:
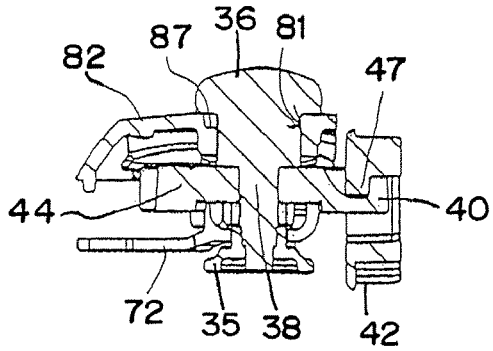
FIG. 15A is a cross-sectional view of the sash lock mechanism and keeper of FIG. 15, shown in the locked position.
Figure 15B:
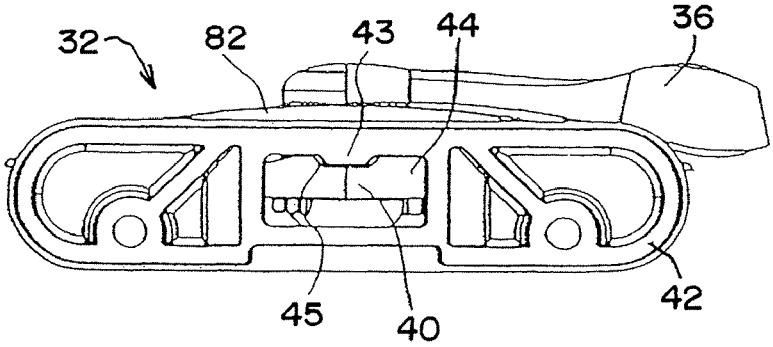
FIG. 15B is a rear view of the sash lock mechanism and keeper of FIG. 15, shown in the locked position.
Figure 16:
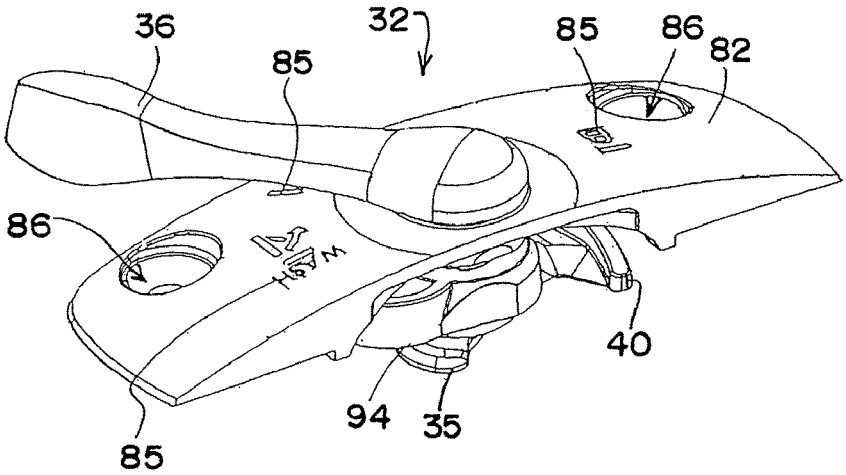
FIG. 16 is a rear perspective view of the sash lock mechanism of FIG. 15, shown in the unlocked position.
Figure 17:
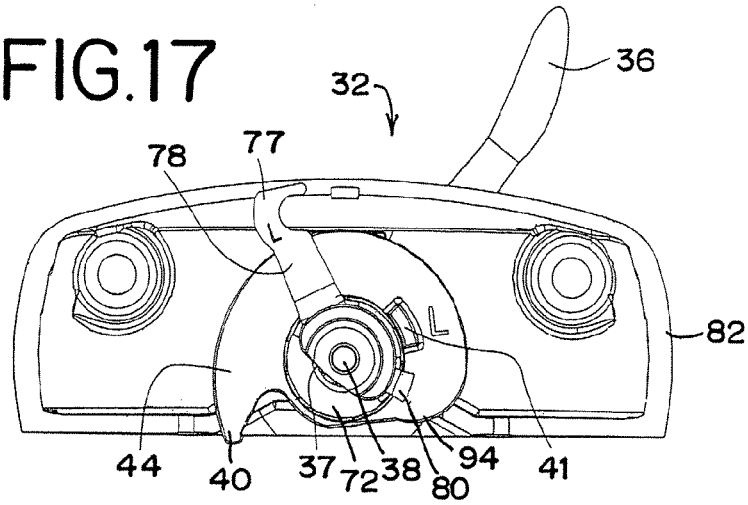
FIG. 17 is a bottom view of the sash lock mechanism of FIG. 15, shown in the unlocked position.
Figure 18:
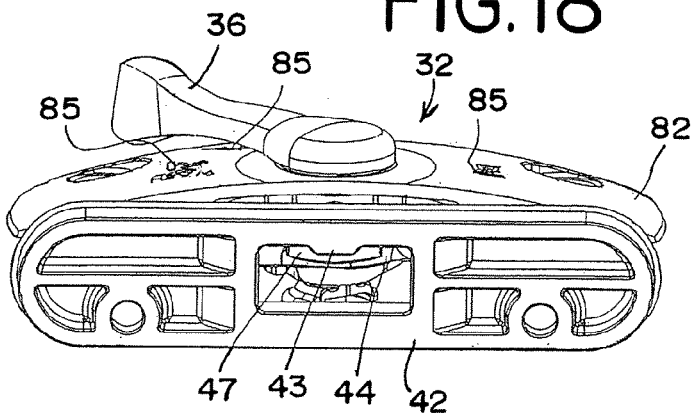
FIG. 18 is a rear view of the sash lock mechanism and keeper of FIG. 15, shown in the unlocked position.

The interlocking between the locking member 40 of the cam or rotor 44 and the keeper 42 is illustrated in more detail in FIGS. 15A and 15B. As shown in FIGS. 15, 15B, 18, and 45, the preferred keeper 42 has a projection 43 that is cooperatively dimensioned with a notch 45 in the rotor 44. When the notch 45 and the projection 43 are aligned, the projection 43 will slip into the notch 45, giving the user a "feel" indication that the assembly 30 is securely in the locked position. Additionally, the keeper 42 has a tongue 47 that interlocks with the locking member 40 of the rotor 44 to hold the sash window 12 more securely closed and give additional protection against forced entry, as illustrated in FIGS. 15, 15A, and 15B.

Figure 19:
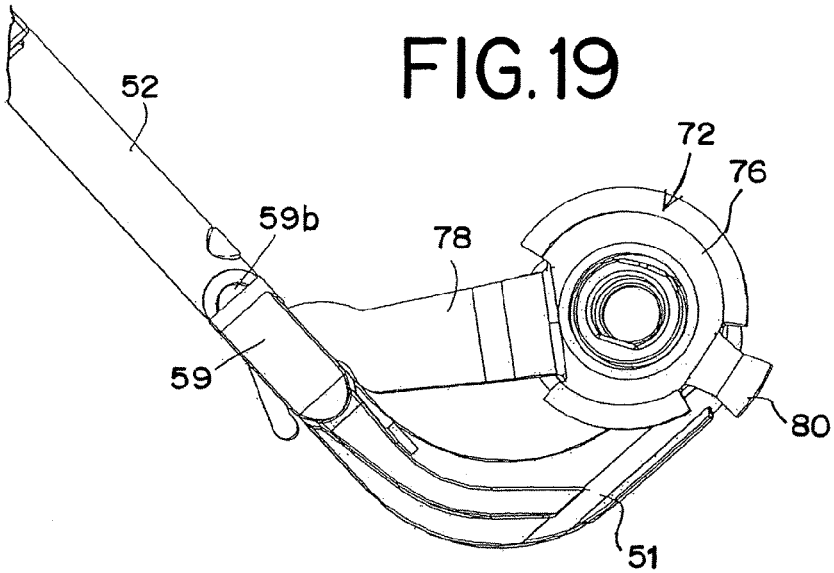
FIG. 19 is a top view of a pawl and a cap of the sash lock mechanism of FIG. 15 and an end of a connector of the integrated tilt latch and sash lock assembly of FIG. 4.
Figure 20:
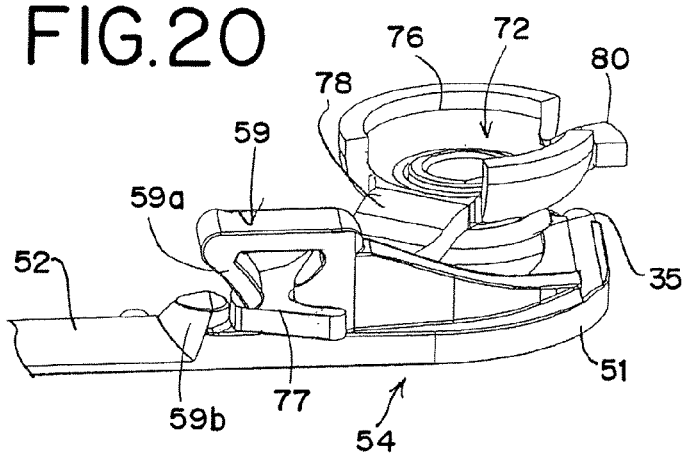
FIG. 20 is a perspective view of the pawl, cap, and connector end of FIG. 19.
Figure 21:
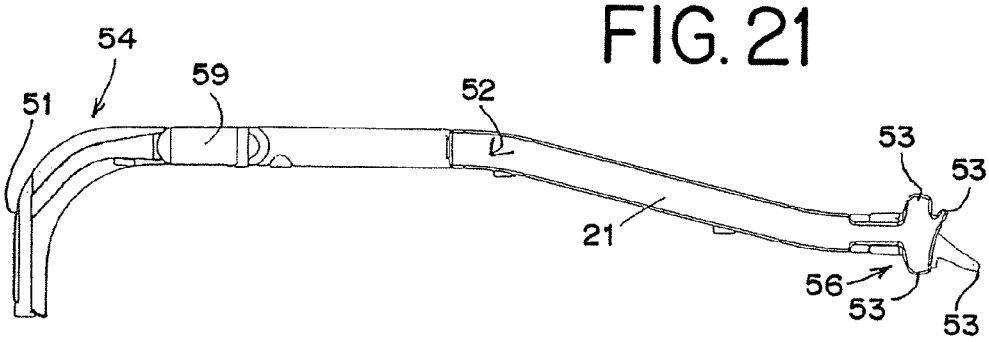
FIG. 21 is a top view of the connector of the integrated tilt latch and sash lock assembly of FIG. 4.
Figure 22:
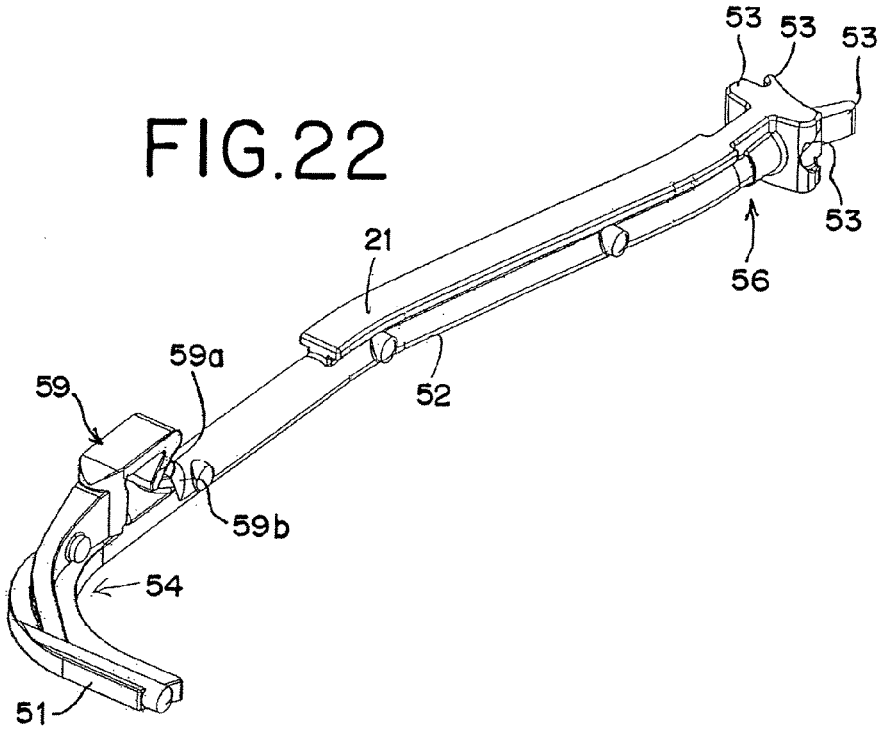
FIG. 22 is a rear perspective view of the connector of FIG. 21.
Figure 23:
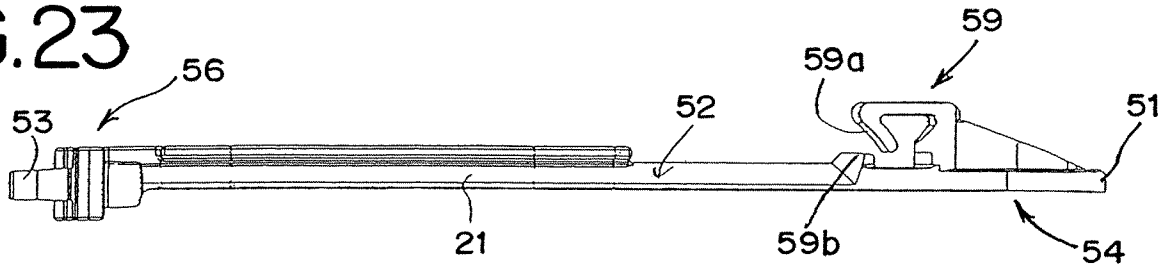
FIG. 23 is a front view of the connector of FIG. 21.
Figure 25:
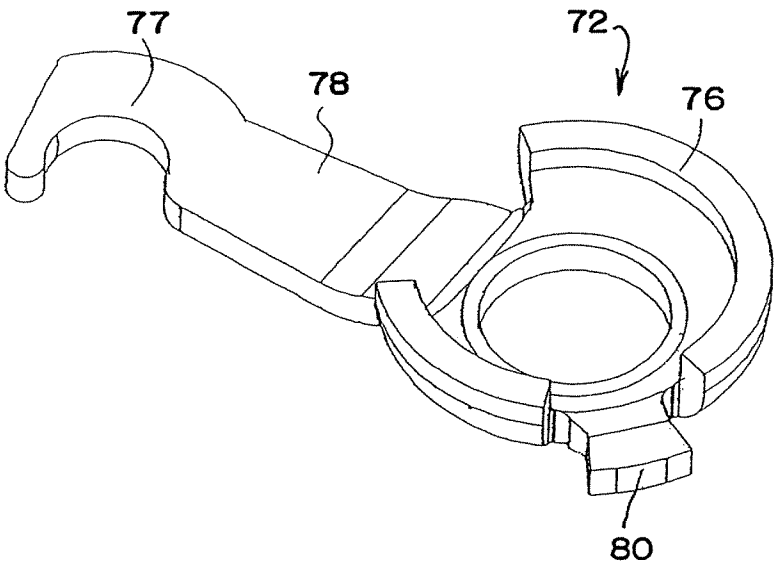
FIG. 25 is a perspective view of the pawl of FIG. 19.
Figure 24:
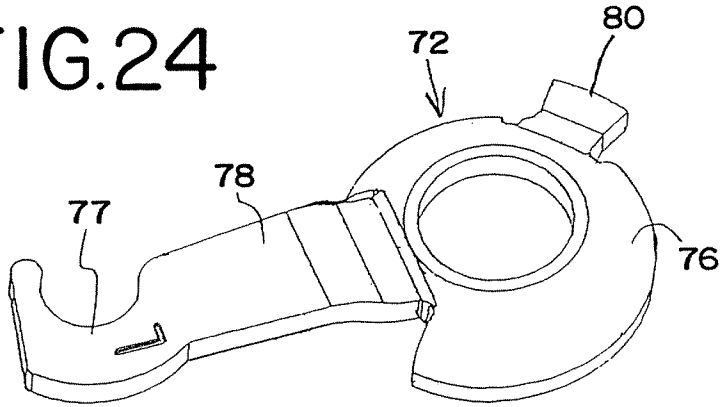
FIG. 24 is a bottom perspective view of the pawl of FIG. 19.

A preferred embodiment of the pawl 72 is illustrated in greater detail in FIGS. 19-20 and 24-25. The pawl 72 includes a base 76 and a pawl member or appending member 78. The pawl 72 is operably associated with the connector 52 that extends away from the sash lock mechanism 32 to the tilt-latch mechanism 31. Preferably, the appending member 78 contains a hook 77 that engages a hitch 59 on the connector 52, directly connecting the pawl 72 to the connector 52, as illustrated in FIGS. 19-20. In this embodiment, the connector 52 contains a retaining structure to hold the hook 77 in place, which includes a flexible lip 59*a* and a protrusion 59*b*. The combination of the lip 59*a* and the protrusion 59*b* force the hook 77 into the retaining structure and then hold the hook 77 in place once the hook 77 is engaged with the hitch 59, forming a snap-fit connection. The pawl 72 is also operably connected to the cam 44 such that rotation of the cam 44 causes rotation of the pawl 72 through a portion of the range of rotation of the cam 44. The cam 44 and the pawl 72 are disposed proximate one another in operable association with each other and a tab 80 extends outwardly from an outer surface of the pawl base 76 to engage the abutment member 41 of the cam 44. Movement of the actuator handle 36 causes the cam 44 to rotate. Preferably, the cam 44 rotates freely and independently of the pawl 72 for a portion of the range of rotation. However, at a point in the rotation, the abutment member 41 of the cam 44 abuttingly engages the tab 80 of the pawl 72, such that when engaged, the cam 44 and the pawl 72 generally rotate in unison. Thus, the actuator handle 36, the cam 44, and the pawl 72 are all operably associated with each other.

The sash lock mechanism 32 illustrated in FIGS. 4-20 additionally includes an asymmetrical or eccentric cap 35 that is operably coupled to the actuator 36 to rotate with movement of the actuator 36. Preferably, the cap 35 is positioned on the bottom side of the pawl 72, opposite the rotor 44, protecting the pawl 72 and securing it to the sash lock mechanism 32. Additionally, the cap 35 is preferably asymmetrical and eccentric in shape, having a beveled or flattened portion 37. The cap 35 operates in a camming action with a curved arm 51 of the connector 52. As the actuator 36 is turned from the locked position, the cap 35 rotates with the cam 44. At a certain point along the rotation, the eccentric nature of the cap 35 causes the cap 35 to engage the arm 51 on the connector 52. Further rotation of the cap 35 exerts a force on the connector arm 51, pulling the connector 52 slightly, which in turn retracts the latch bolt 50 slightly. This permits the integrated assembly 30 to begin retraction of the latch bolt 50 prior to the point where the rotor 44 abuttingly engages the pawl 72.

The integrated assembly shown in FIGS. 4-14 contains one embodiment of the tilt latch mechanism 31, which is shown in greater detail in FIGS. 30-38. The tilt latch mechanism 31 is preferably disposed within the sash window 12, preferably within a cavity 90 in the sash window 12 that extends through both the stile 24,26 and the top sash rail 20. This embodiment of the tilt latch mechanism 31 includes a latch bolt 50 disposed within a housing 60 and coupled to the connector 52, and a means 63 for biasing the latch bolt outwardly, which is preferably a spring 63. It is understood the spring 63 is generally positioned between the latch bolt 50 and the housing 60 to bias the latch bolt 50 outwardly from the housing 60 through a latch bolt opening 62 in the end of the housing 60. The spring 63 is preferably not evenly coiled, but rather has densely-coiled portions and more loosely-coiled portions. These densely-coiled portions prevent springs 63 stored in bulk from becoming intertwined and/or stuck together.

Figure 33:
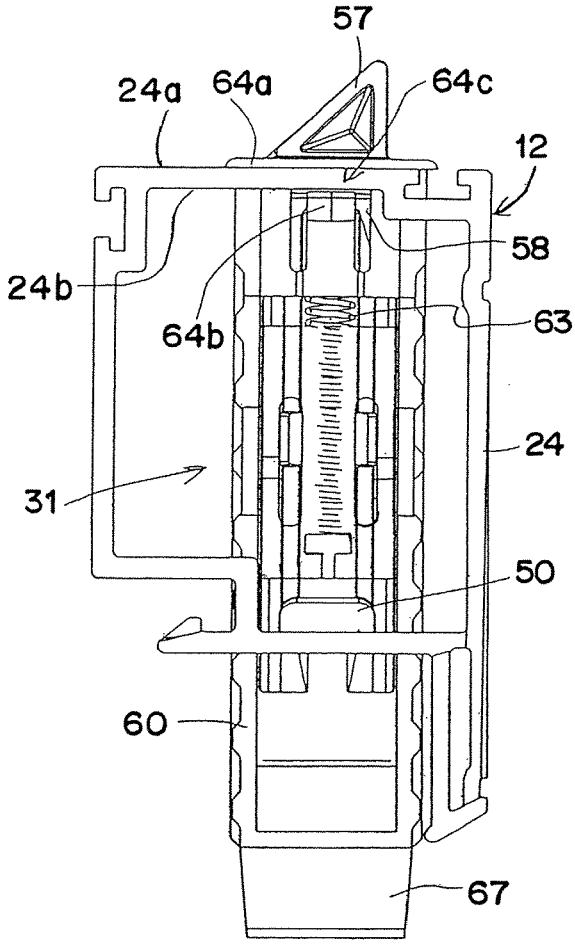
FIG. 33 is a bottom view of the tilt latch mechanism of FIG. 30 mounted in a stile of a sash window assembly.
Figure 34:
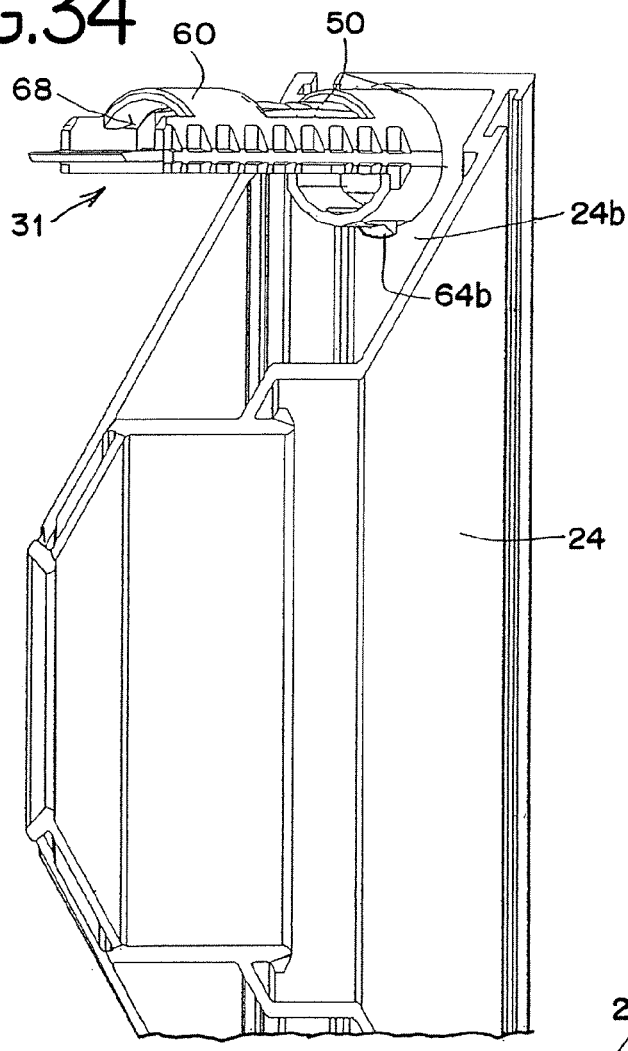
FIG. 34 is a perspective view of the tilt latch mechanism and stile of FIG. 33.
Figures 36, 37, 38, 39:
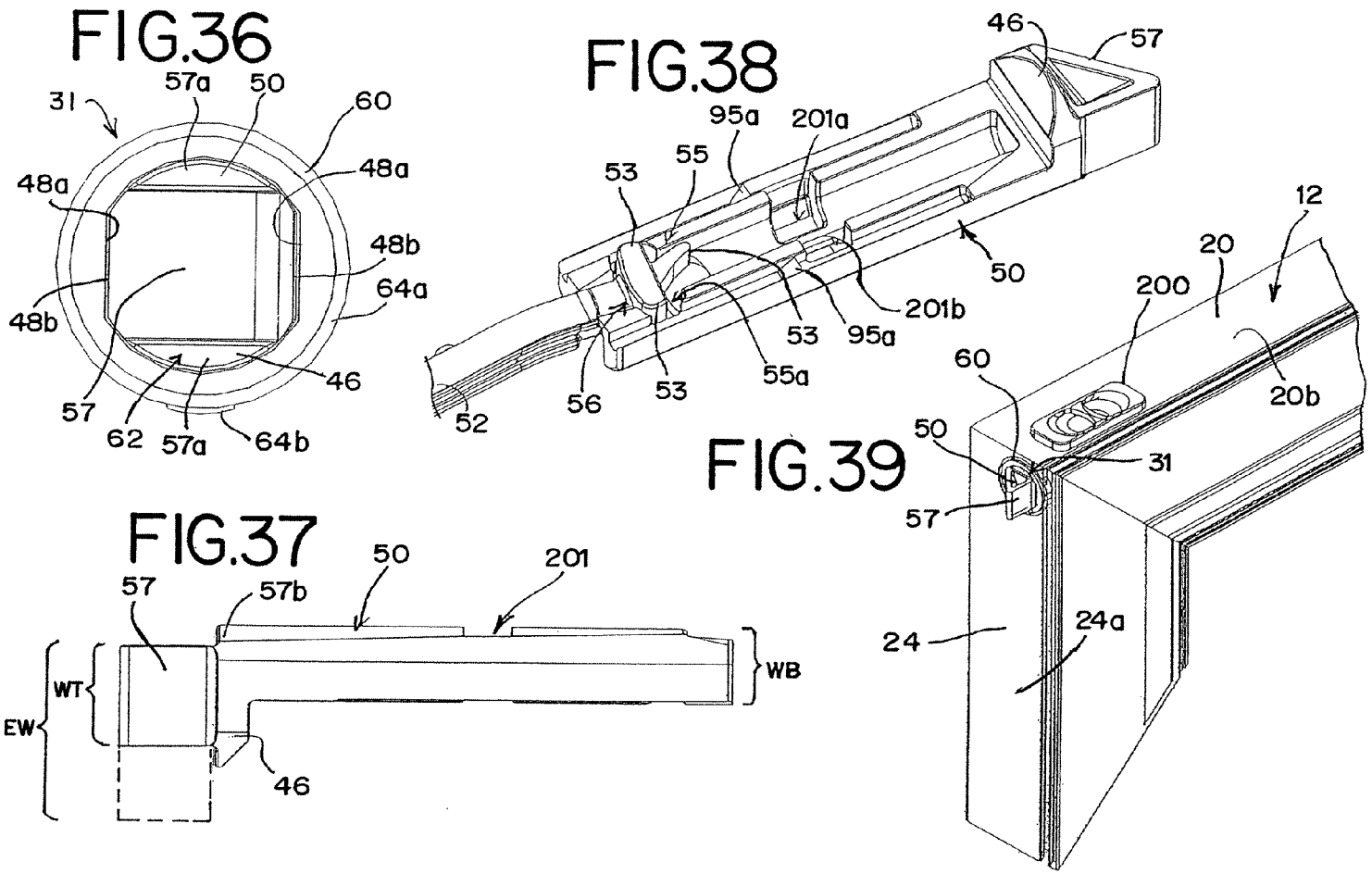
FIG. 36 is a side view of the tilt latch mechanism of FIG. 30.
FIG. 37 is a front view of the latch bolt of FIG. 35.
FIG. 38 is a bottom perspective view of the latch bolt of FIG. 35 and an end of the connector of the integrated tilt latch and sash lock assembly of FIG. 4.
FIG. 39 is a perspective view of a portion of a sash window assembly incorporating a stand-alone tilt latch mechanism of the present invention.

The housing 60 is used to support the latch bolt 50 within the sash window 12. In a preferred embodiment, the housing 60 is substantially cylindrical, having a curvilinear outer surface and appearing round when viewed in a side view (FIG. 36). The cylindrical housing 60 is adapted to be inserted into a round hole 92 in one of the stiles 24,26, as shown in FIGS. 2, 2A, 33, and 34, so that no hole in the top sash rail 20 is necessary for installation, and the tilt latch mechanism 31 is completely hidden beneath the top sash rail 20. The housing 60 has opposed stile-engaging members 64 that are adapted to engage both an outer surface 24*a* and an inner surface 24*b* of the stile 24. As shown in FIGS. 33-34, a preferred embodiment of the tilt latch mechanism 31 has stile-engaging members 64 in the forms of a circular flange 64*a* around the latch bolt opening 62 that engages the outer surface 24*a* of the stile 24 and a flexible, resilient tab 64*b* that engages the inner surface 24*b* of the stile 24. More generally, the tilt latch housing 60 contains a flange 64*a* and a tab 64*b* defining a gap 64*c* therebetween, and a portion of the lower sash window 12 is received within the gap 64*c*. The flange 64*a* and the tab 64*b* cooperate to hold the tilt latch mechanism 31 in place within the sash window 12. The housing 60 also includes a window 58 around the tab 64*b*, which provides ample room for the tab 64*b* to flex upward upon contact with the stile 24 during insertion of the tilt latch mechanism 31 into the sash window 12. Preferably, the window 58 is dimensioned cooperatively with the tab 64*b*, so that the tab 64*b* can easily deflect into the housing 60 through the window 58. Once the tab 64*b* clears the inner surface 24*b* of the stile 24, the resilient tab 64*b* snaps back into its original position to engage the inner surface 24*b* of the stile 24. The flexible, resilient tab 64*b* is able to deflect as described above without being permanently deformed.

The cylindrical housing 60 preferably has a curvilinear outer sidewall 61 having a series of ribs 69 thereon, a rear opening 68, and a stabilizing member 67 proximate the rear opening 68. The rear opening 68 allows the connector 52 to pass through and connect to the latch bolt 50, and is preferably defined at the rear of the housing 68, opposite the latch bolt opening 62, as illustrated in FIGS. 4-14 and 30. The ribs 69 create a waffle-structure that strengthens the housing and improves its strength:weight ratio. The stabilizing member 67 is preferably a flat tongue 67 extending from the housing 60 proximate the rear opening 68, and is adapted to engage an inner wall 20*a* of the top sash rail 20 to stabilize the housing 60 and prevent the housing 60 from rotating within the sash window 12. As shown in FIG. 3, the stabilizing member 67 preferably rests upon the inner wall 20*a* of the top sash rail 20. It is understood that the stabilizing member 67 may have another configuration suitably adapted to engage the inner wall of the top rail 20. The housing 60 of the tilt latch mechanism shown in FIGS. 4-14 and 30-38 also preferably has a cut-out portion 66 at the bottom of the housing 60 and a slot or elongated opening 205 at the top of the housing 60. The cut-out portion 66 decreases the size of the housing 60, both allowing the housing 60 to fit into smaller spaces and decreasing the amount of material used to manufacture the housing 60. Thus, a portion of the housing proximate the latch bolt opening 62 is a complete cylinder, and the rear portion of the housing 60 is partially-cylindrical. The slot 205 allows for insertion of an actuator 200 to operate the tilt latch mechanism 31 independently, as described in greater detail below.

Figure 35:
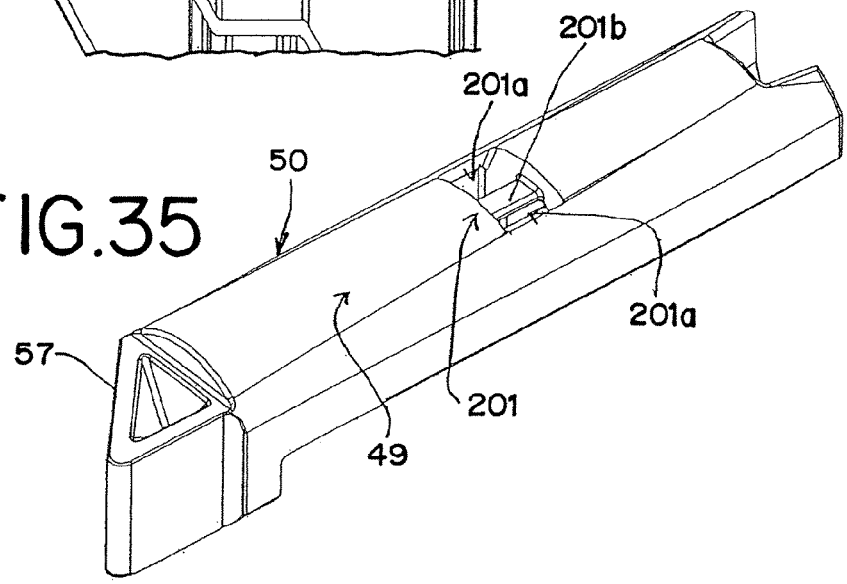
FIG. 35 is a perspective view of a latch bolt of the tilt latch mechanism of FIG. 30.

The latch bolt 50 of the tilt latch mechanism 31 of FIGS. 4-14 and 30-38 is shown alone in FIGS. 35, 37, and 38. The latch bolt 50 is adapted to slide within the housing 60 between a retracted position, wherein the nose or tip 57 of the latch bolt 50 is retracted into the housing 60, and an outwardly-extended position, wherein the nose 57 of the latch bolt 50 extends beyond the end of the housing 60 and beyond the edge of the stile 24,26. This movement of the latch bolt 50 is shown in FIGS. 4-14 and is discussed in greater detail below. When the sash window 12 is closed, the latch bolt 50 engages one of the guide rails 16 in the outwardly-extended position to prevent the window 12 from tilting. The spring 63 is generally positioned between a portion of the latch bolt 50 and a portion of the housing 60, and biases the latch bolt 50 towards the outwardly-extended position. Additionally, the nose or tip 57 of the latch bolt 50 is generally angled or beveled on one side, so that the window 12 may be shut wherein the beveled surfaces engage edges of the guide rails 16 as the sash window 12 is pivoted to the vertical position wherein the latch bolts 50 are retracted into the housing 60 and then extend back outwardly to engage the guide rails 16 when the sash window is in the unpivoted position.

The latch bolt 50 is dimensioned to fit properly within the cylindrical housing 60, which has a rounded latch bolt opening 62, as shown in FIG. 36. Thus, the latch bolt 50 preferably has at least one generally rounded portion. In the embodiment shown in FIGS. 35-38, the latch bolt opening 62 of the housing 60 is generally circular with beveled or flat edges 48*a*, and an end portion 46 of the latch bolt 50 is similarly dimensioned, being generally circular with beveled flat edges 48*b*. The cooperative engagement of the beveled edges 48*a*,48*b* prevent rotation of the latch bolt 50 within the housing 60. The tip 57 of the latch bolt 50 preferably has a different cross-sectional shape than the portion of the latch bolt 50 immediately adjacent the tip 57. As shown in FIG. 36, the tip 57 is rectangular and extends from the enlarged end portion 46 that is dimensioned to fill the latch bolt opening 62. The transition or "filler" segments 57*a* caused by difference in shape between the rectangular tip 57 and the rounded body of the latch bolt 50 can be seen in FIG. 36. As discussed, the tilt-latch housing 60 has generally circular cross-section while the tip 57, or nose 57, of the latch bolt 50 has more of a rectangular cross-section. The latch bolt 50 includes the filler segments 57*a* that "fill" the areas between the tip 57 and the rounded surfaces defining the end opening 62 of the housing 60. Thus, the segments 57*a* have a planar portion adjacent the tip 57 and a rounded portion adjacent the housing 60. It is understood that in a preferred embodiment, fill segments 57*a* are integral with the latch bolt 50.

Further, as illustrated in FIG. 37, the width (WT) of the tip 57 of the latch bolt 50 and the width of the portion 57*b* of the latch bolt 50 adjacent the tip 57 are generally greater than the width (WB) of the bulk of the latch bolt 50. Thus, even though the main portion of the latch bolt 50 is sized to fit within the tilt-latch housing 60 having a smaller configuration to fit within smaller pockets of the top rail 20, the width (WT) of the tip 57 can have a conventional width that provides a suitable engagement surface for the guide rails 16. In another embodiment, the tip 57 of the latch bolt 50 may be substantially larger than the rest of the latch bolt 50 or even larger than the housing 60 to provide a larger engagement surface (EW) because the latch bolt tip 57 need not fit completely into the housing 60. This enlarged design is shown schematically by the dotted lines in FIG. 37. The housing 60 can be designed with a slot or gap (not shown) therein to permit retraction of a latch bolt tip 57 much wider than the housing 60. In such case, the flexible stile engaging member 64*b* may be suitable relocated on the housing 60. The hole provided in the stile would also be enlarged to accommodate the enlarged nose or tip 57. Thus, the latch bolt 50 and housing 60 can be designed to be very small, while the tip 57 of the latch bolt 50 can be of a different size. As shown in FIGS. 35 and 37, the latch bolt 50 has a rounded top surface 49 that is dimensioned similarly to the rounded housing 60. Additionally, the latch bolt 50 preferably has a stop 95*a* (FIG. 38) that abuts an abutment surface 95*b* of the housing 60 to prevent the latch bolt 50 from being pushed out of the housing 60 farther than is necessary for engaging the guide rail 16. It is understood that the latch bolt 50 and the cavity of the housing 60 may be differently shaped, and may include different features to prevent rotation of the latch bolt 50 within the housing 60.

The connector 52 connects to the latch bolt 50, preferably by a snap-fit connection 55, as illustrated in FIGS. 4-14 and 38. The latch bolt 50 preferably has a recess 55*a* on the underside of the latch bolt 50 to receive the end 56 of the connector 52 and create the snap-fit connection 55. As illustrated in FIGS. 21-23 and 38, the second end 56 of the connector 52 preferably has several resilient bracing arms 53 extending therefrom. When the connector end 56 is snapped into the latch bolt 50, the bracing arms 53 exert directional forces on the latch bolt 50, thus bracing the connector 52 against excessive movement during operation of the assembly 30. Also, the top wall of the housing 60 covers the snap fit connection 55 when the latch bolt 50 is extended, resisting disconnection of the connector 52 from the latch bolt 50.

The integrated assembly 30 includes a connector 52 that connects the sash lock mechanism 32 to the tilt latch mechanism 31. The connector 52 has a substantially rigid or semi-flexible, elongated body 21 with a first end 54 connected to the sash lock mechanism 32 and a second end 56 connected to the tilt latch mechanism 31. The first end 54 of the connector 52 is operably associated with the pawl 72, preferably by engaging the appending member 78 of the pawl 72. As described above, the connector 52 preferably has the hitch 59 that engages the hook 77 on the appending member 78 of the pawl 72 and the retaining structure that includes the flexible lip 59*a* and the protrusion 59*b*. The second end 56 of the connector 52 is connected to the latch bolt 50, preferably by passing through the rear opening 68 of the housing 60 and forming a snap-fit connection 55 with the latch bolt, as described above and illustrated in FIGS. 4-14 and 38. As also described above, when the connector end 56 is snapped into the latch bolt 50, the bracing arms 53 exert directional forces on the latch bolt 50, thus bracing the connector 52 against excessive movement during operation of the assembly 30. Additionally, the bracing arms 53 exert a downward force or torque on the connector 52, tending to push the first end 54 of the connector downward. Pushing the first end 54 of the connector 52 downward helps assure that the connector 52 remains in the proper position for connection to the sash-lock mechanism 32, facilitating a user in making a blind connection between the connector 52 and the sash lock mechanism 32. However, the positioning of the bracing arms 53 permits a certain amount of lateral pivoting of the connector 52, which enables mounting in different positions, as described below.

In a preferred embodiment, the connector 52 is a substantially rigid or semi-flexible connecting rod having an elongated body 21. The rigid or semi-flexible connector 52 preferably has a bend in the middle to prevent interference between the connector 52 and mounting structure for the sash lock mechanism 32. Further, the connector 52 has a curved arm 51 at the first end 54 that engages the eccentric cap 35 of the sash lock mechanism 32 to retract the latch bolt 50 slightly, as described below. The non-flexible nature of the connector 52 provides advantages over prior connecting means that utilize flexible cords or bands. For example, the non-flexible connector 52 has increased dimensional stability, so the connector 52 doesn't stretch over time and affect the functioning of the integrated assembly 30. However, in another embodiment, a flexible cord or band may be used as the connector 52 of the present invention.

The length of the connector 52 used with the integrated assembly 30 can vary as desired, for example, in order to mount the integrated assembly 30 in windows of different dimensions. In a preferred embodiment, the connector 52 has a fixed length, and thus, different connectors 52 having different lengths can be produced and selected for use as desired. In other words, the connector 52 selected from a group consisting of a plurality of connectors 52 having different lengths.

Generally, it is preferred that the mounting length between the center of rotation of the cam 44 (i.e., the center of the shaft 38) and the stile outer surface 24*a* is 15-25% of the total length of the top rail 20 when the integrated assembly 30 is mounted in the sash window 12. This positioning maximizes the strength of the top rail 20. In one preferred configuration, the mounting length is 4.5 in. (±1 in.), and the corresponding length of the connector 52 is 3.520 in. (±1 in.). In another preferred configuration, the mounting length is 7.75 in. (±1 in.), and the corresponding length of the connector 52 is 6.770 in. (±1 in.). In a third preferred configuration, the mounting length is 11 in. (±1 in.), and the corresponding length of the connector 52 is 10.020 in. (±1 in.). As described above, a nearly infinite number of other configurations are possible. The connector 52 lengths are selected based on window size and to enhance overall manufacturability, strength, and user operation.

Another embodiment of an integrated assembly 130 is illustrated in FIGS. 45-56. Most of the components of the integrated assembly 130 shown in FIGS. 45-56 are the same or similar to those of the integrated assembly 30 shown in FIGS. 4-38, and are consistently numbered using the "100" series of reference numbers. Preferably, the embodiment 130 shown in FIGS. 45-56 has the same sash lock mechanism 132 as the embodiment 30 described above. However, the integrated assembly 130 has a different tilt-latch mechanism 131 than the integrated assembly 30 described above.

Figure 52:
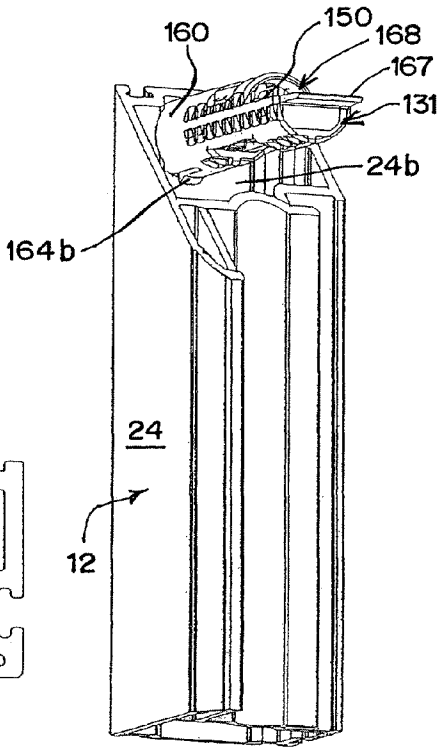
FIG. 52 is a bottom perspective view of the tilt latch mechanism and stile of FIG. 51.
Figure 51:
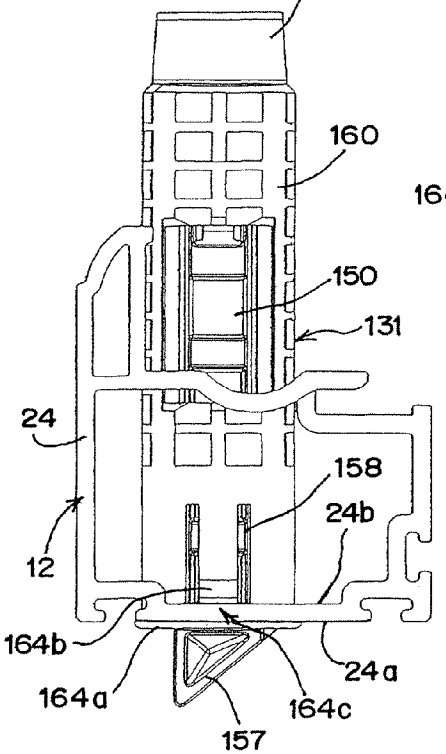
FIG. 51 is a bottom view of the tilt latch mechanism of FIG. 48 mounted in a stile of a sash window assembly.

The housing 160 of the tilt latch mechanism 131 is substantially cylindrical, having a curvilinear outer surface and appearing round when viewed in an end view (FIG. 54), but is differently shaped than the housing 60 described previously. The body 165 of the housing 160 is completely cylindrical over a larger portion of its length, and does not have the substantial cut-out portion 66 of the housing 60 described above. The cylindrical housing 160 is adapted to be inserted into a round hole 92 in one of the stiles 24,26, as shown in FIGS. 51-52, so that no hole in the top sash rail 20 is necessary for installation, and the tilt latch mechanism 131 is completely hidden beneath the top sash rail 20. The housing 160 has opposed stile-engaging members 164 that are adapted to engage both an outer surface 24*a* and an inner surface 24*b* of the stile 24. As shown in FIGS. 51-52, a preferred embodiment of the tilt latch mechanism 131 has stile-engaging members 64 in the forms of a circular flange 164*a* around the latch bolt opening 162 that engages the outer surface 24*a* of the stile 24 and a flexible, resilient tab 164*b* that engages the inner surface 24*b* of the stile 24. The flange 164*a* and the tab 164*b* cooperate to hold the tilt latch mechanism 131 in place within the sash window 12. More generally, the tilt latch housing 160 contains a flange 164*a* and a tab 164*b* defining a gap 164*c* therebetween, and a portion of the lower sash window 12 is received within the gap 164*c*. The housing 160 also includes a window 158 around the tab 164*b*, which provides ample room for the tab 164*b* to flex upward upon contact with the stile 24 during insertion of the tilt latch mechanism 31 into the sash window 12. Preferably, the window 158 is dimensioned cooperatively with the tab 164*b*, so that the tab 164*b* can easily deflect into the housing 160 through the window 158. Once the tab 164*b* clears the inner surface 24*b* of the stile 24, the resilient tab 164*b* snaps back into its original position to engage the inner surface 24*b* of the stile 24. The flexible, resilient tab 164*b* is able to deflect as described above without being permanently deformed.

The cylindrical housing 160 preferably has a generally curvilinear outer sidewall 161 having several ribs 169 thereon, a rear opening 168, and a stabilizing member 167 proximate the rear opening 168. The rear opening 168 allows the connector 52 to pass through and connect to the latch bolt 150, and is preferably defined at the rear of the housing 168, opposite the latch bolt opening 162, as illustrated in FIGS. 45-47 and 55. The ribs 169 enhance the strength of the housing 160, as described above. The stabilizing member 167 is preferably a flat tongue 167 extending from the housing 160 proximate the rear opening 168, and is adapted to engage an inner wall of the top sash rail 20 to stabilize the housing 160 and prevent the housing 160 from rotating within the sash window 12, as described above. It is understood that the stabilizing member 167 may have another configuration suitably adapted to engage the inner wall of the top rail 20.

Figure 53:
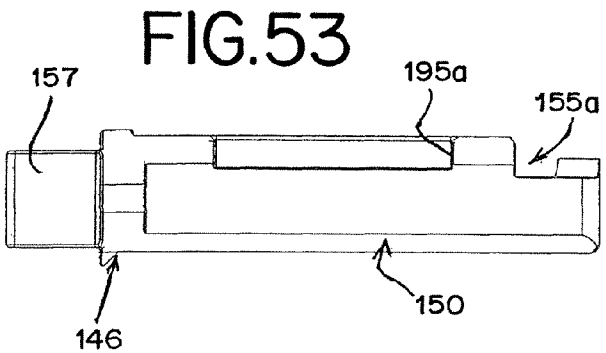
FIG. 53 is a rear view of a latch bolt of the tilt latch mechanism of FIG. 48.
Figure 54:
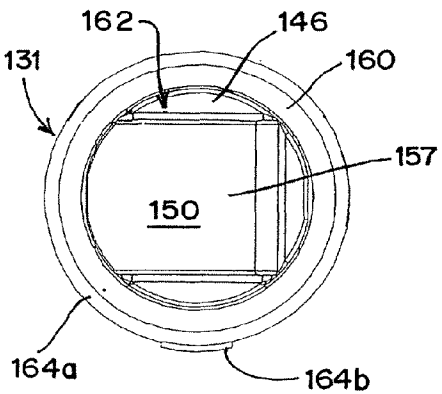
FIG. 54 is a side view of the tilt latch mechanism of FIG. 48.
Figure 55:
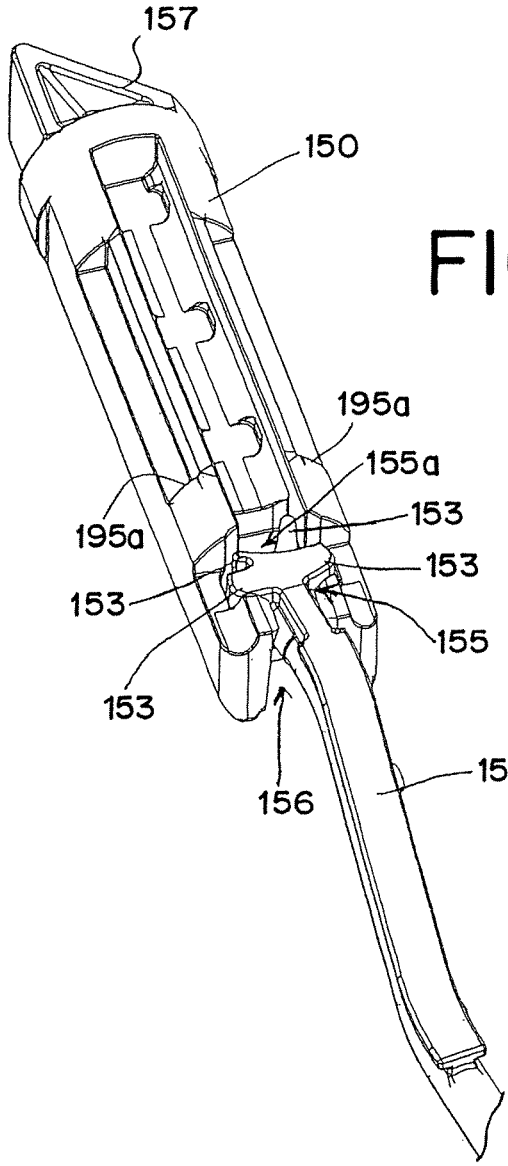
FIG. 55 is a perspective view of the latch bolt of FIG. 53 with an end of a connector of the integrated tilt latch and sash lock assembly of FIG. 45.
Figure 56:
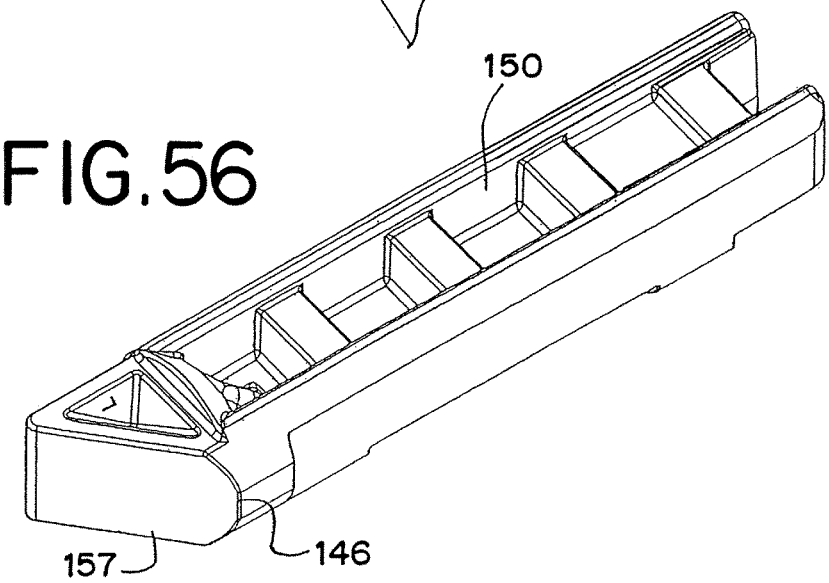
FIG. 56 is a bottom perspective view of the latch bolt of FIG. 53.

The latch bolt 150 of the tilt latch mechanism 131 of FIGS. 45-56 is shown alone in FIGS. 53 and 55-56. The latch bolt 150 is adapted to slide within the housing 160 between a retracted position, wherein the nose 157 or tip 157 of the latch bolt 150 is retracted into the housing 160, and an outwardly-extended position, wherein the tip 157 of the latch bolt 150 extends beyond the end of the housing 160 and beyond the edge of the stile 24,26. This movement of the latch bolt 150 is generally the same as the latch bolt 50 of the integrated assembly 30 shown in FIGS. 4-38 and discussed herein. When the sash window 12 is closed, the latch bolt 150 engages one of the guide rails 16 in the outwardly-extended position to prevent the window 12 from tilting. The spring 163 is generally positioned between a portion of the latch bolt 150 and a portion of the housing 160, and biases the latch bolt 150 towards the outwardly-extended position. Additionally, the tip 157 of the latch bolt 150 is generally angled or beveled on one side, so that the window 12 may be pushed shut into the sash window assembly 10 as described above.

The latch bolt 150 is dimensioned to fit properly within the cylindrical housing 160, which has a rounded latch bolt opening 162, as shown in FIG. 54. Thus, an end portion 146 of the latch bolt 150 preferably has at least one rounded portion. In the embodiment shown in FIGS. 53-56, the latch bolt opening 162 of the housing 160 is generally circular, but does not have flat edges like those of the tilt latch mechanism 31 described above. The end portion 146 of the latch bolt 150 is similarly dimensioned, being generally circular, and also does not have flat edges. However, the end portion 146 of the latch bolt 150 is not as large compared to the body of the latch bolt 150 as the end portion 46 of the latch bolt 50 described above. The end portion 146 also serves as fill segments as described above. The tip 157 of the latch bolt 150 is preferably rectangular, and the transition area caused by difference in shape between the rectangular tip 157 and the rounded body of the latch bolt 150 can be seen in FIG. 54. As shown in FIG. 56, the latch bolt 150 does not have a rounded top surface like the latch bolt 50 described previously. However, the latch bolt 150 is completely cylindrical along a greater portion of its length than the latch bolt 50 described previously. Additionally, the latch bolt 150 preferably has a stop 195*a* that abuts an abutment surface 195*b* of the housing 160 to prevent the latch bolt 150 from being pushed out of the housing 160 farther than is necessary for engaging the guide rail 16. It is understood that the latch bolt 150 and the cavity of the housing 160 may be differently shaped, and may include various features to prevent rotation of the latch bolt 150 within the housing 160.

The connector 152 connects to the latch bolt 150, preferably by a snap-fit connection 155, as illustrated in FIGS. 45-47 and 55. The latch bolt 150 preferably has a recess 155*a* to receive the end 156 of the connector 152 and create the snap-fit connection 155. The recess 155*a* of the latch bolt 150 is located on the top side of the latch bolt 150, in contrast to the recess 55*a* of the latch bolt 50 described above, which is located on the underside of the latch bolt 50. As described above, the second end 156 of the connector 152 preferably has several resilient bracing arms 153 extending therefrom. When the connector end 156 is snapped into the latch bolt 150, the bracing arms 153 exert directional forces on the latch bolt 150, thus bracing the connector 152 against excessive movement during operation of the integrated assembly 130.

Figure 85:
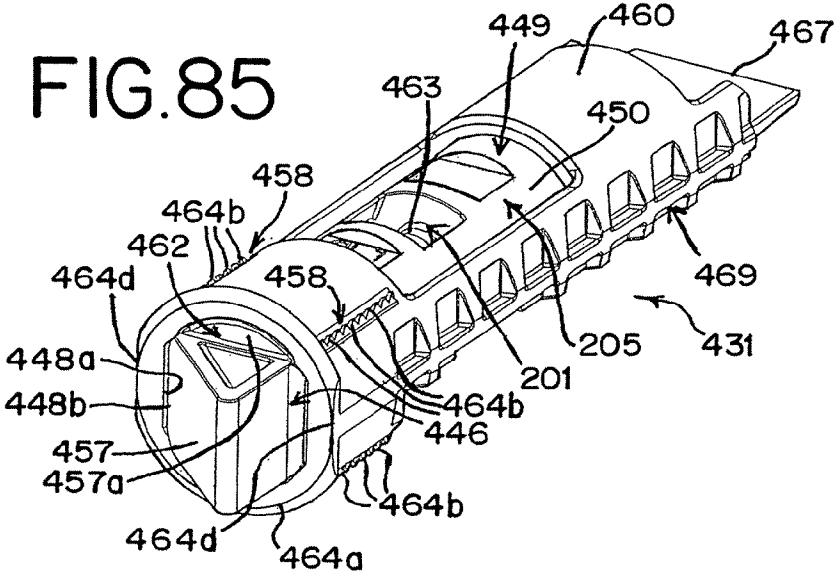
FIG. 85 is a perspective view of another embodiment of a tilt latch mechanism of the present invention.
Figure 86:
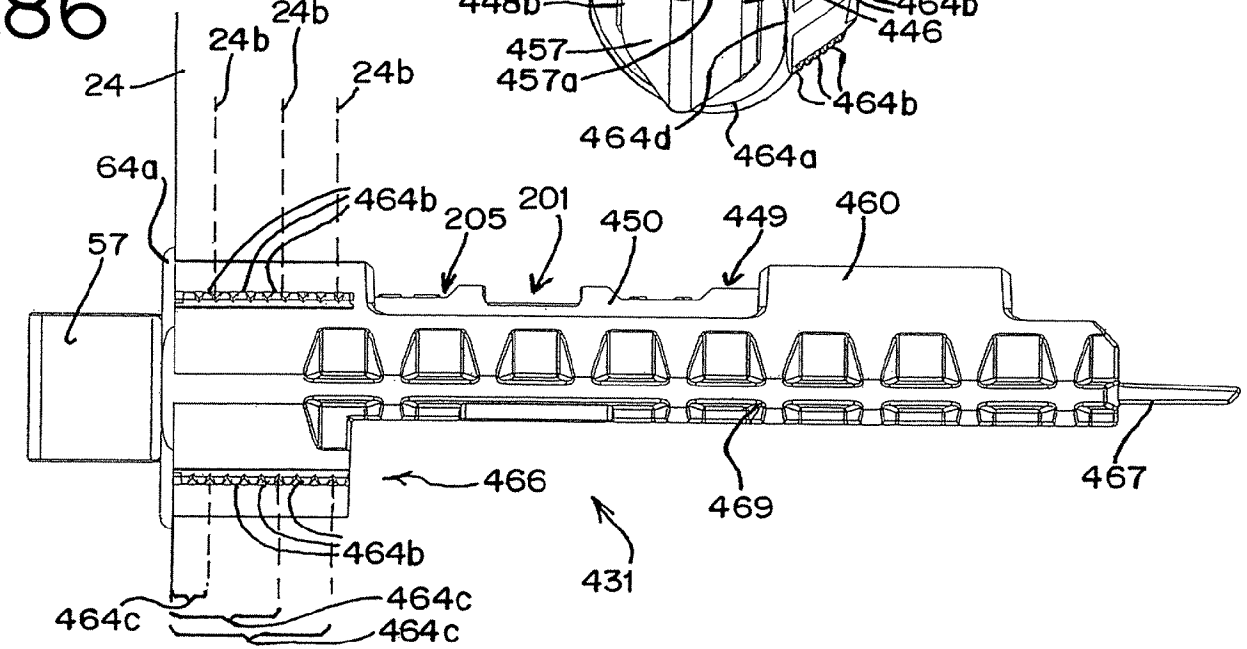
FIG. 86 is a front view of the tilt latch mechanism of FIG. 85 and a portion of a stile of a sash window assembly.

An alternate embodiment of the tilt latch mechanism 431 is shown in FIGS. 85-86. In most respects, the tilt latch mechanism 431 of FIGS. 85-86 is similar or identical to the tilt latch mechanism 31 described above and shown in FIGS. 31-38, and the components of the tilt latch mechanism 431 are consistently numbered using the "400" series of reference numbers. Accordingly, the tilt latch mechanism 431 will be discussed herein only with regard to the differences from the previous tilt latch mechanism 31.

The tilt latch mechanism 431 has different stile-engaging members 464 than the previously-described tilt latch mechanism 31. As shown in FIGS. 85-86, the tilt latch mechanism 431 has a generally circular flange 464*a* and a plurality of flexible tabs or teeth 64*b* defining a series of gaps 464*c* between the flange 464*a* and the tabs 464*b*. The tabs 464*b* are arranged into four substantially linear rows that are transverse to the flange 464*a* and positioned around the circumference of the substantially circular housing 460. Each row of tabs 464*b* engages a different portion of the stile 24 to create a more stable connection between the tilt latch mechanism 431 and the stile 24. As described above, a portion of the stile 24 is received within the gap 464*c* between the flange 464*a* and one of the tabs 464*b*. However, because of the number of tabs 464*b* present, the tilt latch mechanism 431 can be inserted into one of several stiles 24 of varying thicknesses. Put another way, the plurality of tabs 464*b* create a plurality of gaps 464*c* between the tabs 464*b* and the flange 464*a*, and each of the plurality of gaps 464*c* receives a portion of one of a plurality of stiles 24 having different thicknesses, allowing the tilt latch mechanism 431 to be mounted in stiles 24 of varying thicknesses. FIG. 86 illustrates the tilt latch mechanism 431 inserted into a stile 24, with broken lines indicating several different possible stile-widths that can be accommodated by the stile engaging members 464. It is understood that a far greater number of stile-widths can be accommodated than shown in FIG. 86.

As the tilt latch mechanism 431 is inserted into the stile 24, the tabs 464*b* engage the edges of the circular opening 92 and flex inwardly, toward the centerline of the tilt latch mechanism 431. The tilt latch mechanism 431 is provided with a space 58 between each row of tabs 464*b* and the body of the housing 460, which allow the tabs 464*b* to flex in this manner. The tabs 464*b* are preferably resilient, and each tab 464*b* springs back to its original position after clearing the inner surface 24*b* of the stile 24. Thus, the tabs 464*b* and the flange 464*a* cooperate to hold the tilt latch mechanism 431 within the stile 24.

Additionally, the flange 464*a* of the tilt latch mechanism 431 shown in FIGS. 85-86 is not completely circular, having narrowed or beveled edges 464*d*. The narrowed edges 464*d* lessen the total width of the tilt latch mechanism 431, thereby permitting the tilt latch mechanism 431 to be installed closer to the face of the sash window 12 without the flange 464*a* lapping over the edge of the stile 24.

The connection and mounting of the embodiment of the integrated assembly 30 shown in FIGS. 1-38 and the embodiment of the integrated assembly 130 shown in FIGS. 45-56 are generally the same. Thus, the operation will be described herein with respect to the integrated assembly 30 shown in FIGS. 1-38. It is understood that the tilt latch mechanism 431 shown in FIGS. 85-86 is connected and functions in the same manner as the previously described tilt latch mechanisms 31,131, and can be substituted for such tilt latch mechanisms 31,131 in either integrated assembly 30,130. The mounting procedure of the tilt latch mechanism 431 is also the same as that described below, except as stated above with respect to the modified stile-engaging members 464.

The components of the integrated assembly 30 of FIGS. 1-38 are connected as shown in FIGS. 4-14. First, the sash lock assembly 32 and the tilt latch assembly 31 are assembled. Assembly of the tilt latch mechanism 31 includes inserting the latch bolt 50 and the spring 63 into the housing 60 in the required positions. To assemble the sash lock mechanism, the shaft 38 of the actuator handle 36 is inserted down through the opening 81 in the housing 82 and is connected to the cam 44, extending down through the cam. The pawl 72 is then inserted onto the end of the shaft 38, and the cap 35 is connected over the pawl 72 at the tip of the shaft 38. A washer, grommet, bearing, or similar component (not shown) may also be inserted between the components of the sash lock mechanism 32. Finally, the connector 52 is connected at the second end 56 to the latch bolt 50 and at the first end 54 to the appending member 78 of the pawl 72 to operably connect the tilt latch mechanism 31 to the sash lock mechanism 32. As discussed in greater detail below, the tilt-latch mechanism 31 and connector 52 may be inserted into the top rail 20 and then the sash lock mechanism 32 is connected to the connector 52 and mounted on the top rail 20.

Figure 57:
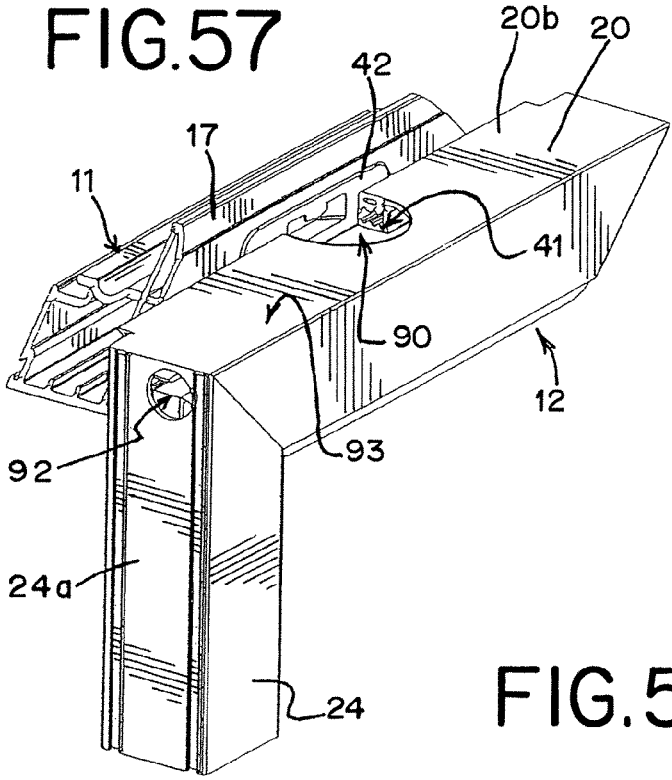
FIG. 57 is a perspective view of the portion of the sash window assembly of FIG. 2.

A variety of different methods can be used to mount the integrated assembly 30 in the sash window 12, as determined by the user. In a preferred embodiment, the integrated assembly 30 is mounted within a cavity 90 in the sash window 12. The cavity 90 is in communication with a first opening 91 in the top sash rail 20 for the sash lock mechanism 32 and a second opening 92 in the stile 24,26 for the tilt latch mechanism 31, as illustrated in FIG. 57. The second opening 92 extends through the vertical outer surface 24*a* of the stile 24 and is located entirely below the horizontal outer surface 20*b* of the top rail 20. It is understood that in some embodiments, the second opening 92 may extend into a top surface 20*b* of the top rail 20 as well, depending on the configuration of the tilt latch mechanism 31. Generally, the user forms the openings 91,92 in the sash window 12 by cutting, drilling, routing etc., but it is contemplated that sash windows 12 could be manufactured with pre-formed openings 91,92. Advantageously, the rounded shape of the tilt latch housing 60 permits the tilt latch mechanism 31 to be mounted in a circular opening 92 in the stile 24,26. The circular opening 92 can be routed or drilled using a corresponding bit of suitable diameter, which is quicker, more precise, and greatly simplified with respect to prior tilt latch mounting procedures that often require stile openings of complex geometry. Further, the tilt latch mechanism 31 does not require an opening that extends through both the stile 24,26 and the top surface 20*b* of the top rail 20, which can lessen the overall strength of the top sash rail 20 and produce an undesirable appearance for some applications, as do many prior tilt latches. Thus, the tilt-latch mechanism 31 is mounted within the top rail 20 by an opening in the stile 24,26 wherein the top surface 20*b* of the top rail 20 is smooth and is not compromised by a top opening.

First, the second end 56 of the connector 52 is snapped to the latch bolt 50 of the assembled tilt latch mechanism 31 to form a snap fit connection 55, after the latch bolt 50 is pulled backward in the housing 60 to make the recess 55*a* accessible. Then, as can be appreciated from FIGS. 2 and 2A, the tilt latch mechanism 31 and connector 52 are inserted through the second opening 92 and into the cavity 90 in the sash window 12. When the tilt latch mechanism 31 is inserted into the opening 92, the tab 64*b* flexes upward upon contact with the stile 24,26 and snaps back into position upon clearing the wall of the stile 24,26. The flange 64*a* and the tab 64*b* then cooperate to hold the tilt latch mechanism 31 in place within the sash window 12. Thus, the tilt latch mechanism 31 can be mounted within the sash window 12 without the use of fasteners. At this point, the first end 54 of the connector 52 is exposed within the first opening 91. The assembled sash lock mechanism 32 is likewise installed in the first opening 91 so that the housing 82 rests upon the top surface 20*b* of the top sash rail 20 and a portion of the sash lock mechanism 32 extends into the cavity 90 in the sash window 12. The sash lock mechanism 32 should be positioned so that the appending member 78 of the pawl 72 is in position to engage the hitch 59 of the connector 52. Preferably, the sash lock housing 82 is fastened to the top sash rail 20 by screws or other fasteners (not shown). Once the tilt latch mechanism 31 and the sash lock mechanism 32 are in place, the connector 52 is connected to the appending member 78 of the pawl 72 by simply rotating the actuator handle 36, which causes the pawl 72 to rotate, forcing the hook 77 of the pawl 72 to snap into the hitch 59 on the first end 54 of the connector 52. Another integrated assembly may be mounted at the other side of the sash window 12 in a similar manner. The order of the steps in the mounting method described above may be varied, and further, the integrated assembly 30 may be mounted using a different method.

The first opening 91 is positioned at a first location and the second opening 92 is positioned at a second location remote from the first location, so that, when mounted, the sash lock mechanism 32 is positioned at the first location and the tilt latch mechanism 31 is positioned at the second, remote location. The positioning of the openings 91,92 on the sash window 12 can vary, based on several factors, including user choice and the size of the components of the integrated assembly 30. Generally, the tilt latch opening 92 can be moved an appreciable lateral distance without necessitating a change in components of the integrated assembly 30. The broken lines in FIG. 2A illustrate two potential positions to which the tilt latch opening 92 and the tilt latch mechanism 31 may be moved. The structure of the snap fit connection 55, particularly the bracing arms 53 of the connector 52, permit the connector 52 to pivot a certain distance laterally, creating a variety of different positions for connection. Thus, the lateral displacement between the tilt latch mechanism 31 and the sash lock mechanism 32 can vary. Further, the bracing arms 53 embody means and structure for resisting vertical movement and pivoting of the connector 52 while permitting lateral movement and pivoting of the connector 52.

When the integrated assembly 30 is mounted within the sash window 12, the sash lock mechanism 32 is preferably located partially above the top wall 93 of the top sash rail 20 and partially below the top wall 93, as shown in FIGS. 3 and 3A. Mounting the sash lock mechanism 32 with a shallow mounting depth is advantageous because it allows the integrated assembly 30 to be mounted using a relatively shallow cavity 90. On the other hand, mounting the sash lock mechanism 32 with a large mounting depth is often considered more visually appealing because such a mounting generally results in a lower profile. Thus, the mounting configuration of the integrated assembly 30 offers a compromise, having a relatively shallow cavity 90 while still presenting a relatively low profile. As shown in FIGS. 3 and 3A, the integrated assembly 30 is mounted so the cam 44 is approximately level with the top wall 93 of the top sash rail 20. Thus, a portion 44*a* of the cam 44 is above the top sash rail 20 and a portion 44*b* of the cam 44 is below the top sash rail 20. It is understood that the mounting depth can be varied by altering the size, shape, and spacing of the components of the sash lock mechanism 32, including by altering the shape and/or curvature of the sash lock housing 82. Also, as shown in FIGS. 6, 7, 10, and 14, because the bottom surface 82*a* of the sash lock housing 82 rests on the top wall 93 of the top sash rail 20, the sash lock mechanism 32 is configured so that a portion 44*a* of the cam 44 is above the bottom surface 82*a* of the sash lock housing 82 and a portion 44*b* of the cam 44 is below the bottom surface 82*a* of the sash lock housing 82.

The keeper 42 is mounted on the bottom sash rail 17 of the upper sash window 11, preferably within an opening cut into the side surface of the bottom sash rail 17, as shown in FIGS. 1 and 2. To mount the keeper 42, the opening is cut into the bottom sash rail 17 in the proper shape and the keeper 42 is inserted into the opening. The keeper 42 is preferably held in place by screws or other fasteners (not shown). The positioning of the cam 44 level with the top wall 93 of the top sash rail 20 of the bottom sash window 12 makes this positioning of the keeper 42 advantageous. In addition, this positioning of the keeper 42 presents a lower profile as compared to positioning the keeper 42 on top of the bottom sash rail 17.

The operation of the embodiment of the integrated assembly 30 shown in FIGS. 1-38 and the embodiment of the integrated assembly 130 shown in FIGS. 45-56 are generally the same. Thus, the operation will be described herein with respect to the integrated assembly 30 shown in FIGS. 1-38. It is understood that the tilt latch mechanism 431 of FIGS. 85-86 operates in the same manner as the other tilt latch mechanisms 31,131 described herein when incorporated into an integrated assembly. As described above and illustrated in FIGS. 4-14, the assembly 30 is operable between a locked position, an unlocked position, and a tiltable position. The actuator handle 36 of the present invention is operable between locked, unlocked and tiltable positions, adjusting the assembly 30 between the three positions. The sash lock housing 82 has indicia 85 thereon to indicate the positions of the actuator handle 36. It is also contemplated that the actuator handle 36 can include some indicia thereon for assisting a user during operation. When the actuator handle 36 is in the locked position, illustrated in FIGS. 7-10, the locking member 40 of the cam 44 engages the keeper 42 (See FIGS. 15A and 15B) and the latch bolt 50 is in the outwardly-extended position, engaging the guide rail 16. Accordingly, the sash lock mechanism 32 is locked wherein the cam 44 is locked with the keeper 42. Also, the latch bolt 50 is in its extended position and engaged with the guide rail 16. Thus, the sash window 12 is prevented both from sliding vertically with respect to the upper sash window to an open position and from tilting from the master frame 14. In this position, the abutment member 41 of the cam 44 and the tab 80 of the pawl 72 are not engaged with each other, and the cam 44 moves freely and independently of the pawl 72.

Figure 4:
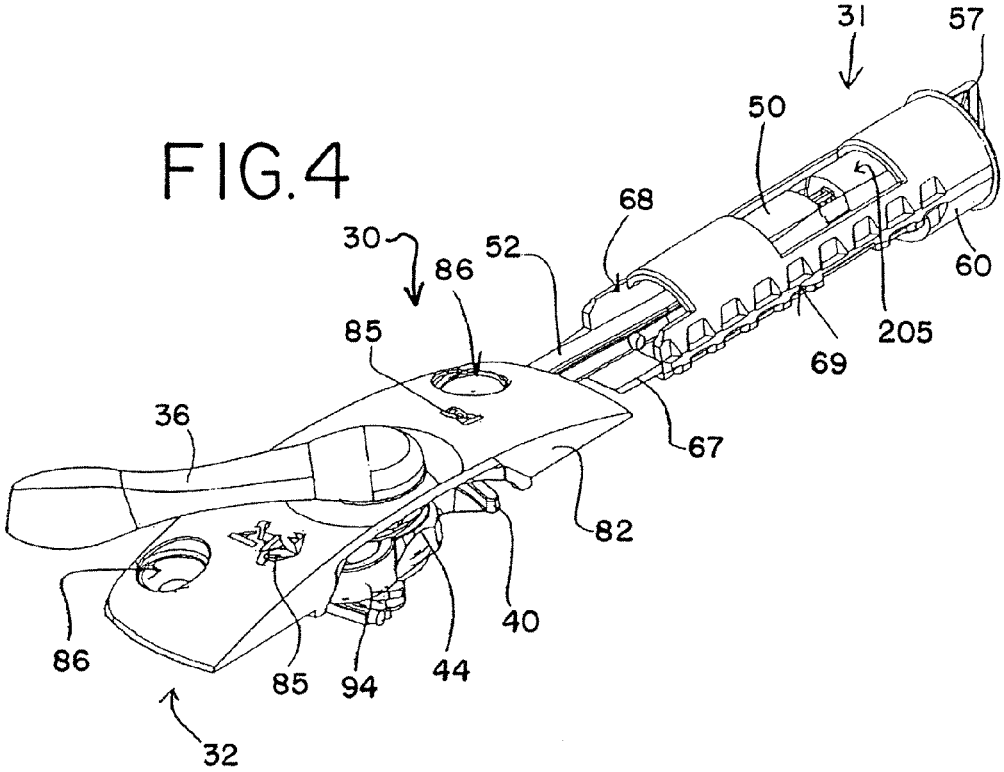
FIG. 4 is a rear perspective view of one embodiment of an integrated tilt latch and sash lock assembly of the present invention, shown in an unlocked position.
Figure 4A:
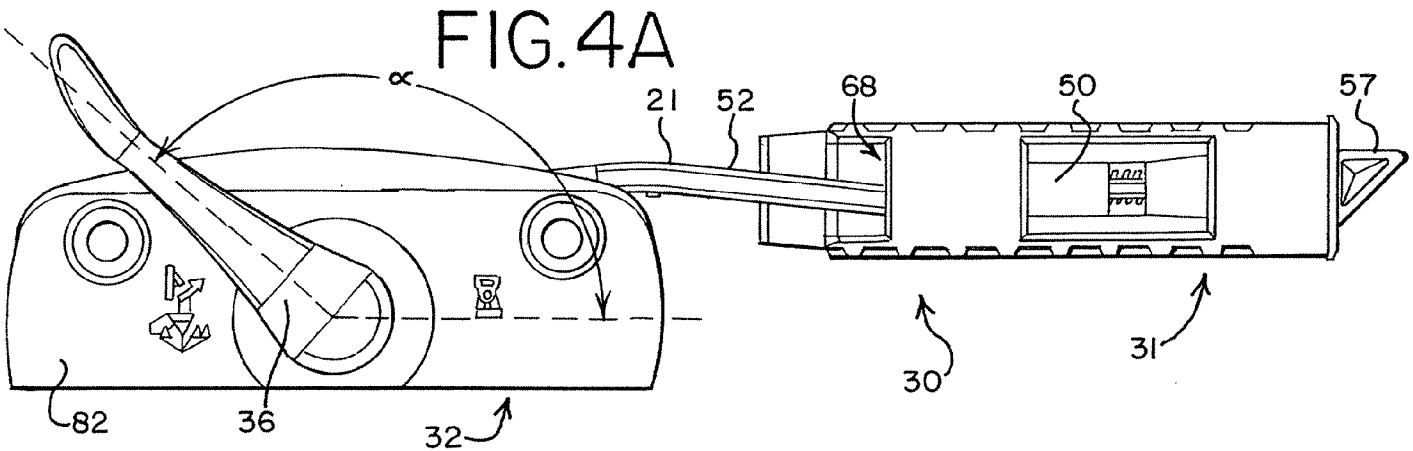
FIG. 4A is a top view of the integrated tilt latch and sash lock assembly of FIG. 4, shown in the unlocked position.
Figure 5:
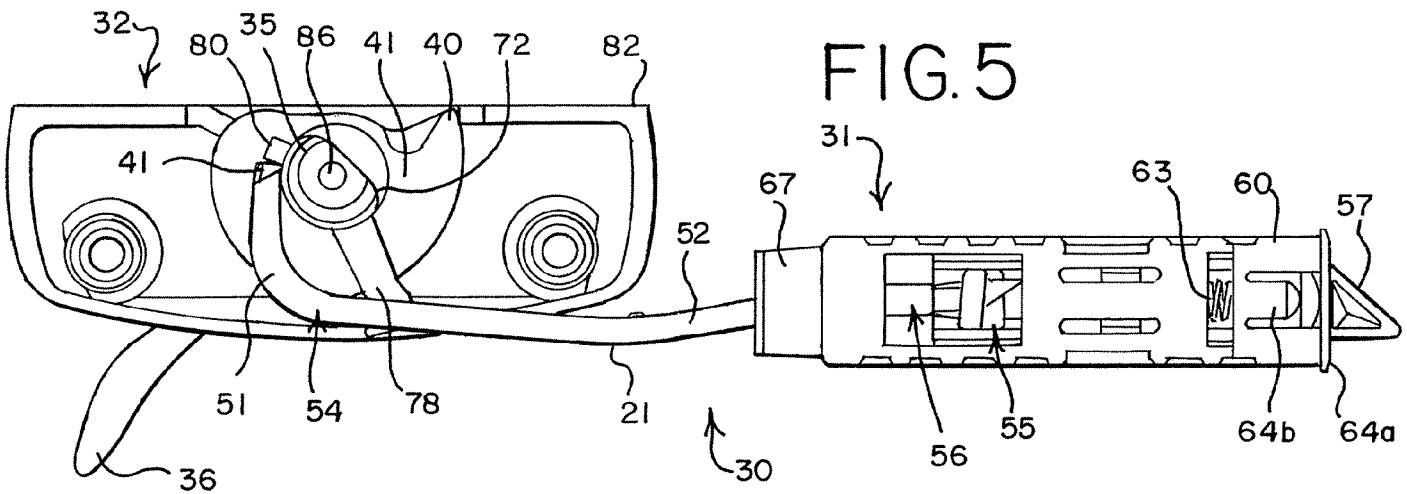
FIG. 5 is a bottom view of the integrated tilt latch and sash lock assembly of FIG. 4, shown in the unlocked position.
Figure 6:
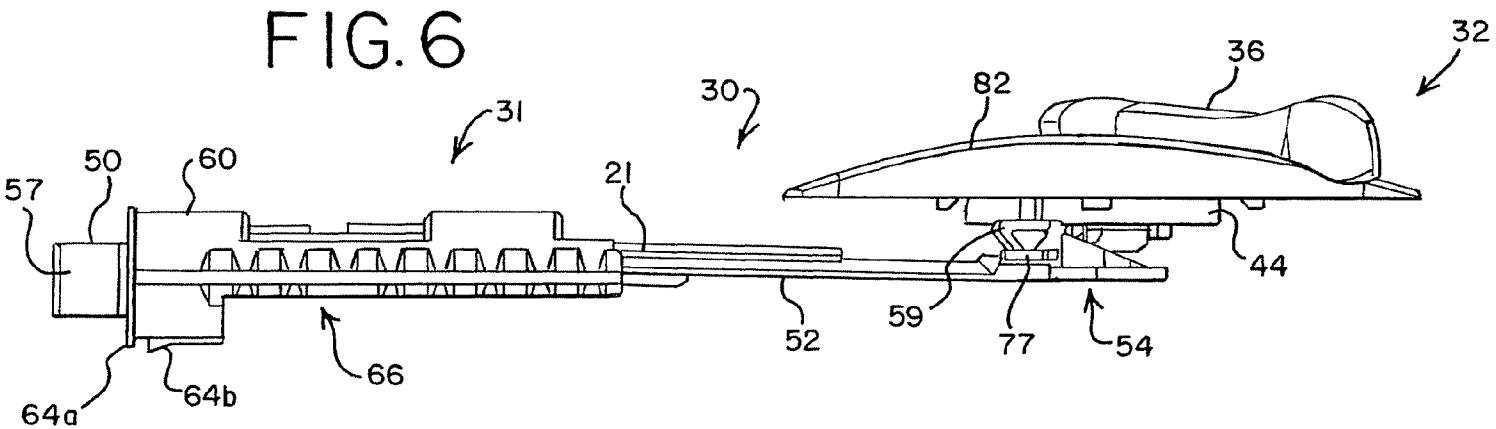
FIG. 6 is a front view of the integrated tilt latch and sash lock assembly of FIG. 4, shown in the unlocked position.
Figure 7:
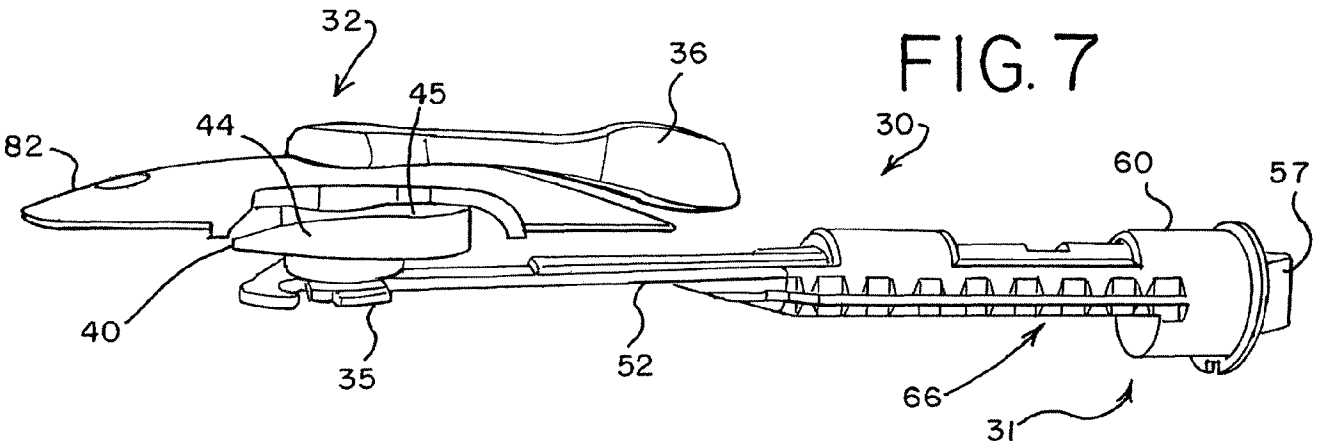
FIG. 7 is a rear perspective view of the integrated tilt latch and sash lock assembly of FIG. 4, shown in a locked position.
Figure 8:
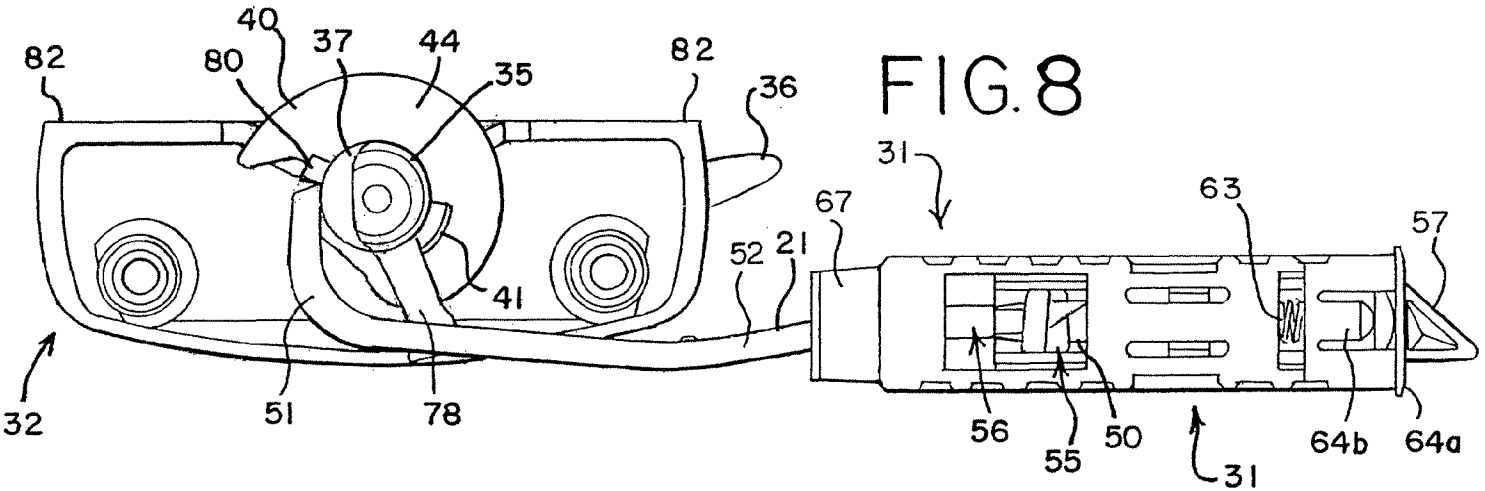
FIG. 8 is a bottom view of the integrated tilt latch and sash lock assembly of FIG. 4, shown in the locked position.
Figure 9:
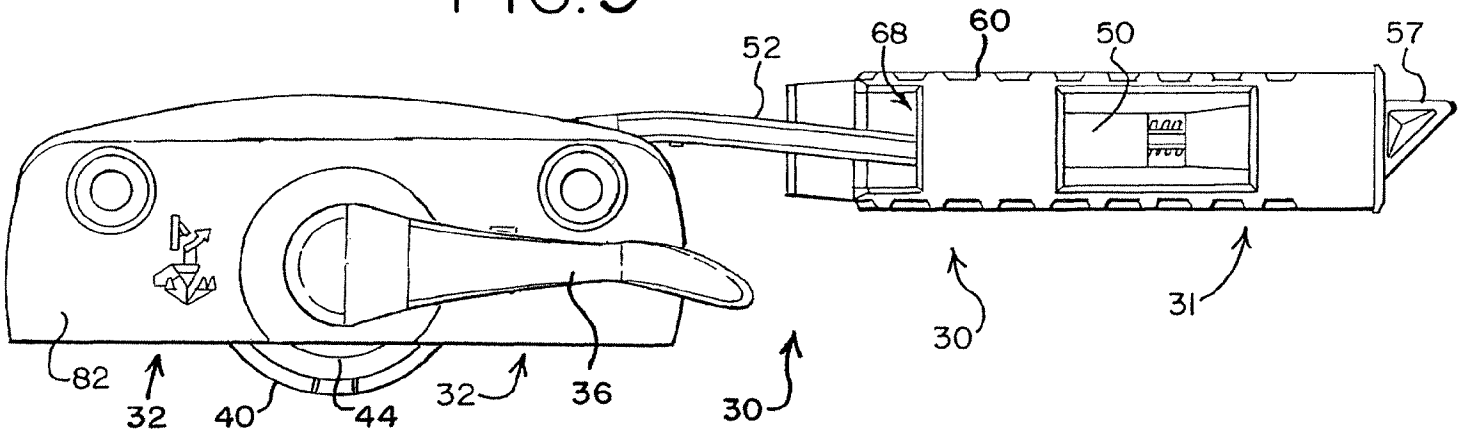
FIG. 9 is a top view of the integrated tilt latch and sash lock assembly of FIG. 4, shown in the locked position.
Figure 10:
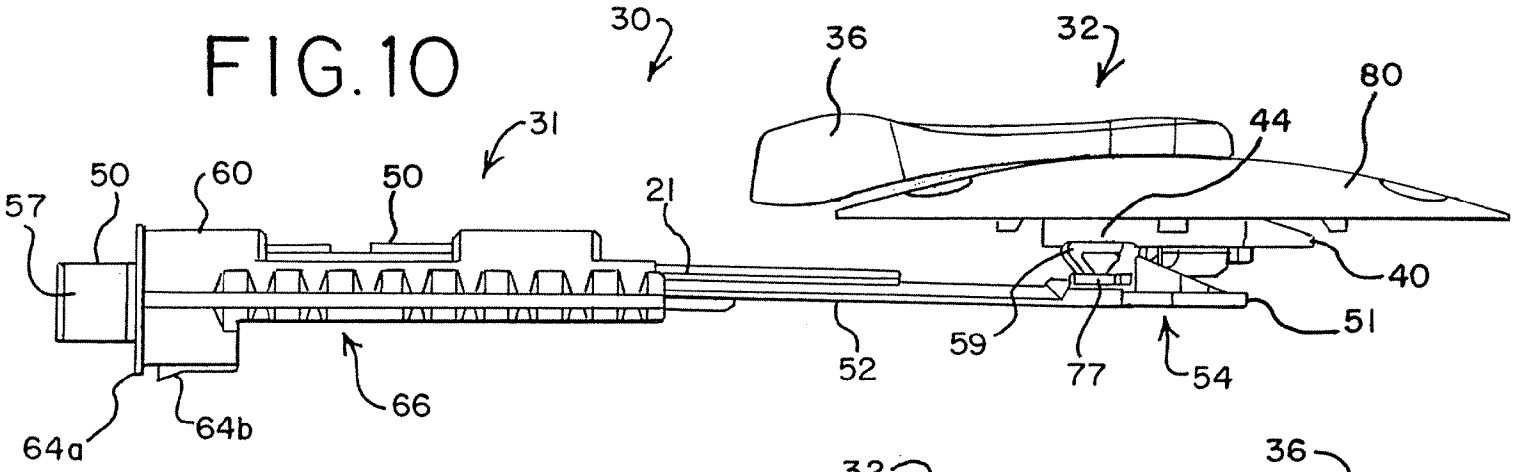
FIG. 10 is a front view of the integrated tilt latch and sash lock assembly of FIG. 4, shown in the locked position.
Figure 11:
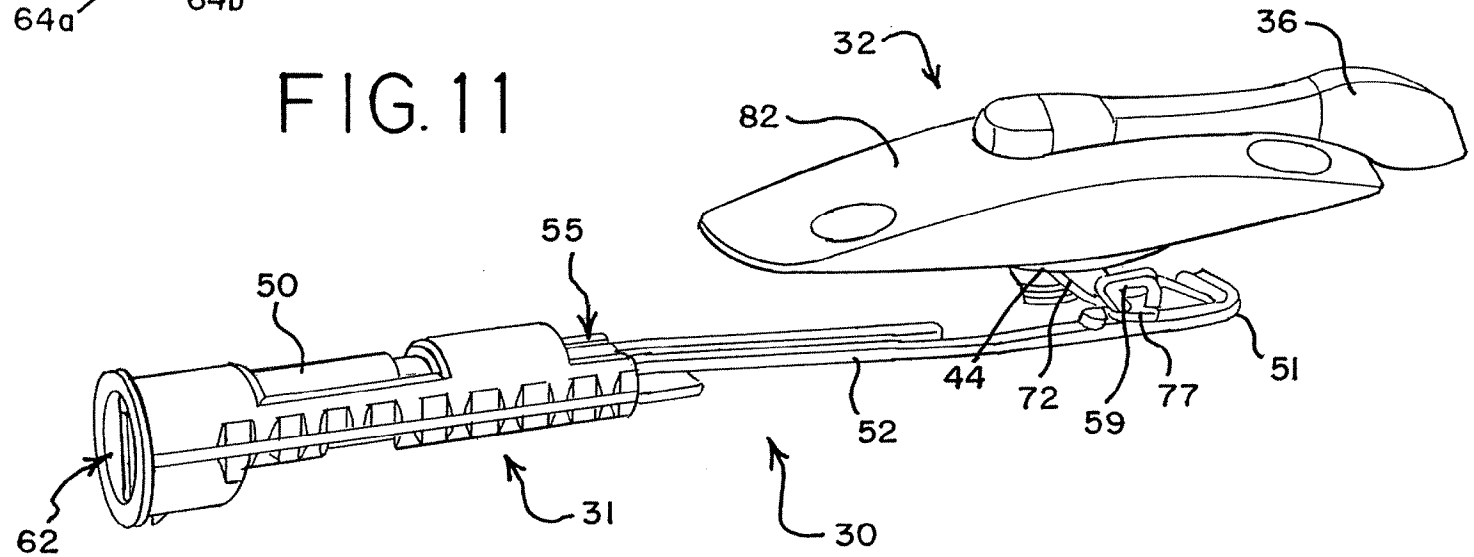
FIG. 11 is a perspective view of the integrated tilt latch and sash lock assembly of FIG. 4, shown in a tiltable position.
Figure 12:
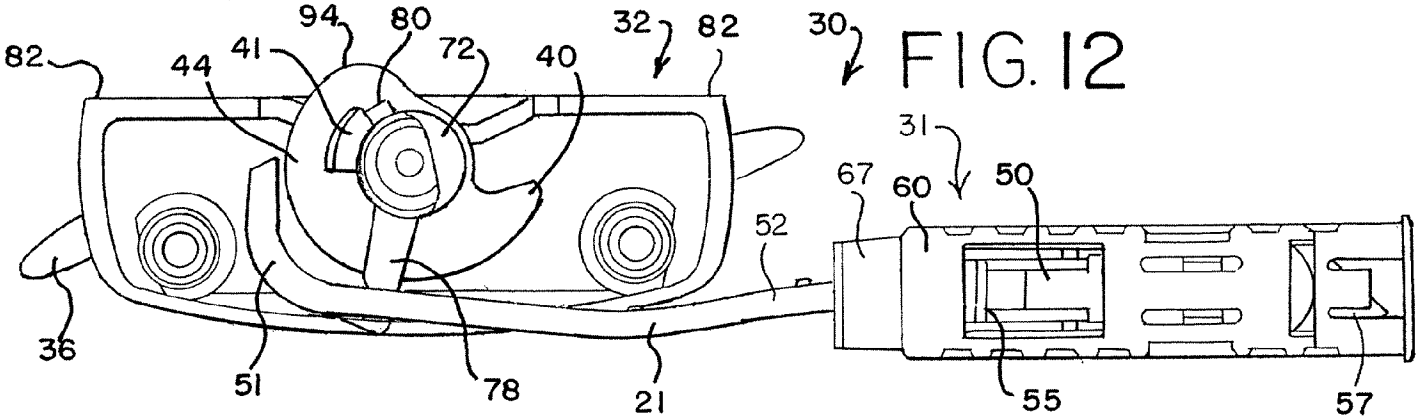
FIG. 12 is a bottom view of the integrated tilt latch and sash lock assembly of FIG. 4, shown in the tiltable position.
Figure 13:
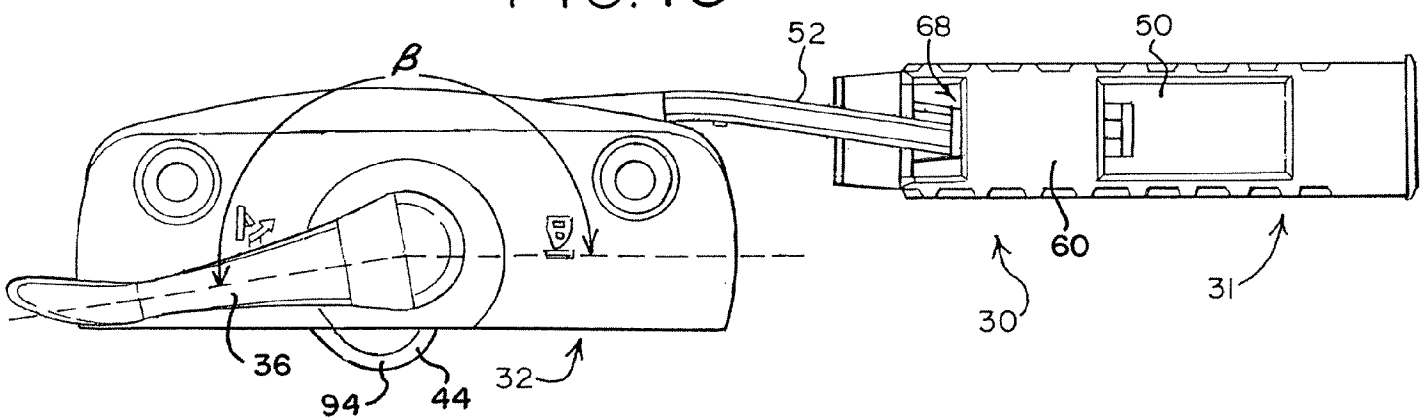
FIG. 13 is a top view of the integrated tilt latch and sash lock assembly of FIG. 4, shown in the tiltable position.
Figure 14:
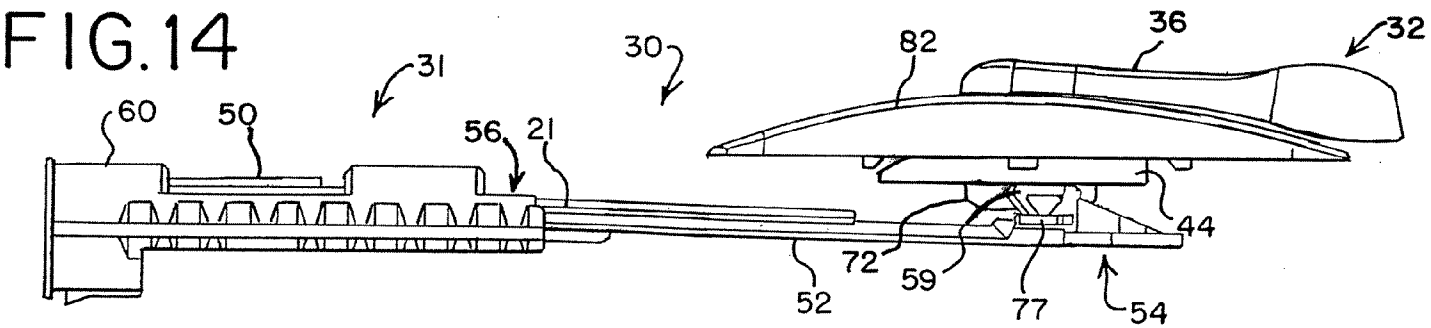
FIG. 14 is a front view of the integrated tilt latch and sash lock assembly of FIG. 4, shown in the tiltable position.

When the actuator handle 36 is moved from the locked position to the unlocked position, shown in FIGS. 4-6, the actuator handle 36 and the cam 44 are rotated to a first angle $\alpha$ from the locked position. This rotation disengages the locking member 40 from the keeper or locking bracket 42, permitting the sash window 12 to vertically open by sliding within the window frame 14. However, the latch bolt 50 remains outwardly extended into the guide rail 16, and thus, the sash window 12 continues to be prevented from tilting. Preferably, in the unlocked position, the tab 80 of the pawl 72 is still not yet abuttingly engaged by the cam 44, and the pawl 72 abuttingly engages the cam 44 upon slight further rotation. However, the integrated assembly 30 may be modified so the cam 44 and the pawl 72 abuttingly engage prior to the actuator 36 reaching the unlocked position, simultaneously with the unlocked position, or significantly after the actuator 36 passes the unlocked position. Additionally, a spring within the latch bolt housing 60 may bias the cam 44 toward the unlocked position.

When the actuator arm 36 is moved from the unlocked position to the tiltable position, shown in FIGS. 11-14, the actuator handle 36 and the cam 44 are rotated to a second angle $\beta$ from the locked position, wherein the second angle $\beta$ is greater than the first angle $\alpha$. The second angle $\beta$ is greater than 180° in one embodiment, shown in FIG. 13. In the tiltable position, the locking cam 44 remains disengaged from the keeper 42, still permitting the sash window 12 to vertically open. However, the cam 44 abuttingly engages the tab 80 extending from the pawl 72, causing the pawl 72 to rotate in unison with the cam 44. Rotation of the pawl 72 pulls the connector 52, which in turn pulls the latch bolt 50 toward the retracted position. In this retracted position, the latch bolt 50 is released from the guide rail 16, permitting the sash window 12 to tilt about the pivot corner 15. During this movement, the connector 52 is substantially linearly displaced. At some point between the first angle $\alpha$ and the second angle $\beta$ and prior to the point where the abutment member 41 abuttingly engages the pawl 72, the eccentric cap 35 rotates to engage the curved arm 51 of the connector 52. Further rotation of the cap 35 exerts a camming force on the connector arm 51, pulling the connector 52 slightly, which in turn retracts the latch bolt 50 slightly. This permits the integrated assembly 30 to begin retraction of the latch bolt 50 prior to the point where the abutment member 41 of the cam 44 abuttingly engages the pawl 72.

As described above, the cam 44 contains means 94 for selectively preventing movement of the integrated assembly 30 to the tiltable position, which preferably takes the form of the enlarged or eccentric portion 94 of the cam 44 that is rotationally opposite of the locking member 40. When the integrated assembly 30 is in the unlocked position, and a user wishes to move the actuator handle 36 to the tiltable position, the eccentric portion 94 abuts the keeper 42, preventing rotation of the cam 44. In order to rotate the actuator handle 36 and cam 44 further, the user must lift the sash window 12 slightly, to allow the eccentric portion 94 to clear the keeper 42 and preferably the bottom rail 17 in the preferred embodiment, and the actuator handle 36 can thus be moved to the tiltable position. It is understood that the bottom rail 17 could be modified or the keeper 42 positioned such that as soon as the cam 44 passes above the keeper 42, the actuator handle 36 can be moved to the tiltable position.

Additionally, the actuator handle 36 and the sash lock housing 82 preferably have cooperating structure to indicate the position of the integrated assembly 30 to the user. As shown in FIGS. 28-29, the housing 82 has an annular ledge 87 having two protrusions 88 positioned at points around the ledge 87, and the actuator handle 36 has a projection 89 on the lower side. The first protrusion 88*a* is located proximate the fully locked position of the actuator handle 36, and the second protrusion 88*b* is located proximate the unlocked position of the actuator handle 36. During rotation of the actuator handle 36, the projection 89 of the actuator handle 36 engages the protrusion 88 of the housing 82, creating momentarily greater resistance to rotation of the actuator handle 36. When the actuator handle 36 clears the protrusion 88, the user feels a "click" which, due to the relative positions of the protrusions 88, indicates a position of the actuator handle 36 to the user. Accordingly, the tactile feel created by the first protrusion 88*a* indicates when the actuator handle 36 has moved to or from the fully locked position. Similarly, the tactile feel created by the second protrusion 88*b* indicates when the actuator handle 36 has moved to or from the unlocked position. Thus, the actuator handle 36 and the housing 82 create a tactile feel for the user to indicate positions of the integrated assembly 30.

Viewed another way, the assembly 30 is moveable through a first range of angular movement, where movement of the actuator handle 36 rotates the rotor 44, and a second range of angular movement, where the rotor 44 abuttingly engages the pawl 72 such that movement of the actuator handle 36 rotates the rotor 44 and the pawl 72 together. As described above, the locking member 40 is preferably disengaged from the keeper 42 within the first range of angular movement, and prior to the abutting engagement between the rotor 44 and the pawl 72. Additionally, the actuator handle 36 is moveable among a first position, where the cam or rotor 44 does not abuttingly engage the pawl 72 and the assembly is in the locked position, a second position where the cam 44 abuttingly engages the pawl 72 and the assembly is in the unlocked position, and a third position where the cam 44 abuttingly engages the pawl 72 and the connector 52 retracts the latch bolt 50 so the assembly is in the tiltable position. As described above, the locking member 40 is preferably disengaged from the keeper 42 before the actuator handle 36 reaches the second position. It is understood that the assembly 30 and the actuator 36 may have several positions which are "locked," "unlocked," and "tiltable" positions, dictated by the function of the window at the respective position. It is also understood that the sequence of mechanical interactions within the assembly 30 may be varied. Thus, depending on the configuration of the assembly 30, there may be additional positions where, for example, the assembly is in the locked position and the cam 44 is already abuttingly engaging the pawl 72; or, in an alternate embodiment of the assembly, where the assembly 30 is in the unlocked position but the cam 44 has not yet abuttingly engaged the pawl 72.

When operating the actuator handle 36 in reverse to the above, the integrated assembly 30 is moved from the tiltable position to the unlocked position, and the actuator handle 36 and cam 44 are rotated from the second angle $\beta$ back to the first angle $\alpha$. The locking member 40 remains disengaged from the keeper 42, still permitting the sash window to vertically open. As the actuator handle 36 and the cam 44 move toward the unlocked position, the latch bolt 50 moves back to the outwardly-extended position due to the bias created by the spring 63. This movement is enabled because the pawl 72 is no longer being rotatably biased by the cam 44. In a preferred embodiment, this action is done automatically when the handle 36 is released by the user, because the force of the spring 63 not only forces the latch bolt 50 to the outwardly-extended position, but pulls on the connector 52, causing the cam 44 and the handle 36 to rotate back to the unlocked position (angle $\alpha$). At some point within this range of movement, prior to the full extension of the latch bolt 50, the abutting engagement between the abutment member 41 of the cam 44 and the tab 80 of the pawl 72 ceases. When the integrated assembly 30 reaches the unlocked position, the latch bolt 50 is once again fully extended, and the sash window 12 is prevented from tilting when in the closed position. It is understood that the integrated assembly 30 can be returned to the unlocked position while the window 12 is still tilted open. Due to the beveled surface of the latch bolt tip 57, the window 12 can be shut while the integrated assembly 30 is in the unlocked position, as contact with the window frame 14 will force the latch bolt 50 back into the housing 60 until the latch bolt tip 57 is aligned with the guide rails 16, when the spring 63 forces the latch bolt 50 back outward. The forcing of the latch bolt 50 inward during this action will cause the pawl 72 to rotate, but since the pawl 72 and the cam 44 are engaged only for rotation in one direction, this movement of the pawl 72 will not rotate the cam 44. As the actuator handle 36 and the cam 44 further move toward the locked position, the cam 44 rotates to engage the keeper 42. When the integrated assembly 30 is returned to the locked position, the locking member 40 engages the locking bracket on the keeper 42, preventing the sash window 12 from opening.

The tilt latch mechanism 31 of FIGS. 30-38 and can also function as a stand-alone mechanism independently of the other components of the integrated assembly 30, as shown in FIGS. 39-44. The tilt latch mechanism 31 is shown mounted alone in a sash window assembly 12 in FIG. 39. As with the integrated assembly 30, it is understood that another tilt latch mechanism 31 may be mounted at the opposite side of the sash window assembly 12. Thus, the tilt latch mechanism 31 can perform the tilt latch operation with or without incorporating the entire integrated assembly 30. Further, the tilt latch mechanism 31 has a first configuration, where the tilt latch mechanism 31 is directly operable by a user, and a second configuration, where the sash window assembly 10 further includes the sash lock mechanism 32, and the tilt latch mechanism 31 is operably coupled to the sash lock mechanism 32 by the connector 52 to form the integrated tilt latch and sash lock assembly 30.

Figure 30:
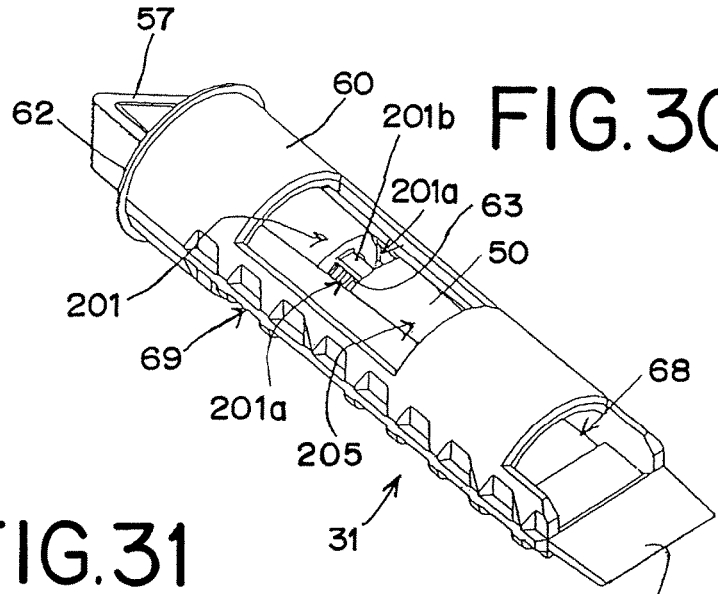
FIG. 30 is a perspective view of a tilt latch mechanism of the integrated tilt latch and sash lock assembly of FIG. 4.
Figure 31:
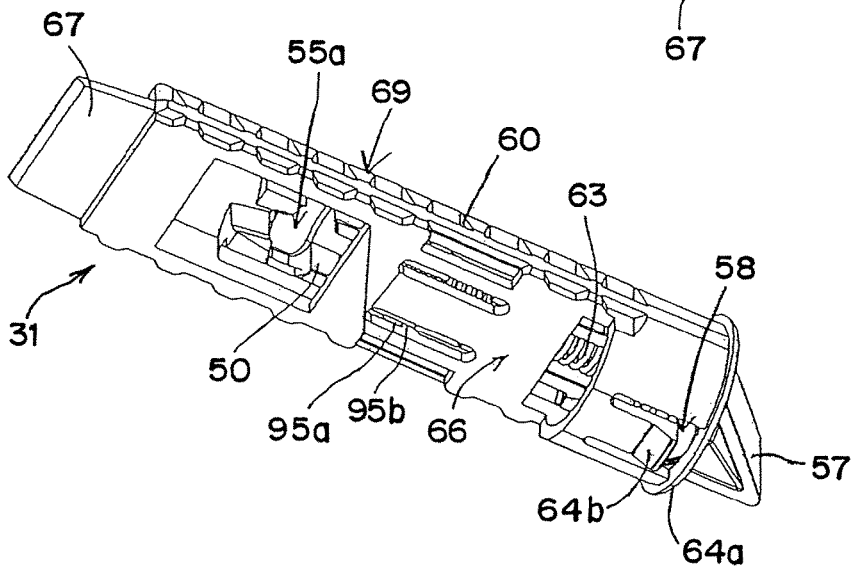
FIG. 31 is a bottom perspective view of the tilt latch mechanism of FIG. 30.
Figure 32:
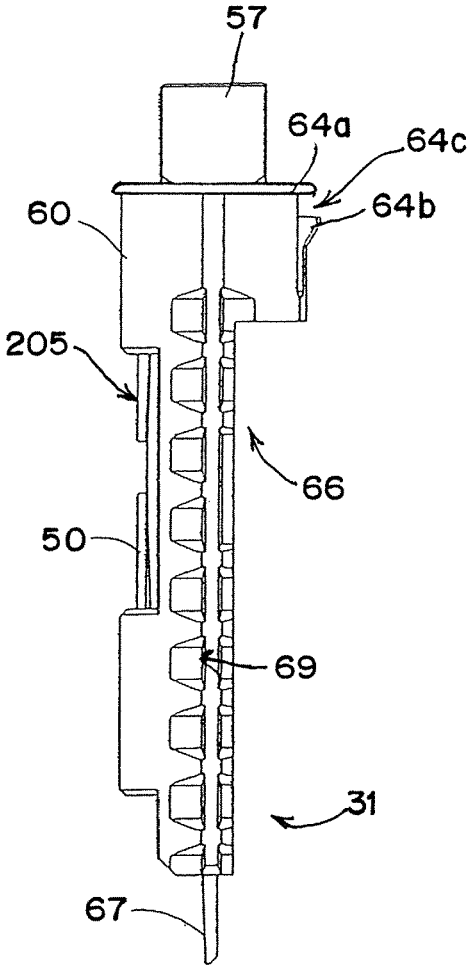
FIG. 32 is a rear view of the tilt latch mechanism of FIG. 30.
Figure 40:
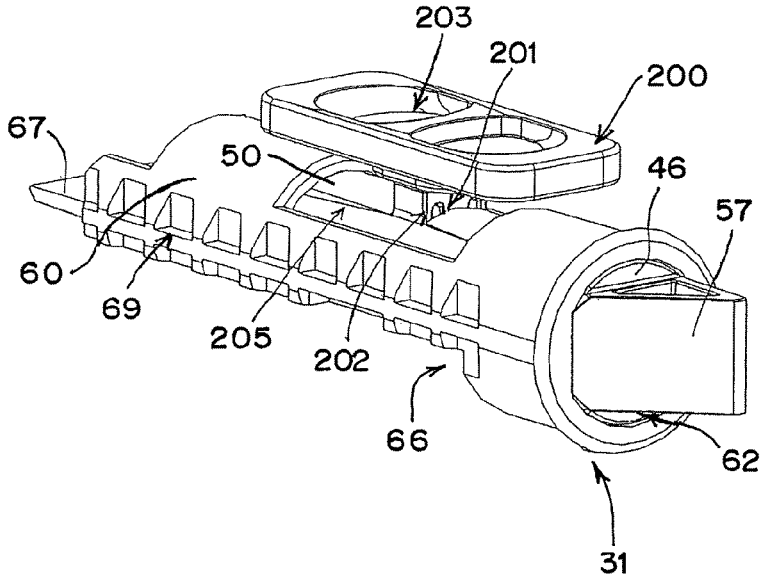
FIG. 40 is a perspective view of the tilt latch mechanism of FIG. 39.
Figure 41:
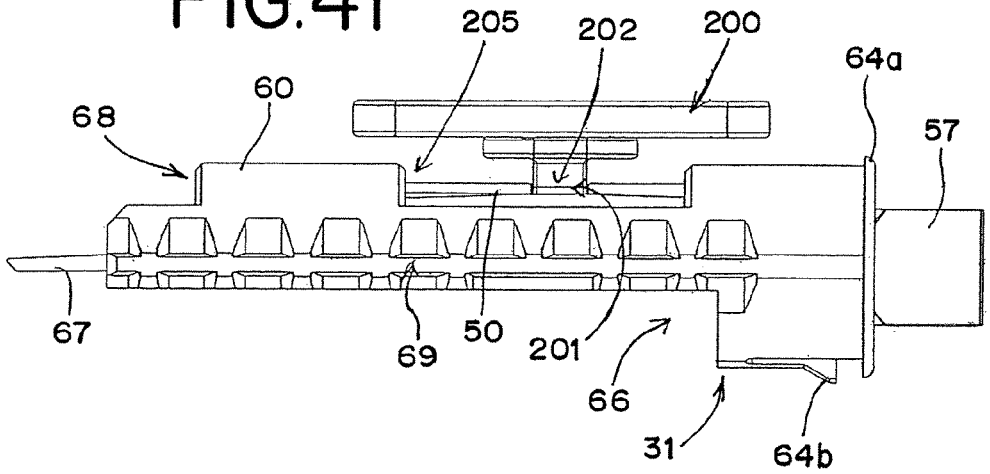
FIG. 41 is a rear view of the tilt latch mechanism of FIG. 39.
Figure 42:
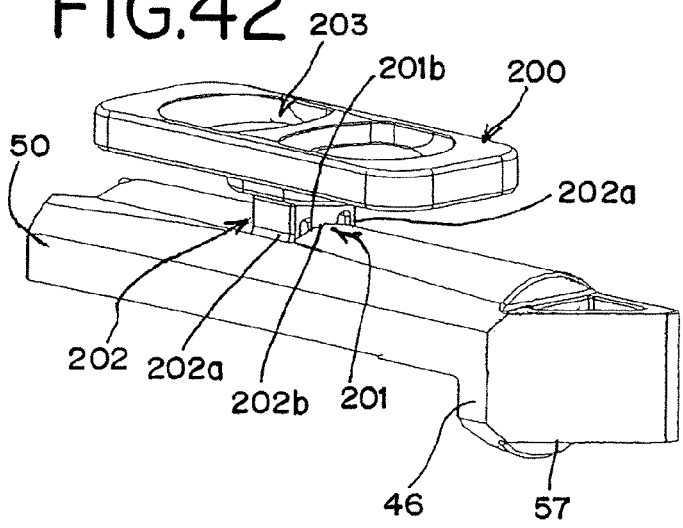
FIG. 42 is a perspective view of a latch bolt and actuator of the tilt latch mechanism of FIG. 39.
Figure 43:
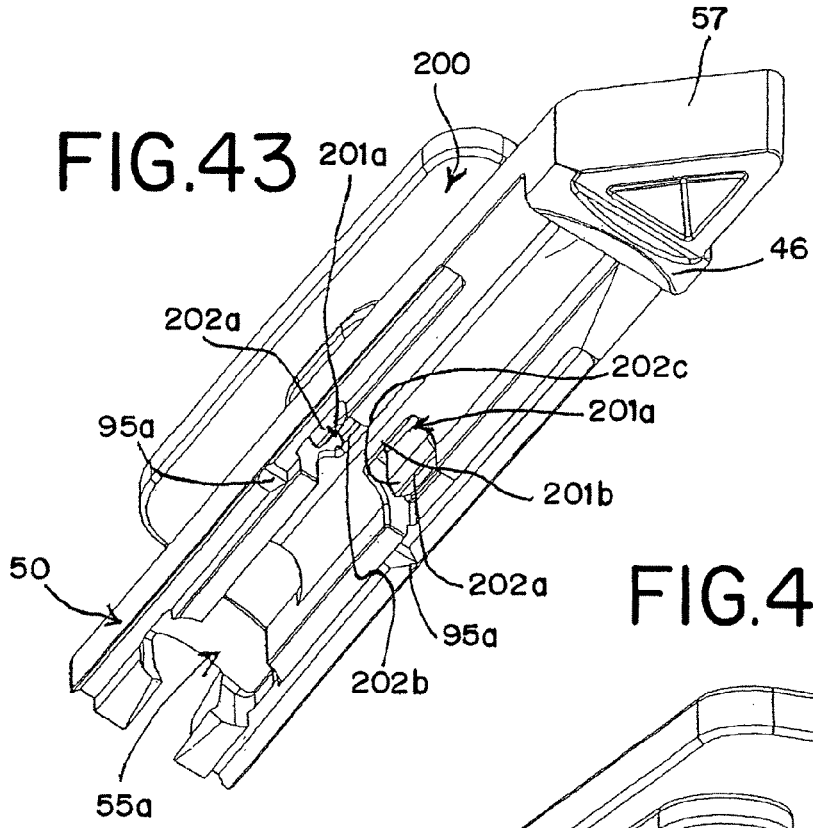
FIG. 43 is a bottom perspective view of the latch bolt and actuator of FIG. 42.
Figure 44:
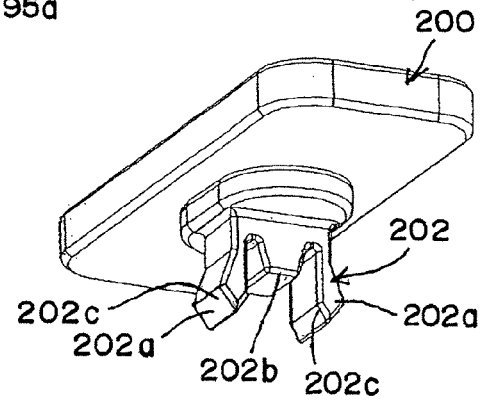
FIG. 44 is a bottom perspective view of the actuator of FIG. 42.

As shown in FIGS. 39-43, the tilt latch mechanism 31 includes an actuator 200 connected to the latch bolt 50 to permit direct manipulation of the latch bolt 50 by a user. Other than the addition of the actuator 200, the structure of the tilt latch mechanism 31 is the same as described above. The housing 60 has an elongated slot 205 in the top thereof, and the latch bolt 50 has connecting structure 201 positioned proximate the slot 205 in the assembled tilt latch mechanism 31, such that the connecting structure 201 is accessible through the slot 205, as illustrated in FIGS. 30, 40, and 41. The actuator 200 also has a connecting structure 202 that is adapted to connect to the connecting structure 201 of the latch bolt 50. Preferably, the connecting structure 201,202 forms a snap connection. The connecting structure 202 of the actuator includes two flexible tabs 202*a* spaced by a center bumper 202*b*, as shown in FIGS. 40-44. The complementary connecting structure 201 of the latch bolt 50 includes two receivers 201*a* with a bar 201*b* therebetween, as shown in FIGS. 30, 35, and 40-43. When connected, each tab 202*a* is received in one of the receivers 201*a*, and the bumper 202*b* abuts the bar 201*b*. Each tab 202*a* has a flange or enlarged end 202*c* that extends beneath the top surface of the latch bolt 50 to secure the connection between the actuator 200 and the latch bolt 50, as shown in FIG. 43. The abutting contact between the bar 201*b* and the bumper 202*b* provides stability and balance for the connection and prevents the tabs 202*a* from being inserted too far into the latch bolt 50. During connection, the flexible tabs 202*a* are pushed inward toward the bumper 202*b* by contacting the outer edges of the receivers 201*a*. Once the enlarged ends 202*c* clear the edges of the receivers 201*a*, the tabs 202*a* snap back outward to hold the actuator 200 in place. In other embodiments, other suitable connecting structure may be used. For example, the latch bolt 50 may have male structure and the actuator 200 may have complementary female structure for receiving the male structure of the latch bolt 50.

The actuator 200 also has means 203 and structure for manipulation by a user to facilitate operation of the tilt latch mechanism 31. As shown in FIGS. 40 and 42, the preferred means 203 is a pair of finger detents 203 on the top of the actuator 200, into which a user can insert a finger to operate the tilt latch mechanism 31. Other suitable means 203 may be used, such as a button, a stub, or a ridged surface, or other known means and structure for user manipulation. When the user pulls the actuator 200 back away from the latch bolt opening 62 and the stile 24,26, the latch bolt 50 is pulled backward to the retracted position and away from the guide rail 16. With the latch bolt 50 retracted, the sash window 12 can be tilted, as described above. When the user releases the actuator 200, the biasing means 63 pushes the latch bolt 50 back to the outwardly extended position, where the latch bolt tip 57 can engage the guide rail 16.

Figure 58:
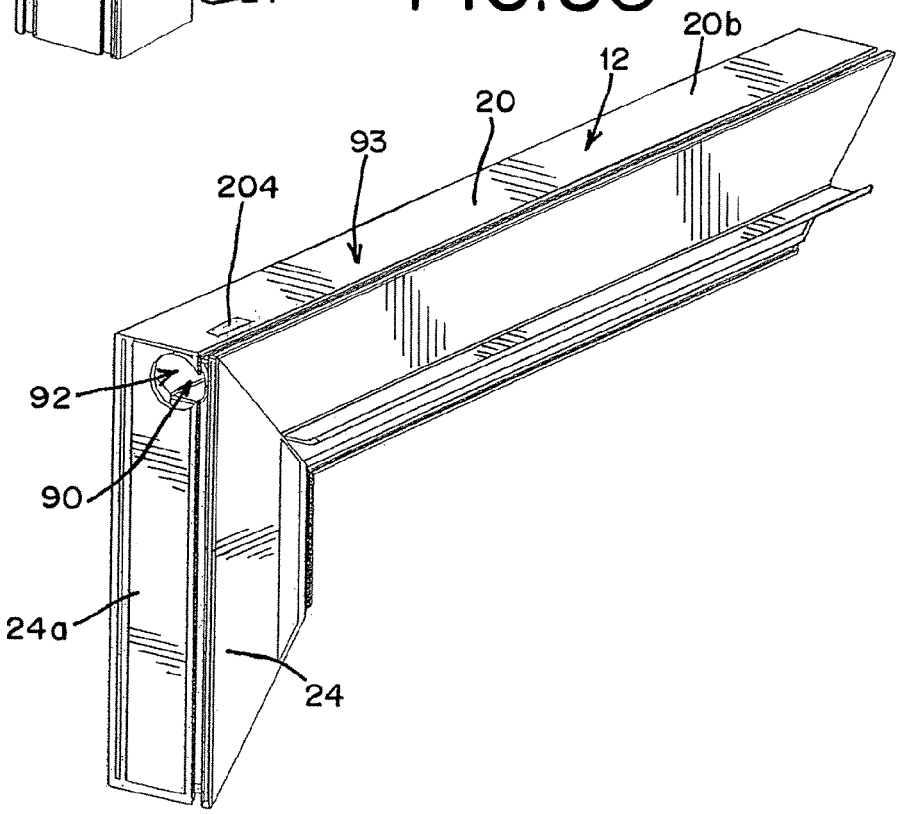
FIG. 58 is a perspective view of the portion of the window assembly of FIG. 39.

The stand-alone tilt latch mechanism 31 is mounted in substantially the same manner described above, as if the tilt latch mechanism 31 were connected to the integrated assembly 30. However, in place of the sash lock opening 91, an actuator opening 204 must be formed in the top rail 20 for the actuator 200, in order for the actuator 200 to connect to the latch bolt 50 and be accessible from outside the top rail 20, as shown in FIG. 58. This actuator opening 204 is preferably formed in the same manner as the sash lock opening 91 described above, and is positioned to be in alignment with the slot 205 in the housing 60 when the tilt latch mechanism 31 is installed. After the tilt latch mechanism 31 is inserted into the circular opening 92 in the stile 24,26, the connecting structure 202 of the actuator 200 is pushed down through the actuator opening 204 in the top sash rail 20 and through the slot 205 in the housing 60 to connect to the connecting structure 201 of the latch bolt 50. After connection of the actuator 200 to the latch bolt 50, the tilt latch mechanism 31 is operable. Preferably, the actuator 200 is large enough to completely cover the actuator opening 204 in either the extended position or the retracted position. It is understood that a sash lock mechanism that is not operably connected to the tilt latch mechanism 31 may or may not be used with the tilt latch mechanism 31 in this independent configuration. In one embodiment, the stand-alone tilt latch mechanism 31 and the actuator 200 can be mounted in the top sash rail 13 of the upper sash window 11. Thus, in one preferred embodiment, a pair of tilt-latch mechanisms 31 are utilized in the upper sash window 11 in the first configuration wherein a respective actuator 200 is connected to a respective latch bolt 50 slideable in the respective tilt-latch housing 60. The upper sash window 11 can then be tilted by a user retracting the latch bolts 50 via the actuators 200. Further in this preferred embodiment, a pair of tilt-latch mechanisms 31 are utilized in a pair of integrated tilt-latch and sash lock mechanisms 30 as described above and installed and connected in the top rail 20 of the lower sash window 12.

Accordingly, the tilt latch mechanism 31 shown in FIGS. 30-38 and 39-43 can be actuated in two different manners, and is adapted to receive one of two different and separate actuators in two different configurations. Preferably, the two configurations are transverse to each other. In the first configuration, the actuator 52 is received in a generally horizontal configuration to actuate the tilt latch mechanism 31. As shown in FIGS. 30-38, the tilt latch mechanism 31 can be actuated through the rear opening 68 of the housing 60 by the connector 52 acting as the actuator. In the second configuration, the actuator 200 is received in a generally horizontal configuration to actuate the tilt latch mechanism 31. As shown in FIGS. 39-43, the tilt latch mechanism 31 can be actuated through the slot 205 in the housing 60 by manipulation of the actuator 200.

Additionally, the tilt latch mechanism 431 of FIGS. 85-86 can function as a stand-alone mechanism in the same manner as the tilt latch mechanism 31 of FIGS. 30-38. The structure, function, mounting, and operation of the stand-alone tilt latch mechanism 431 is the same as described above with respect to the stand-alone tilt latch mechanism 31 shown in FIGS. 39-44, with the exception of the modified stile-engaging members 464.

The present invention provides another embodiment of an integrated tilt latch and sash lock assembly 330, illustrated in FIGS. 59-84. It is understood that some of the features or components of the integrated assembly 30 shown in FIGS. 1-38, the integrated assembly 130 shown in FIGS. 45-56, and the tilt latch assembly 431 shown in FIGS. 85-86 may be interchanged with the features or components of the integrated assembly 330. The integrated assembly 330 provides a sash locking operation by a sash lock mechanism 332. Additionally, the integrated assembly 330 provides a tilt-latch operation by a tilt latch mechanism 331. While the integrated assembly 330 will be described herein with respect to a single integrated assembly 330, the integrated assembly 330 can also be used in connection with a dual integrated assembly. In such an instance, the second half of the integrated assembly will be substantially the same as that half of the integrated assembly 330 described herein. Also, as can be understood from FIGS. 59 and 60, a preferred embodiment of the invention has a left-side integrated assembly 330 and a right-side integrated assembly 330.

Figure 59:
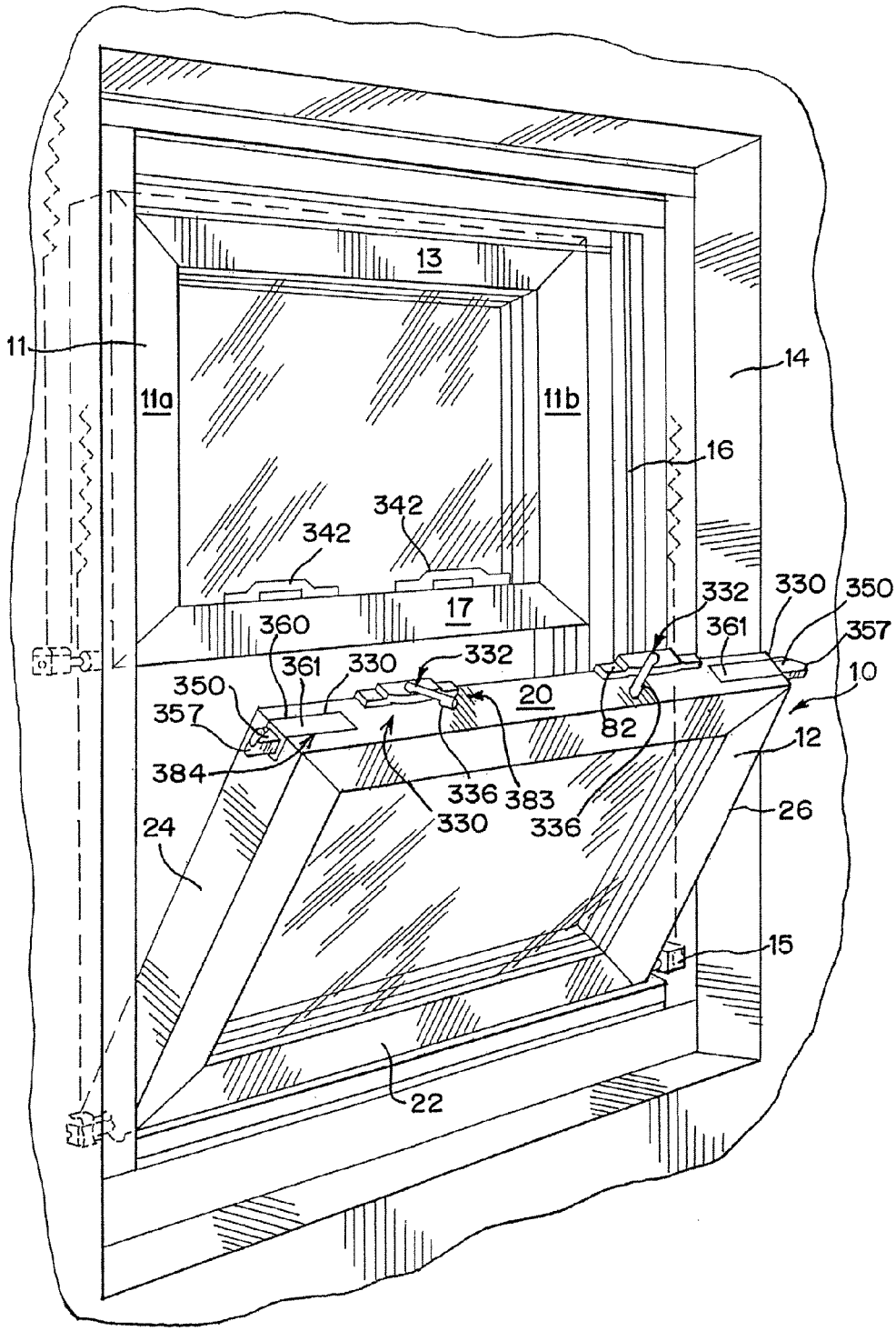
FIG. 59 is a perspective view of a sash window assembly incorporating an integrated tilt/sash lock of the present invention.
Figure 60:
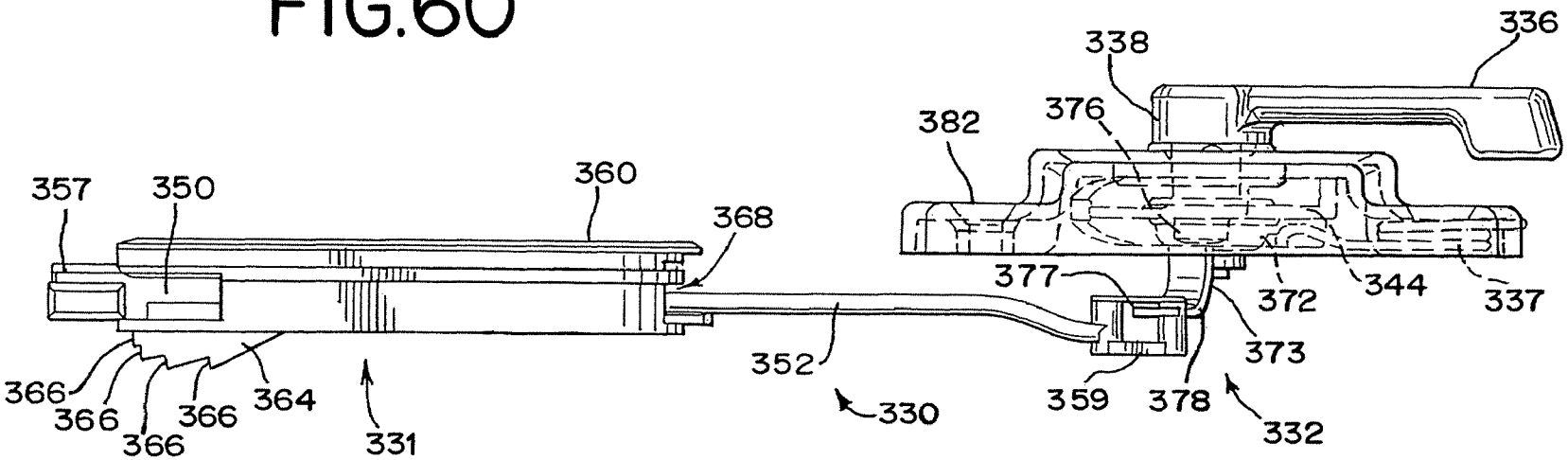
FIG. 60 is an elevation view of an integrated tilt/sash lock assembly of the present invention.
Figure 61:
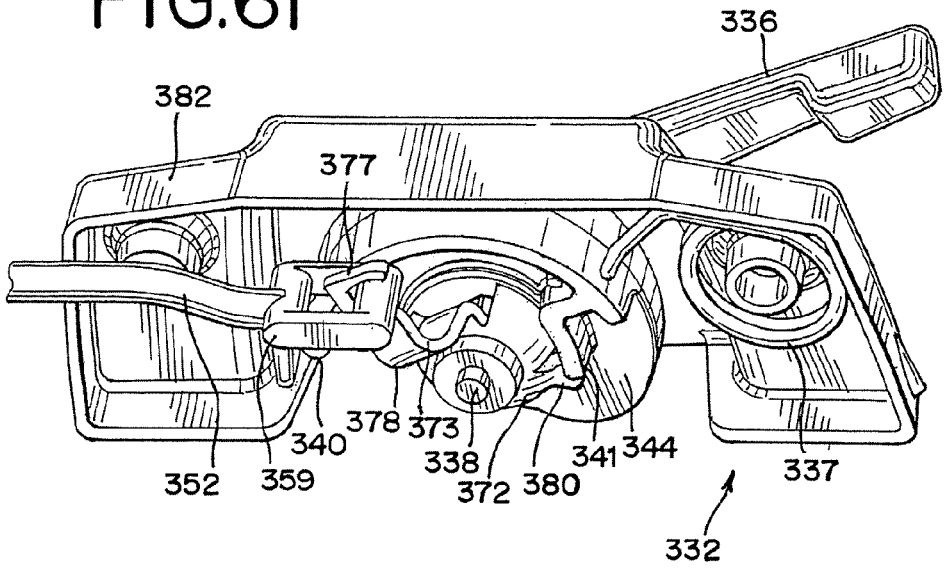
FIG. 61 is a front-bottom perspective view of a sash lock of the assembly of FIG. 2 and also partially showing a connector.
Figure 62:
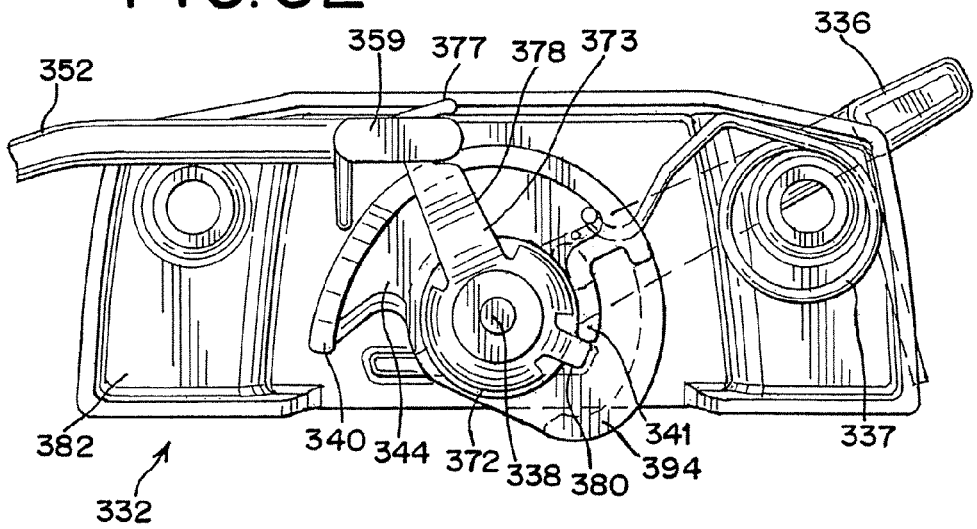
FIG. 62 is a bottom view of the sash lock of FIG. 61.
Figure 63:
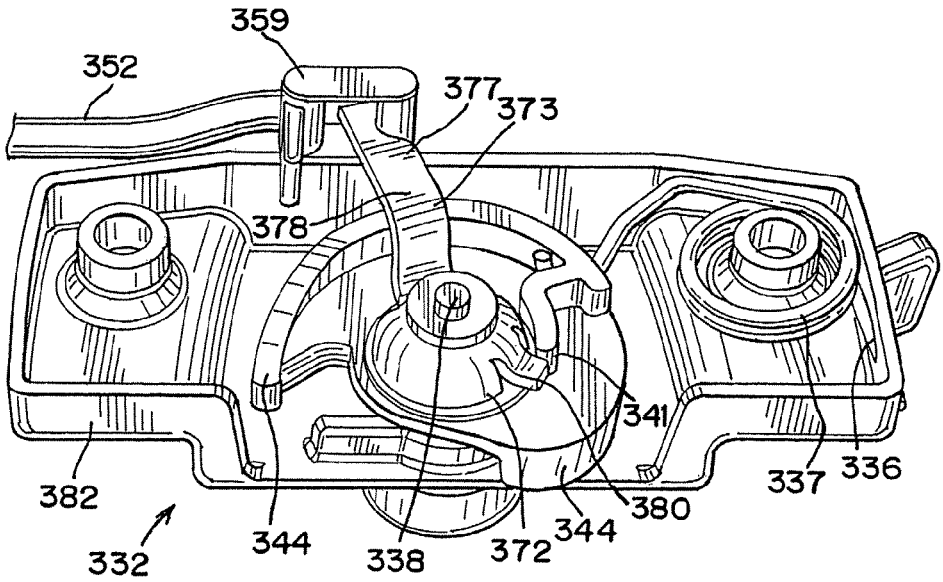
FIG. 63 is a rear-bottom perspective view of the sash lock of FIG. 61.
Figure 64:
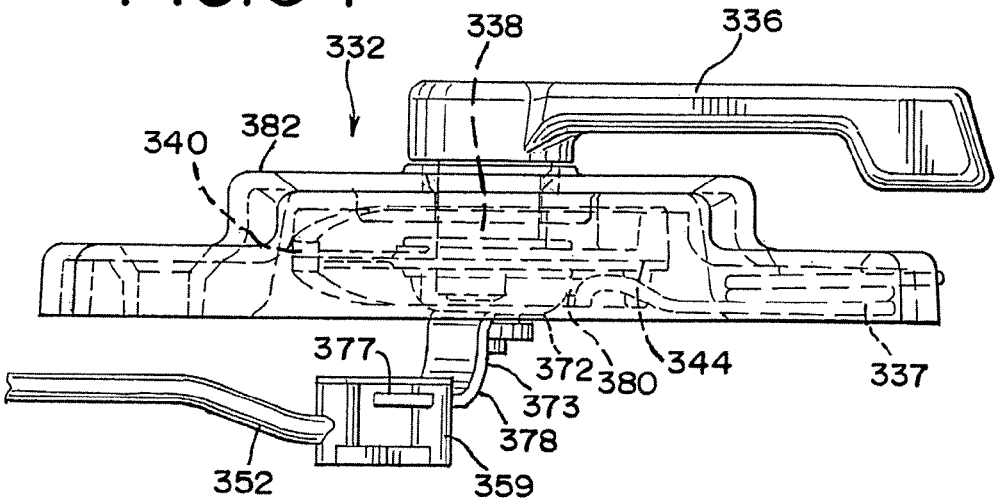
FIG. 64 is an elevation view of the sash lock of FIG. 61.

Referring to FIGS. 59 and 60, the integrated tilt/sash lock assembly 330 generally includes the sash lock mechanism 332 and the tilt-latch mechanism 331. The sash lock mechanism 332 includes a cam 344 operably associated with a pawl 372 that has an appending member 378. The tilt-latch mechanism 331 includes a housing 360 having a rear opening 368 and a latch bolt 350 slidably disposed in the housing 360. The tilt latch mechanism 331 is adapted to be flush-mounted on the top sash rail 20 of the window assembly 10, in contrast to the embodiments described above, which are adapted to be concealed within the top sash rail 20. A connector 352 also preferably forms part of the assembly 330. The connector 352 has a first end 354 operably connected to the pawl 372 and a second end 356 passing through the rear opening 368 of the housing 360 and connected to the latch bolt 350.

Referring to FIGS. 60-64, the sash lock mechanism 332 includes an actuator arm 336 connected via a shaft 338 to a cam 344. The cam 344 preferably includes an abutment member 341 and a locking member 340 configured to engage a keeper or locking bracket 342. The sash lock mechanism 332 also includes the pawl 372 that is comprised of a base 376 and a pawl member or appending member 378. The pawl 372 is operably associated with the connector 352 that extends away from the sash lock mechanism 332 to the tilt latch mechanism 331. Preferably, the appending member 378 contains a hook 377 that engages a hitch 359 on the connector 352, as illustrated in FIGS. 60-64. The base 376 includes a tab 380 extending outwardly from an outer surface of the pawl 372. The cam 344 and the pawl 372 are disposed proximate one another in operable association with each other. Movement of the actuator arm 336 causes the cam 344 to rotate. Preferably, the cam 344 rotates freely and independently of the pawl 372 for a portion of the range of rotation. However, at a point in the rotation, the abutment member 341 of the cam 344 abuttingly engages the tab 380 of the pawl 372, such that when engaged, the cam 344 and the pawl 372 generally rotate in unison.

A sash lock housing 382 covers and helps support the other components of the sash lock mechanism 332, and is designed to be attached to the top sash rail 20, as illustrated in FIG. 59. As shown in one embodiment illustrated in FIG. 62, the sash lock housing 382 may be disposed in a first location 383 of the sash rail 20 that is laterally offset from, or misaligned with, a second location 384 of the sash 20 rail in which the latch bolt housing 360 is disposed. In this embodiment, the appending member 378 of the pawl 372 includes a step portion 373. As shown in FIG. 60, the base 376 of the pawl 372 will be mounted proximate the first location 383, which is at a higher location in the top sash rail 20. The step portion 373 allows the latch bolt housing 360 to be mounted at a lower depth in the rail 20 than the sash lock housing 382. Such a configuration facilitates a channel in the sash window rail 20 of sufficient depth to secure the latch bolt housing 360 with minimal compromise to the structural integrity of the rail 20. It is understood that the step portion 373 can vary for different assembly configurations.

Figure 65:
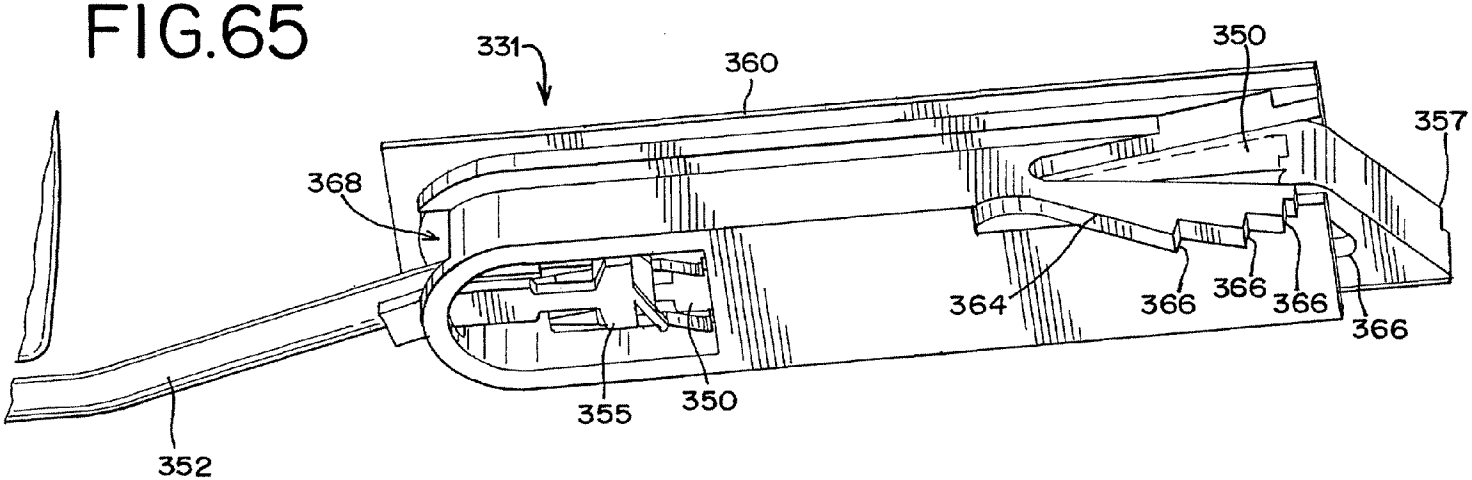
FIG. 65 is a rear-bottom perspective view of a tilt-latch of the assembly of FIG. 60.
Figure 66:
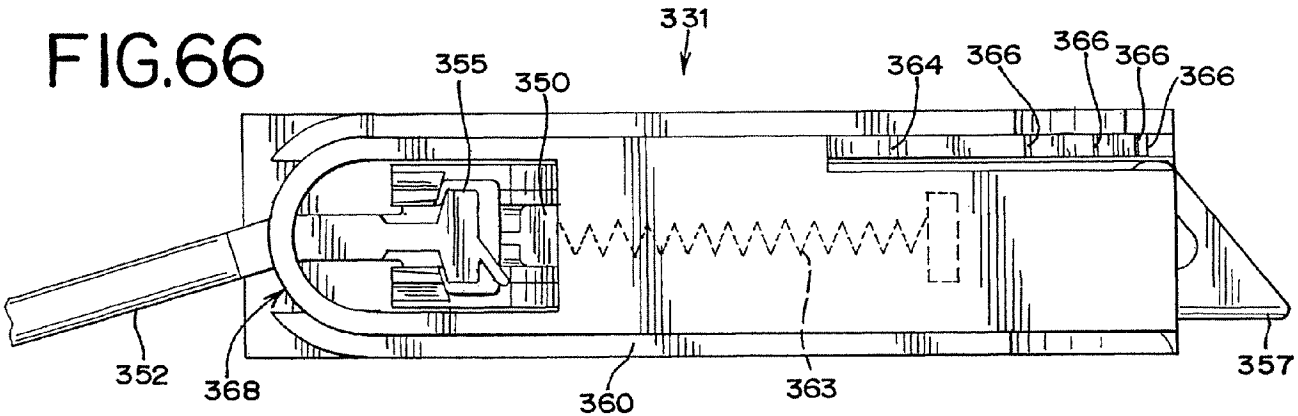
FIG. 66 is a bottom view of the tilt-latch of FIG. 65.

Referring to FIGS. 59 and 65-66, the tilt-latch mechanism 331 includes a latch bolt 350 disposed within a housing 360 and coupled to a spring 363 (FIG. 66) and the connector 352. It is understood the spring 363 is generally positioned between the latch bolt and the housing to bias the latch bolt out of the housing. The housing 360 is used to support the latch bolt 350 in the top sash rail 20, and is preferably flush-mounted within the top sash rail 20, as shown in FIG. 59. The latch bolt 350 is able to slide within the housing 360 between a retracted position, wherein the noses 357 or tip 357 of the latch bolt 350 is retracted into the housing 360, and an outwardly-extended position, wherein the tip 357 of the latch bolt 350 extends beyond the edge of the stile 24,26. When the sash window 12 is closed, the latch bolt 350 engages one of the guide rails 16 in the outwardly-extended position. The spring biases the latch bolt 350 towards the outwardly-extended position. The connector 352 connects to the latch bolt 350, preferably by a snap-fit connection 355, as illustrated in FIGS. 65-66. Additionally, the housing 360 preferably contains a rear opening 368, allowing the connector 352 to pass through and connect to the latch bolt 350. The rear opening 368 is defined within the rear portion of the housing 368, opposite the tip 357 of the latch bolt 350, and is preferably a rectangular hole, as illustrated in FIGS. 65-66. However, the rear opening 368 can also take the form of a slot or a groove in the rear portion of the housing, and can be shaped differently as well. The opening 368 can also be positioned in other portions of the housing 368.

The housing 360 also includes a stile-engaging member 364 having a stepped configuration to define a plurality of engaging surfaces 366. Each of the plurality of engaging surfaces 366 allows the housing to engage a stile 24,26 of different thickness, increasing the versatility of the tilt latch mechanism 331. The stile-engaging member 364 is preferably resilient. Accordingly, the stile-engaging member 364 is able to bend to allow the tilt-latch mechanism 331 to be inserted into the top sash rail 20 without being permanently deformed. Thus, a single housing 368 design can be used with multiple sash window designs.

The connector 352 preferably connects the tilt latch mechanism 331 and the sash lock mechanism 332, and has a first end 354 and a second end 356. The first end 354 of the connector 352 is operably associated with the pawl 372, preferably by engaging the appending member 378 of the pawl 372. The second end 356 of the connector 352 is connected to the latch bolt 350, preferably by passing through the rear opening 368 of the housing 360 and forming a snap-fit connection 355 with the latch bolt, as described above and illustrated in FIGS. 65-66. According to one embodiment of the present invention, the connectors 352 are flexible cords. It is preferred, however, that the connectors 352 are instead rigid or semi-flexible connecting rods. The connector 352 also contains several bracing arms 353 at the second end 356 that function to brace the connector 352 within the snap-fit connection 355 and properly align the connector 352, similarly to the bracing arms 53 described above. The hitch 359 of the connector 352 shown in FIGS. 60-64 is different from the hitch 59 of the embodiment shown in FIGS. 19-23, and contains only a vertical bar to which the hook 377 of the pawl 372 is connected.

The actuator arm 336 of the present invention is operable between three positions, locked, unlocked and tiltable. It is contemplated that the actuator arm 336 and/or the housing 382 includes some indicia thereon for assisting a user during operation. When the sash windows are in the locked position (with the actuator 336 on the left-hand integrated assembly 330 rotated to the far left in FIG. 59) (it is further understood that the actuator 336 on the right-hand integrated assembly 330 would be rotated to the far right in FIG. 59), the locking member 340 engages the locking bracket 342 and the latch bolts 350 are in the outwardly-extended position. Thus, the sash window 12 is prevented from vertically opening and from tilting. In this position, the cam 344 and the pawl 372 are not engaged with each other, and the cam 344 moves freely and independently of the pawl 372.

When the actuator arm 336 is moved from the locked position to the unlocked position (with the actuator 336 on the left-hand integrated assembly 330 rotated towards the center in FIG. 59), the cam 344 is rotated to a first angle from the locked position. This rotation disengages the locking member 340 from the keeper or locking bracket 342, permitting the sash window to vertically open. However, the tab 380 of the pawl 372 is not yet engaged by the cam 344 and thus the latch bolt 350 remains outwardly extended into the guide rail 16. Thus, the sash window 12 continues to be prevented from tilting. Additionally, a spring within the latch bolt housing 360 may bias the cam 344 toward the unlocked position.

When the actuator arm 336 is moved from the unlocked position to the tiltable position (with the actuator 336 on the left-hand integrated assembly 330 rotated to the far right in FIG. 59), the cam 344 is rotated to a second angle from the locked position, wherein the second angle is greater than the first angle. In the tiltable position, the locking cam 344 remains disengaged from the locking bracket 342, still permitting the sash window to vertically open. However, the cam 344 is rotated to engage the tab 380 extending from the pawl 372, causing the pawl 372 to rotate in unison with the cam 344. Further rotation of the pawl 372 pulls the connector 352, which in turn pulls the latch bolt 350 toward the retracted position. In this retracted position, the latch bolt 350 is released from the guide rail 16, permitting the sash window 12 to tilt about the pivot corner 15.

When operating the actuator arm 336 in reverse to the above, the actuator arm 336 is moved from the tiltable position to the unlocked position, and the cam 344 is rotated back to the first angle. The locking member 340 remains disengaged from the locking bracket 342, still permitting the sash window 12 to vertically open. In the unlocked position, the latch bolt 350 moves back to toward the outwardly-extended position due to the bias created by the spring 363. This movement is made possible because the pawl 372 is no longer is engaged with, and rotatably biased by, the cam 344 and does not pull the latch bolt 350 toward the retracted position. Thus, the sash window 12 is prevented from tilting.

When the actuator arm 336 is moved from the unlocked position to the locked position. The locking member 340 engages the locking bracket 342, preventing the sash window 12 from opening. Thus, the sash window 12 is still prevented from tilting, and the latch bolt 350 provides additional security against opening of the window.

The actuator arm 336 and the upper side of the cam 344 may include cooperating structures, such that the integrated assembly 330 produces an audible click whenever the actuator arm reaches any of the locked, unlocked, or released positions.

Figure 67:
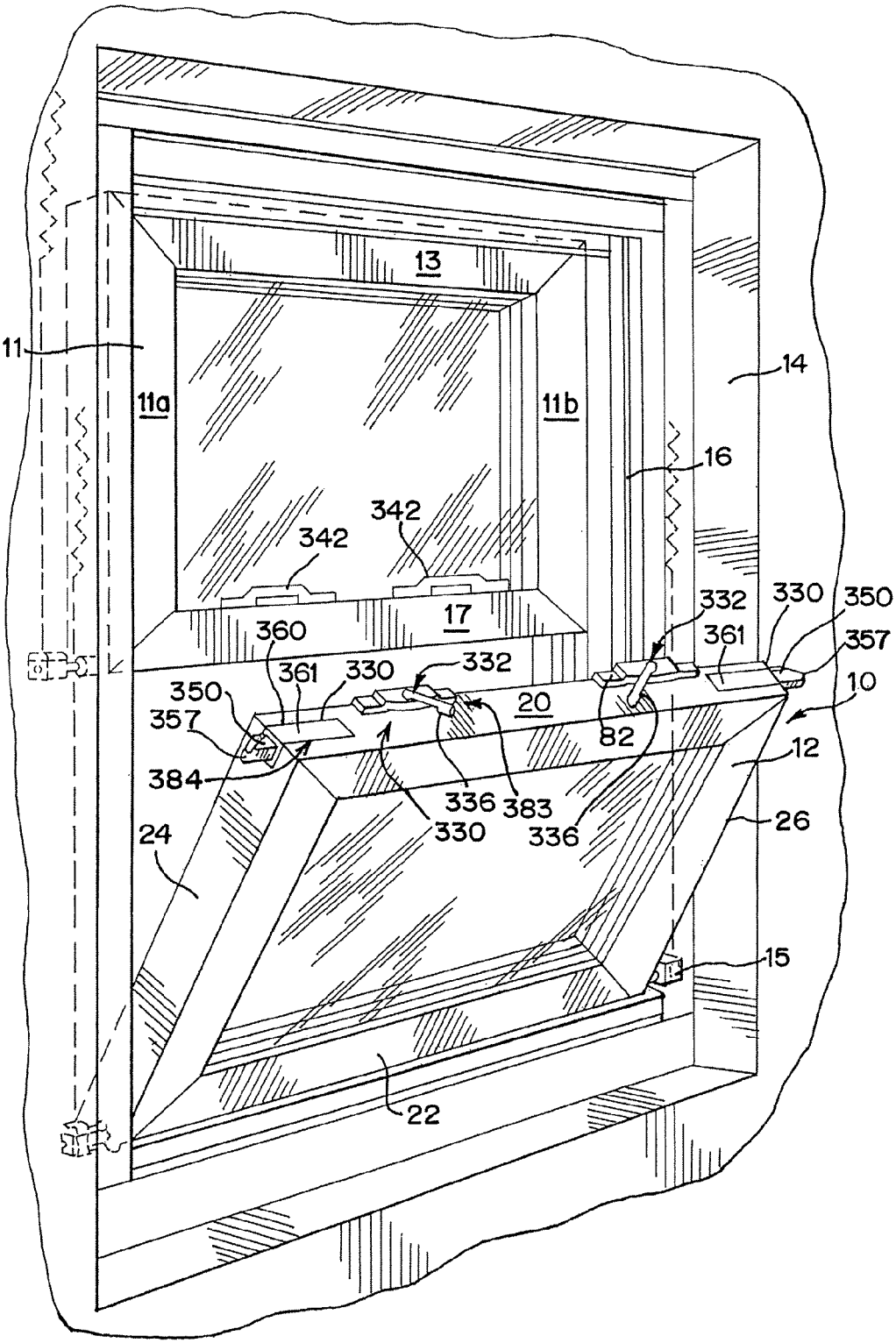
FIG. 67 is a perspective view of a sash window assembly incorporating another embodiment of the integrated tilt/sash lock assembly of the present invention.

FIGS. 67-84 disclose another embodiment of an integrated tilt/sash lock assembly 330 of the present invention. The same reference numerals will be used to describe similar structures with respect to this embodiment as with the embodiment of FIGS. 59-66. This embodiment is likewise installed in a sash window assembly 10 such as shown in FIG. 67.

Similar to the previous embodiment, the sash window assembly 10 includes an integrated tilt/sash lock assembly 330. The integrated assembly 330 provides a sash locking operation with a sash lock mechanism 332. Additionally, the integrated assembly 330 provides a tilt-latch operation with a tilt latch mechanism 331. While the integrated assembly 330 will be described herein with respect to a single integrated assembly 330, the integrated assembly 330 can also be used in connection with a dual integrated assembly. In such an instance, the second half of the integrated assembly will be substantially the same as that half of the integrated assembly 330 described herein. Also, as can be understood from FIG. 67, a preferred embodiment of the invention has a left-side integrated assembly 330 and a right-side integrated assembly 330.

Referring to FIGS. 67-72, the integrated tilt latch and sash lock assembly 330 generally includes the sash lock mechanism 332 and the tilt-latch mechanism 331. The sash lock mechanism 332 includes a cam 344 operably associated with a pawl 372 that has a pawl member 378. The tilt-latch mechanism 331 includes a housing 360 having a rear opening 368 and a latch bolt 350 disposed in the housing 360. A connector 352 also preferably forms part of the assembly 330. The connector 352 has a first end 354 operably associated with the pawl member 378 and a second end 356 passing through the rear opening 368 of the housing 360 and connected to the latch bolt 350.

Figure 70:
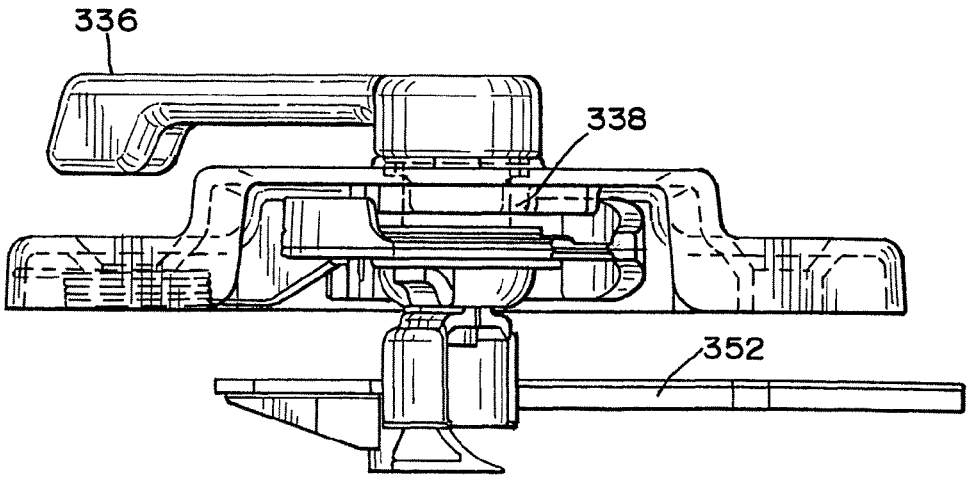
FIG. 70 is a partial elevation view of the sash lock mechanism of the integrated assembly of FIG. 67.
Figure 71:
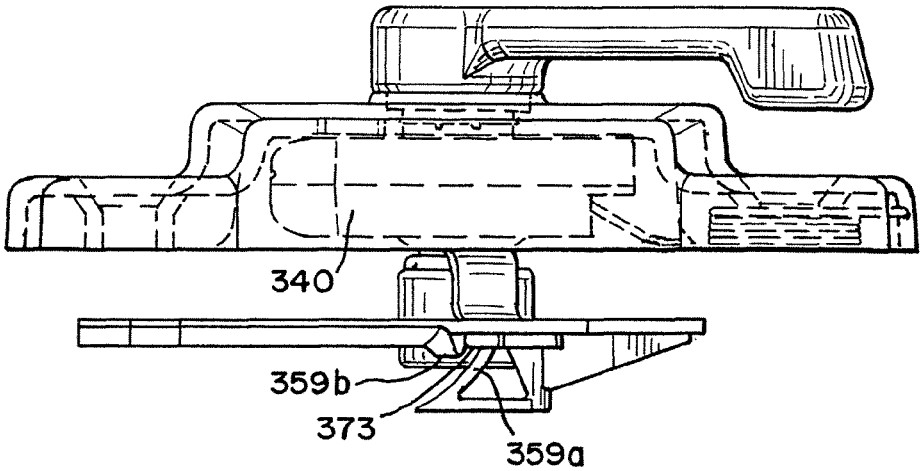
FIG. 71 is another partial elevation view of the sash lock mechanism of the integrated assembly of FIG. 67.

Referring to FIGS. 68-72, the sash lock mechanism 332 includes an actuator arm 336 connected via a shaft 338 to a cam 344. The cam 344 includes an abutment member 341 as in the previous embodiment and a locking member 340 configured to engage a keeper or locking bracket 342. The sash lock mechanism 332 also includes the pawl 372 that is similar in general structure to the pawl 372 of the previous embodiment. The pawl 372 is comprised of a base 376 and a pawl member or appending member 378. The pawl 372 is operably associated with a connector 352 that extends away from the sash lock mechanism 332 to the tilt-latch mechanism 331. Preferably, the appending member 378 contains a hook 377 that engages a hitch 359 on the connector 352, as illustrated in FIG. 71. The base 376 may include a tab 380 extending outwardly from an outer surface of the pawl 372 like in previous embodiments. The cam 344 and the pawl 372 are disposed proximate one another in operable association with each other. Movement of the actuator arm 336 causes the cam 344 to rotate. Preferably, the cam 344 rotates freely and independently of the pawl 372 for a portion of the range of rotation. However, at a point in the rotation, the abutment member 341 of the cam 344 abuttingly engages the tab 380 of the pawl 372, such that when engaged, the cam 344 and the pawl 372 generally rotate in unison. The sash lock mechanism 332 may also include a depending fastener 333 in the form of a cap member 333. The cap member 333 is connected to the cam 344 and holds the pawl 372 on the shaft 338 to assure that the pawl 372 is properly associated with the cam 344. The cap member 333 has an eccentric body that depends down from the cam 344. This cap member 333 functions similarly to the cap member 35 described above and shown in FIGS. 4-20, pushing a curved arm 351 of the connector 352 to retract the latch bolt 350 slightly prior to the engagement of the abutment member 341 of the cam 344 and the tab 380 of the pawl 372.

Figure 72:
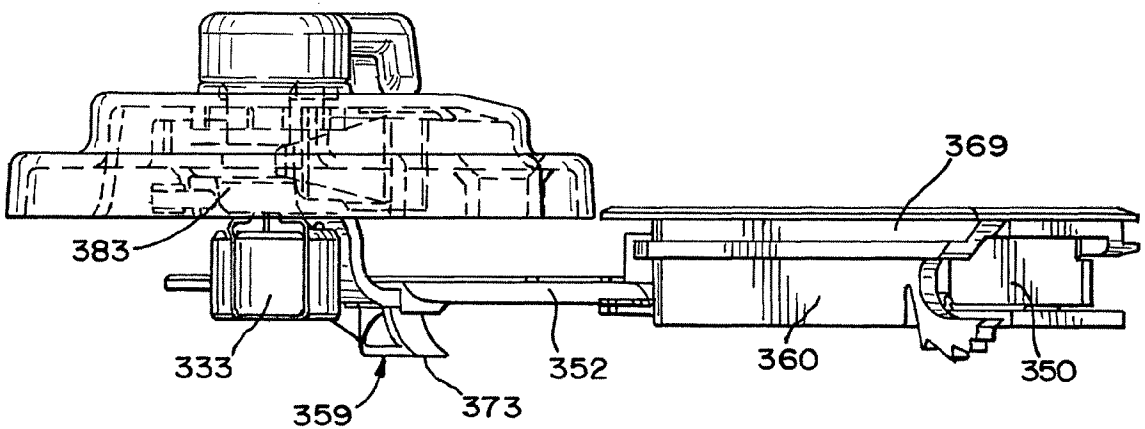
FIG. 72 is an elevation view of the integrated assembly of FIG. 67.
Figure 73:
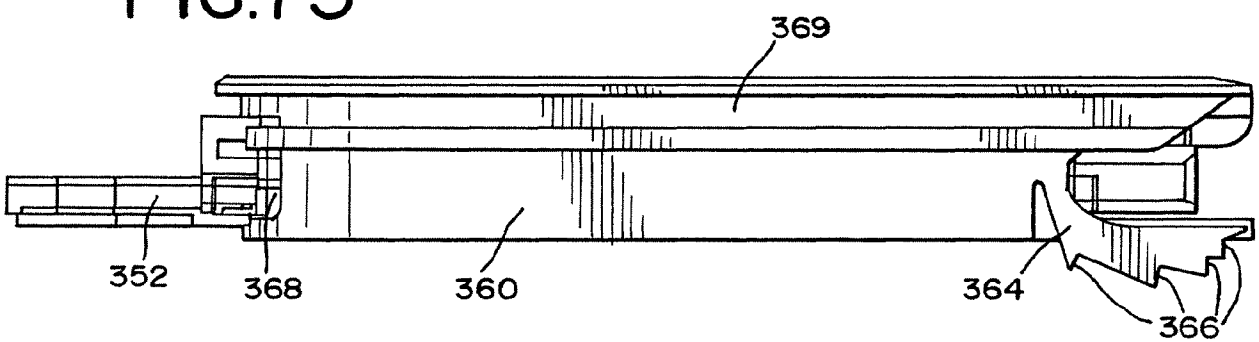
FIG. 73 is a partial elevation view of a tilt-latch mechanism of the integrated assembly of FIG. 67 and showing a portion of the connector.
Figure 74:
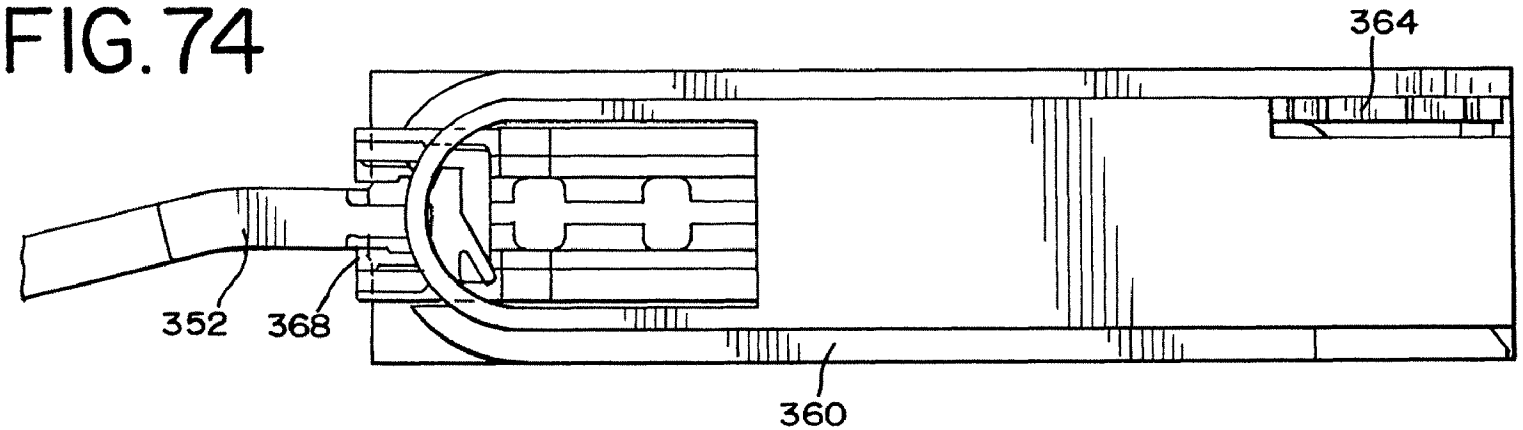
FIG. 74 is a partial underside view of the tilt-latch mechanism of the integrated assembly.
Figure 75:
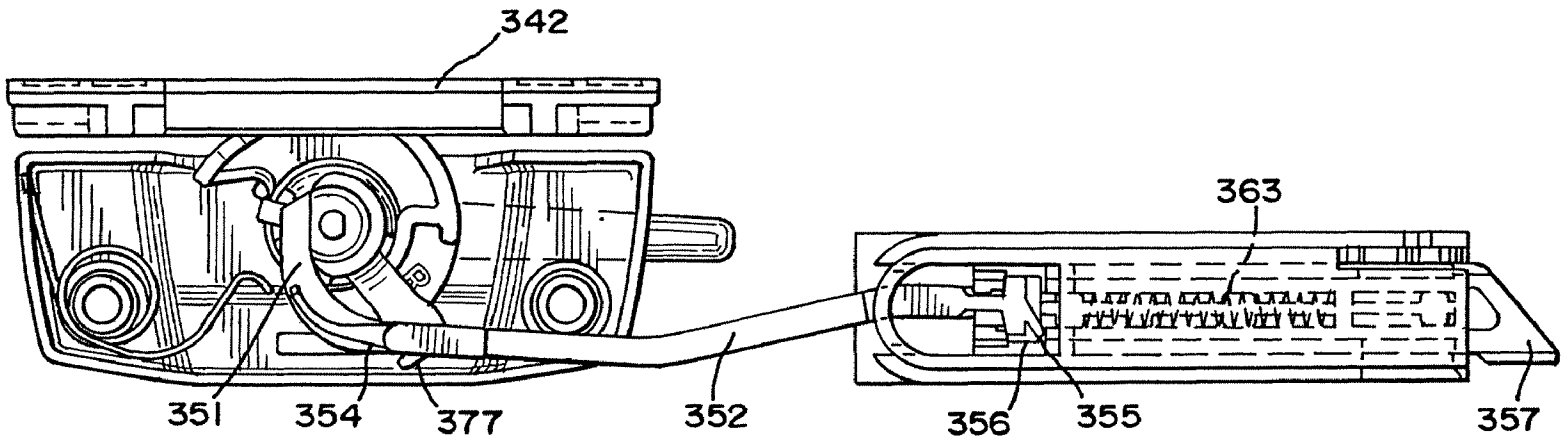
FIG. 75 is an underside plan view of the integrated tilt/sash lock assembly of FIG. 67 wherein the sash lock is in a locked position and the tilt-latch is in an extended position.
Figure 76:
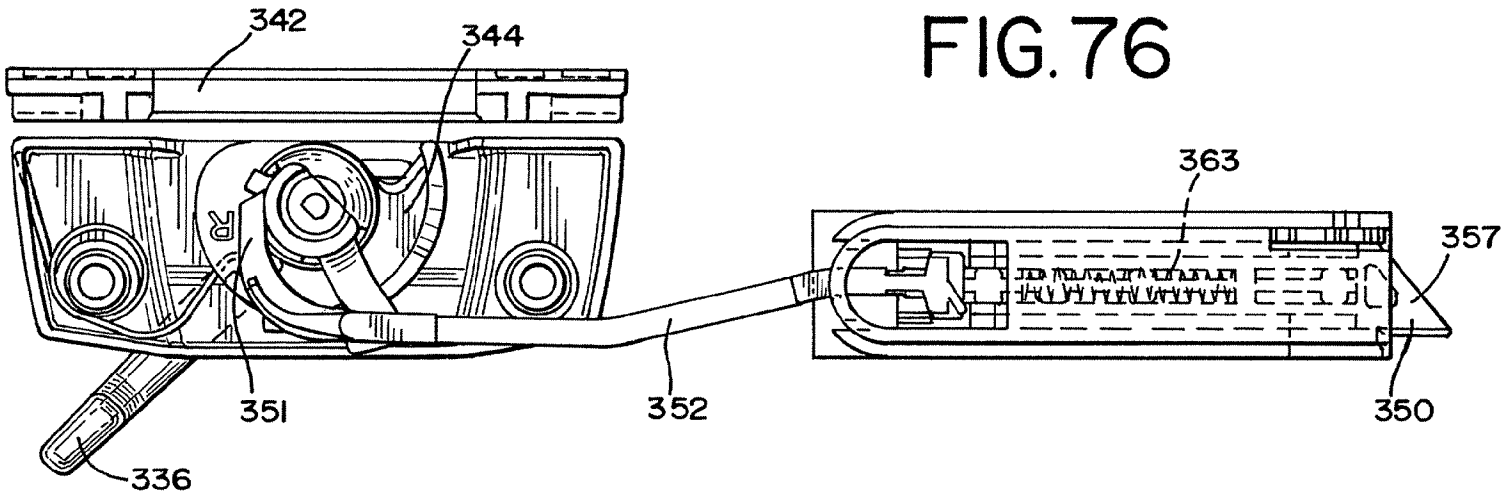
FIG. 76 is an underside plan view of the integrated assembly shown in FIG. 75 wherein the sash lock is in an unlocked position.

A sash lock housing 382 covers and helps support the other components of the sash lock mechanism 332, and is designed to be attached to the top sash rail 20, as illustrated in FIG. 67. As shown in one embodiment illustrated in FIGS. 68-69, the sash lock housing 382 may be disposed in a first location 383 of the sash rail 20 that is laterally offset from, or misaligned with, a second location 384 of the top sash rail 20 in which the latch bolt housing 360 is disposed. In this embodiment, the appending member 378 of the pawl 372 may include a step portion 373. As shown in FIGS. 71-72, the base 376 of the pawl 372 will be mounted proximate the first location 383, which is at a higher location in the top sash rail 20. The step portion 373 allows the latch bolt housing 360 to be mounted at a lower depth in the rail 20 than the sash lock housing 382. Such a configuration facilitates a channel in the sash window rail 20 of sufficient depth to secure the latch bolt housing 360 with minimal compromise to the structural integrity of the rail 20. It is understood that the step portion 373 can vary for different assembly configurations.

Figure 68:
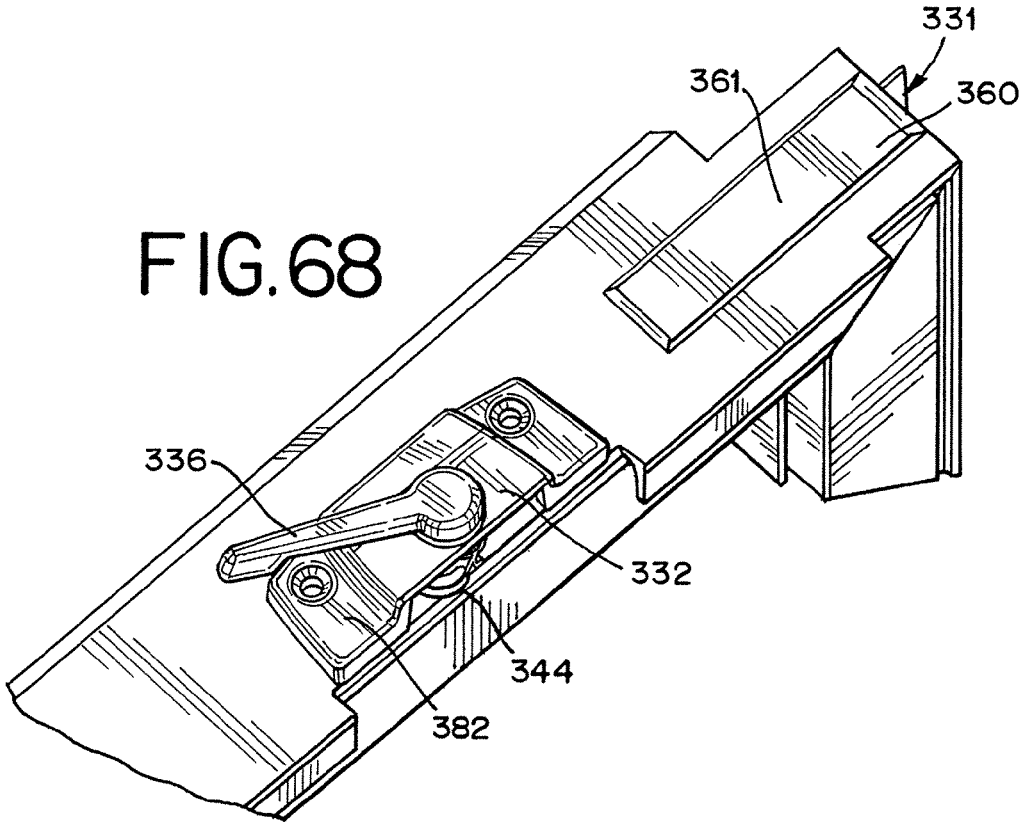
FIG. 68 is a partial perspective view of a top rail of a sash window incorporating the integrated tilt/sash lock assembly shown in FIG. 67.
Figure 69:
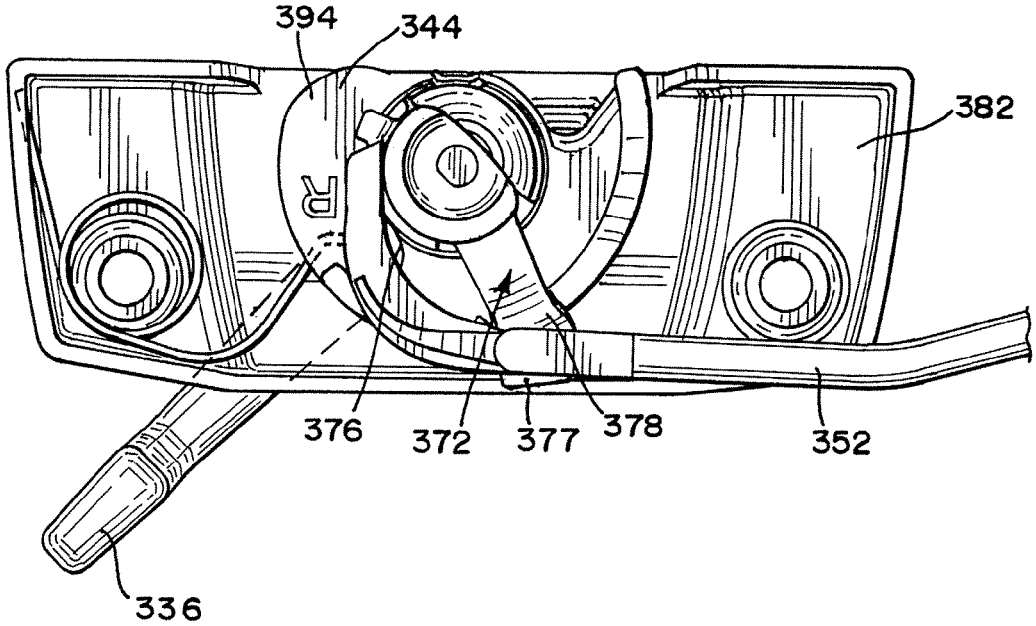
FIG. 69 is a partial underside view of a sash lock mechanism of the integrated assembly of FIG. 67 and showing a portion of a connector.

Referring to FIGS. 67, 68, and 72-74, the tilt-latch mechanism 331 includes a latch bolt 350 disposed within a housing 360 and coupled to a spring 363 (FIGS. 75-80) and the connector 352. It is understood the spring 363 is generally positioned between the latch bolt and the housing 360 to bias the latch bolt 350 out of the housing 360. The housing 360 is used to support the latch bolt 350 in the top sash rail 20, and is preferably flush-mounted within the top sash rail 20, as shown in FIGS. 67-68. The housing 360 has a side wall rail that cooperates with the cover of the housing to form a groove 369 used to receive a header rail of the top rail. The structures forming the groove 369 can be continuous or non-continuous as desired. The housing 360 includes a planar top wall 361 that is substantially flush with the top rail 20 and provides a smooth aesthetic view along the top rail 20. The latch bolt 350 is able to slide within the housing 360 between a retracted position, wherein the nose 357 or tip 357 of the latch bolt 350 is retracted into the housing 360, and an outwardly-extended position, wherein the tip 357 of the latch bolt 350 extends beyond the edge of the stile 24,26. When the sash window 12 is closed, the latch bolt 350 engages one of the guide rails 16 in the outwardly-extended position. The spring biases the latch bolt 350 towards the outwardly-extended position. The connector 352 connects to the latch bolt 350, preferably by a snap-fit connection 355, as illustrated in FIGS. 65-66. Additionally, the housing 360 preferably contains a rear opening 368, allowing the connector 352 to pass through and connect to the latch bolt 350. The rear opening 368 is defined within the rear portion of the housing 368, opposite the tip 357 of the latch bolt 350, and is preferably a rectangular hole, as illustrated in FIGS. 73-80. However, the rear opening 368 can also take the form of a slot or a groove in the rear portion of the housing, and can be shaped differently as well. The opening 368 can also be positioned in other portions of the housing 368. The latch bolt 350 may include multiple openings that can receive the end of the connector 352 to provide an adjustable connection. Similar to the tilt-latch described above, the tilt-latch housing 368 could be modified to have two openings wherein in one configuration, a traditional actuator may be connected to the latch bolt through an opening for example in the cover of the housing 368 when the tilt-latch housing 368 is not used with an integrated assembly. In the other configuration, the connector 352 would be used as described above, which would require an additional component to cover the opening in the cover of the housing 368.

The housing 360 also includes a stile-engaging member 364 having a stepped configuration to define a plurality of engaging surfaces 366. Each of the plurality of engaging surfaces 366 allows the housing 360 to engage a stile 24,26 of different thickness, increasing the versatility of the tilt-latch 331. The stile-engaging member 364 is preferably resilient. The stile engaging member 364 shown in FIG. 73 may also have a depending member 367 that has a curved configuration. Accordingly, it is able to bend to allow the tilt-latch mechanism 331 to be inserted into the top sash rail 20 without being permanently deformed. Thus, a single housing 368 design can be used with multiple sash window designs.

The connector 352 preferably connects the tilt-latch mechanism 331 and the sash lock mechanism 332, and has a first end 354 and a second end 356. The first end 354 of the connector 352 is operably associated with the pawl 372, preferably by engaging the appending member 378 of the pawl 372. The second end 356 of the connector 352 is connected to the latch bolt 350, preferably by passing through the rear opening 368 of the housing 360 and forming a snap-fit connection 355 with the latch bolt, as described above and illustrated in FIGS. 74-80. According to one embodiment of the present invention, the connectors 352 are flexible cords. It is preferred, however, that the connectors 352 are instead rigid or semi-flexible connecting rods. The connector 352 also contains several bracing arms 353 at the second end 356 that function to brace the connector 352 within the snap-fit connection 355 and properly align the connector 352, similarly to the bracing arms 53 described above. Further, the connector 352 contains the curved arm 351 at the first end 354, which functions in combination with the cap member 333 of the sash lock mechanism 332 as described above. The hitch 359 of the connector 352 shown in FIGS. 70-71 is similar to the hitch 59 of the embodiment described above and shown in FIGS. 19-23. The hitch 359 contains a retaining structure to hold the hook 377 in place, which includes a flexible lip 359*a* and a protrusion 359*b*. The combination of the lip 359*a* and the protrusion 359*b* force the hook 377 into the retaining structure and then hold the hook 377 in place once the hook 377 is engaged with the hitch 359.

The actuator arm 336 of the present invention is operable between three positions, locked, unlocked and tiltable. It is contemplated that the actuator arm 336 includes some indicia thereon for assisting a user during operation. When the sash windows are in the locked position (with the actuator 336 on the left-hand integrated assembly 330 rotated to the far left in FIG. 67), the locking member 340 engages the locking bracket 342, or keeper, and the latch bolts 350 are in the outwardly-extended position (See FIG. 75). Thus, the sash window 12 is prevented from vertically opening and from tilting. In this position, the cam 344 and the pawl 372 are not engaged with each other, and the cam 344 moves freely and independently of the pawl 372.

When the actuator arm 336 is moved from the locked position to the unlocked position (with the actuator 336 on the left-hand integrated assembly 330 rotated towards the center in FIG. 67), the cam 344 is rotated to a first angle from the locked position. This rotation disengages the locking member 340 from the keeper or locking bracket 342, permitting the sash window to vertically open (See FIG. 76). However, the tab 380 of the pawl 372 is not yet engaged by the cam 344 and thus the latch bolt 350 remains outwardly extended into the guide rail 16. Thus, the sash window 12 continues to be prevented from tilting. Additionally, a spring 363 within the latch bolt housing 360 may bias the cam 344 toward the unlocked position.

Figure 77:
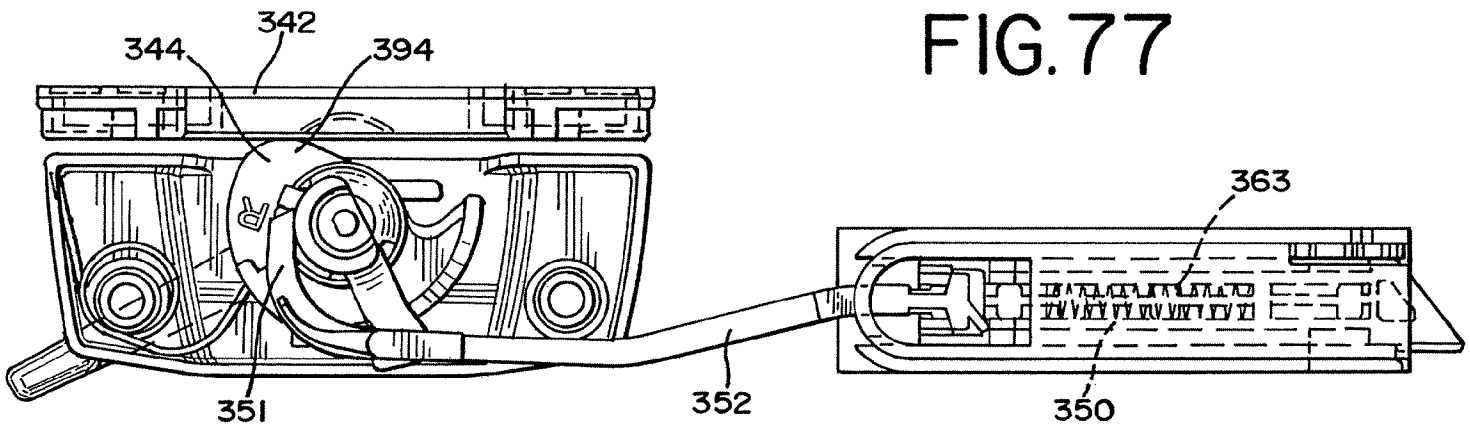
FIG. 77 is an underside plan view of the integrated assembly shown in FIG. 75 wherein the sash lock is in an unlocked position and a latch bolt of the tilt-latch mechanism is in a partially retracted position.
Figure 78:
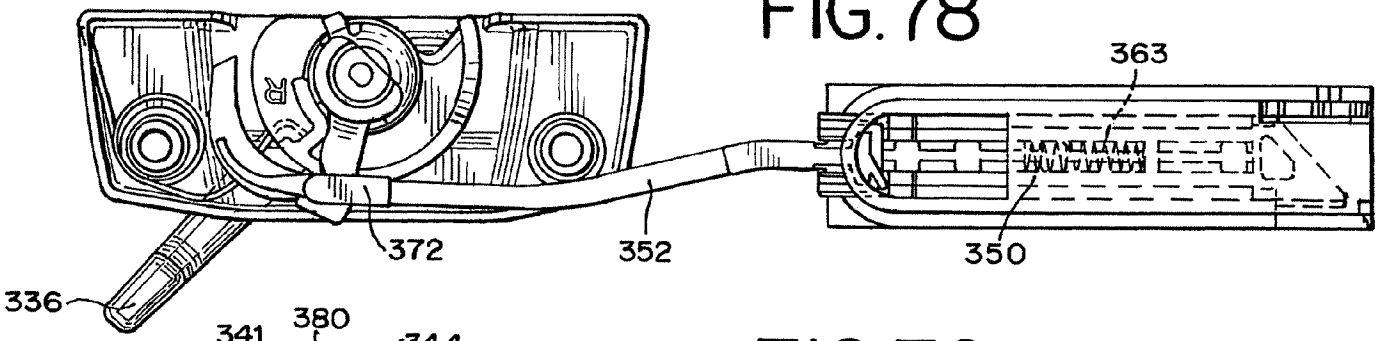
FIG. 78 is an underside plan view of the integrated assembly shown in FIG. 75 wherein the sash lock is in an unlocked position and the latch bolt is in a retracted position.
Figure 79:
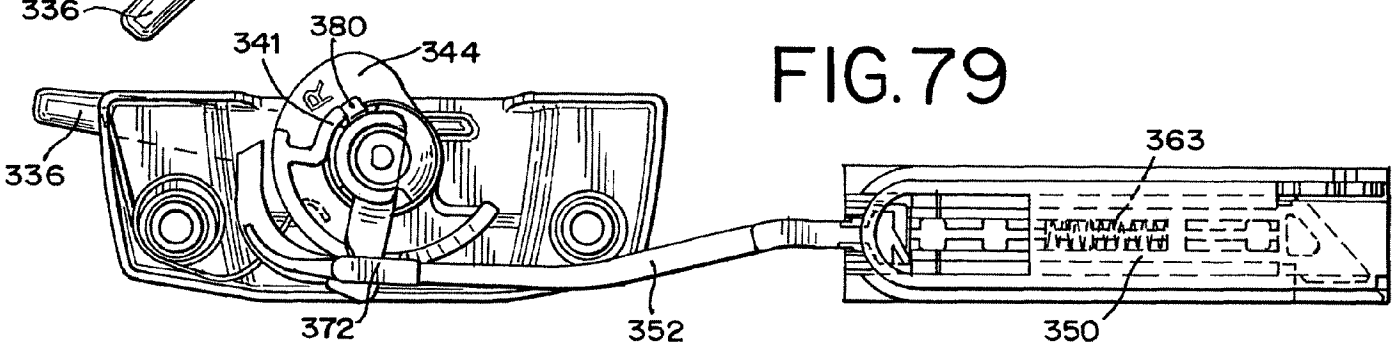
FIG. 79 is an underside plan view of the integrated assembly shown in FIG. 75 wherein the sash lock is in an unlocked position with a cam of the sash lock further rotated and the latch bolt is in a retracted position.
Figure 80:
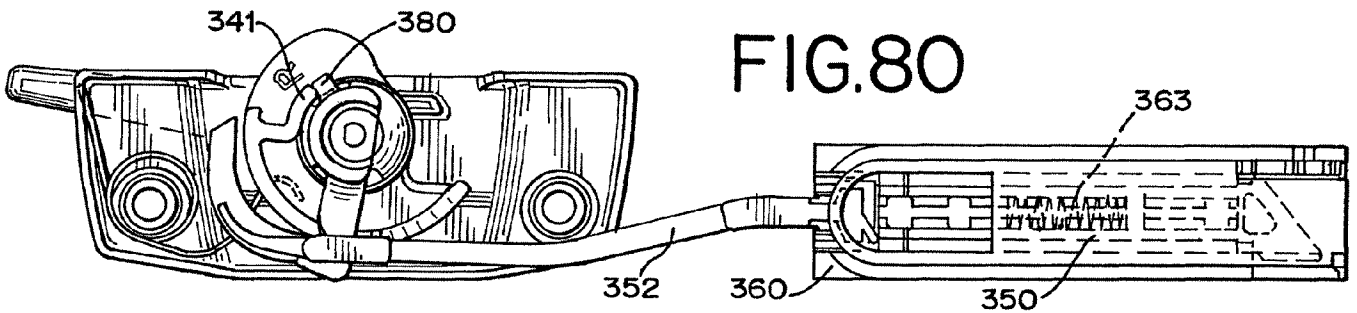
FIG. 80 is another underside plan view of the integrated assembly shown in FIG. 75 wherein the sash lock is in an unlocked position with a cam of the sash lock further rotated and the latch bolt is in a retracted position.

When the actuator arm 336 is moved from the unlocked position to the tiltable position (with the actuator 336 on the left-hand integrated assembly 330 rotated to the far right in FIG. 67), the cam 344 is rotated to a second angle from the locked position, wherein the second angle is greater than the first angle. In the tiltable position, the locking cam 344 remains disengaged from the locking bracket 342, still permitting the sash window to vertically open. However, the cam 344 is rotated to engage the tab 380 extending from the pawl 372, causing the pawl 372 to rotate in unison with the cam 344. FIG. 77 shows the latch bolt being initially retracted. Further rotation of the pawl 372 pulls the connector 352, which in turn pulls the latch bolt 350 toward the retracted position. In this retracted position, the latch bolt 350 is released from the guide rail 16, permitting the sash window 12 to tilt about the pivot corner 15. FIGS. 78-80 show the latch bolt in a fully retracted position. As described above, the rotation of the eccentric cap member 333 pushes on the curved arm 351 of the connector 352 to slightly retract the latch bolt 350 prior to the engagement of the tab 380 and the abutting member 341.

When operating the actuator arm 336 in reverse to the above, the actuator arm 336 is moved from the tiltable position to the unlocked position, and the cam 344 is rotated back to the first angle. The locking member 340 remains disengaged from the locking bracket 342, still permitting the sash window to vertically open. In the unlocked position, the latch bolt 350 moves back to toward the outwardly-extended position due to the bias created by the spring. This movement is made possible because the pawl 372 is no longer is engaged with, and rotatably biased by, the cam 344 and does not pull the latch bolt 350 toward the retracted position. Thus, the sash window 12 is prevented from tilting.

When the actuator arm 336 is moved from the unlocked position to the locked position. The locking member 340 engages the locking bracket 342, preventing the sash window 12 from opening. Thus, the sash window 12 is still prevented from tilting, and the latch bolt 350 provides additional security against opening of the window.

The actuator arm 336 and the upper side of the cam 344 may include cooperating structures, such that the integrated assembly 330 produces an audible click whenever the actuator arm reaches any of the locked, unlocked, or released positions.

Figure 81:
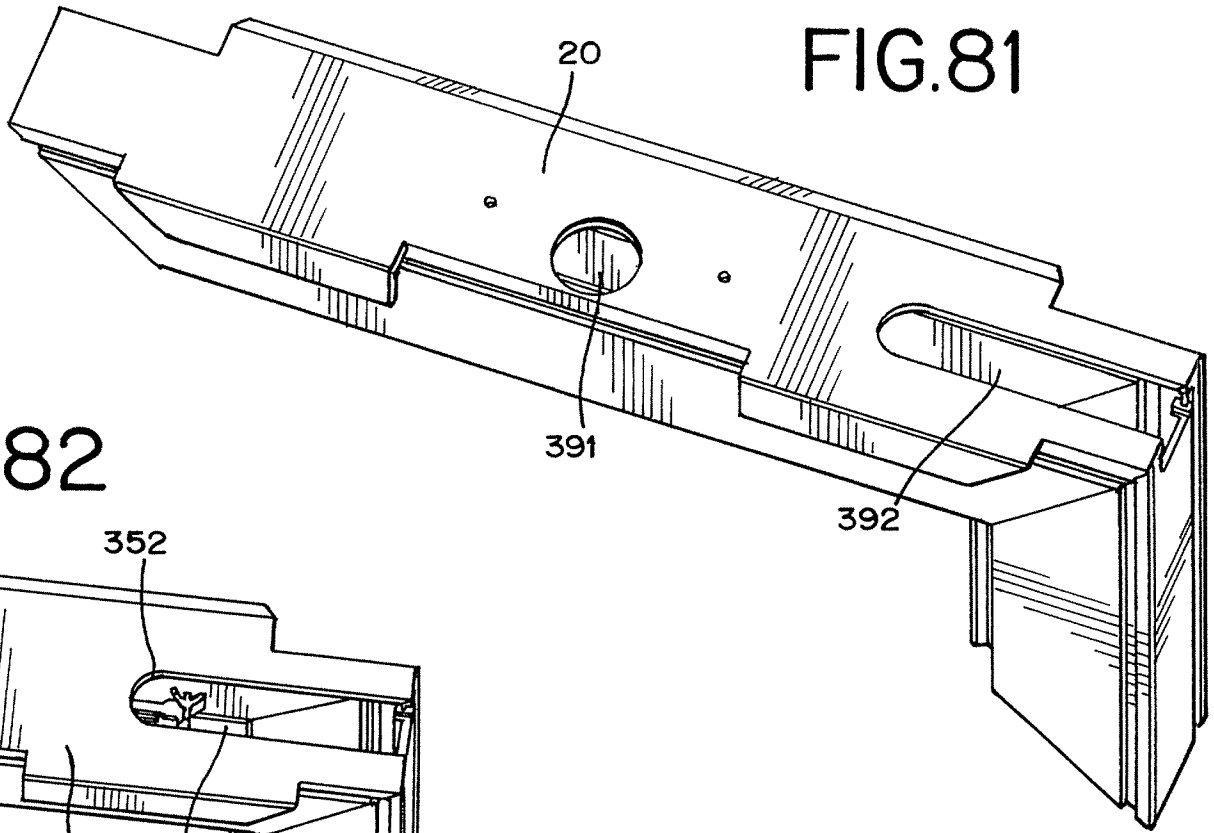
FIG. 81 is a partial perspective view of the top rail showing a first opening to receive the sash lock mechanism and a second opening to receive the tilt-latch mechanism.
Figure 82:
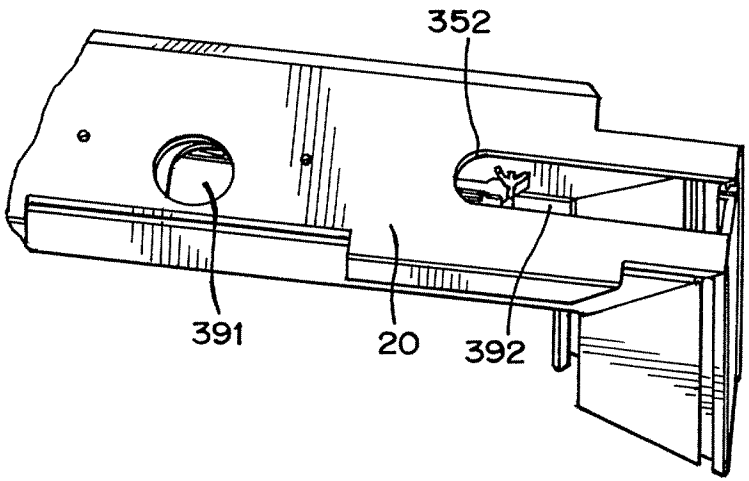
FIG. 82 is a partial perspective view of the top rail showing the connector in the top rail.
Figure 84:
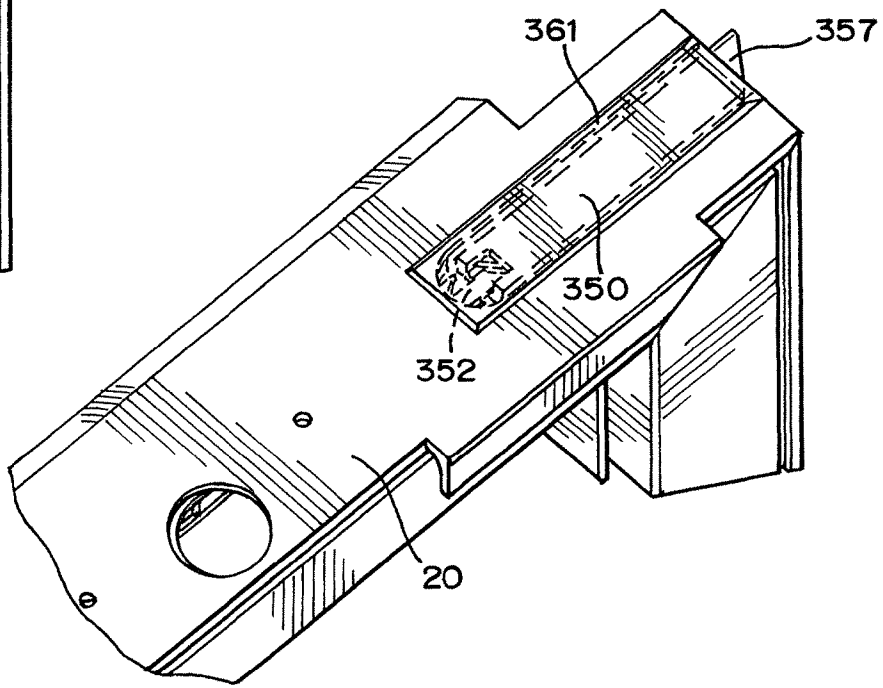
FIG. 84 is a partial perspective view of the top rail showing the tilt-latch mechanism installed and showing a cover of the tilt-latch mechanism in phantom.
Figure 83:
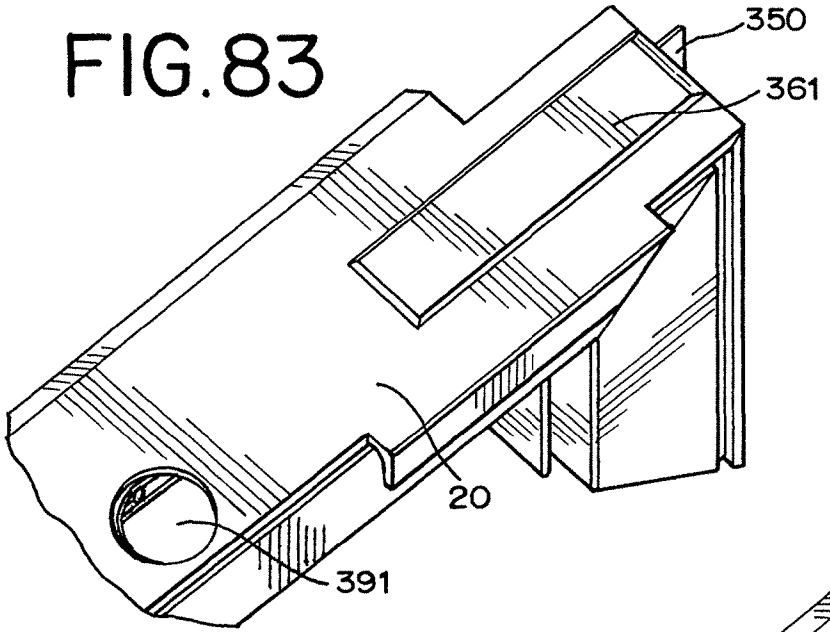
FIG. 83 is a partial perspective view of the top rail showing the tilt-latch mechanism installed and showing a portion of the connector through the first opening to receive the sash lock mechanism.

FIGS. 81-84 shown certain structures of the top rail and installation of certain components of the integrated assembly. FIG. 81 shows that the top rail 20 has a first opening 391 that is adapted to receive the sash lock mechanism and a second opening 392 that is adapted to receive the tilt-latch assembly. In contrast to the integrated assemblies 30,130 described above, the tilt latch opening 392 of the integrated assembly 330, shown in FIGS. 81-84, extends through both the top rail 20 and the stile 24. This allows the tilt latch mechanism 331 to be installed substantially flush with the top surface 20*b* of the top rail 20. FIG. 82 shows the connector 352 installed in the top rail 20. FIGS. 83 and 84 show the tilt latch mechanism 331 installed in the top rail 20. The cover of the housing 360 is substantially flush with the top surface 20*b* of the top rail 20. Openings are included in the top rail 20 to receive fasteners to attach the sash lock housing to the top rail 20.

The sash lock mechanism 332 may include a spring 337 that will return the cam 344 to an open position if the assembly is placed in a particular position as desired. Additionally, the cam 344 has a means 394 for selectively preventing movement of the integrated assembly 330 to the tiltable position, which preferably takes the form of an enlarged or eccentric portion 394 of the cam 344 that is rotationally opposite of the locking member 340. When the integrated assembly 330 is in the unlocked position, and a user wishes to move the actuator handle 336 to the tiltable position, the eccentric portion 394 abuts a portion of the keeper 342, preventing rotation of the cam 344. In order to rotate the actuator handle 336 and cam 344 further, the user must lift the sash window 12 slightly, to allow the eccentric portion 394 to clear the keeper 342, and the actuator handle 36 can thus be moved to the tiltable position. As shown in FIG. 77, if the sash window is a closed position, one cannot move the actuator arm 336 to retract the latch bolt as a portion of the cam 344 will interfere with the keeper 342. FIGS. 78-80 show the latch bolt in a fully retracted position.

The integrated assembly 30 provides many benefits. The rounded shape of the tilt latch housing 60 permits the tilt latch mechanism 31 to be mounted in a circular opening 92 in the stile 24,26, which can be routed or drilled using a respective bit of suitable diameter. Routing or drilling the circular opening 92 is quicker, more precise, and greatly simplified with respect to prior tilt latch mounting procedures that often require stile openings of more complex geometry. Additionally, the tilt latch mechanism 31 does not require an opening that extends through both the stile 24,26 and the top rail 20, which can weaken the top sash rail 20. Concealing the tilt latch mechanism 31 beneath the top rail 20 also produces a more desirable appearance than prior configurations when one desires a top rail that is as smooth as possible. In this configuration, the top surface 20*b* of the top rail at the tilt-latch location is not compromised. The mounting configuration of the integrated assembly 30 requires a relatively shallow cavity 90 in the top sash rail 20, while still presenting a relatively low profile. Further, the tilt latch mechanism 31 is suitable for use either as a stand-alone tilt latch 31 or in connection with a sash lock mechanism as part of an integrated assembly 30. Thus, necessary SKU inventory is decreased, since a single tilt-latch mechanism 31 can be used for all purposes. Furthermore, the connection between the sash lock mechanism 32 and the tilt-latch mechanism 31 provides enhanced flexibility. The lengths of the connectors 52 can be varied as desired. Thus, if integrated assemblies 30 are to be used in larger windows, longer connectors 52 can be utilized such that the tilt-latch mechanisms 31 are positioned at the ends of the top rail and the sash lock mechanisms 32 are positioned towards the center portions of the top rail. In addition, the length of the connectors 52 can be changed to place the sash lock mechanism 32 at the particular position on the top rail as desired by the user.

While the specific embodiments have been illustrated and described, numerous modifications come to mind without significantly departing from the spirit of the invention and the scope of protection is only limited by the scope of the accompanying Claims.

What is claimed is:

1. An integrated sash lock and tilt-latch assembly for a sash window assembly, the sash window assembly having a lower sash window having a top rail, a bottom rail, and a pair of stiles and an upper sash window having a keeper, the integrated assembly comprising:

a sash lock mechanism adapted to be supported by the top rail, wherein the sash lock mechanism further comprises:

an actuator movable to adjust the assembly among a locked position, an unlocked position, and a tiltable position, a sash lock housing adapted to be supported on a top surface of the top rail, the sash lock housing having an opening receiving the actuator therethrough, a rotor coupled to the actuator, such that movement of the actuator causes rotation of the rotor on an axis of rotation, over a range of rotation, and a pawl comprising a base and an appending member, the pawl being rotatable about the axis of rotation of the rotor, wherein the pawl rotates simultaneously with the rotor over at least a portion of the range of rotation of the rotor, wherein the rotor and the pawl are hung from the actuator opposite the sash lock housing, and, wherein at least a portion of the sash lock housing interposes the actuator and rotor;

a tilt-latch mechanism adapted to be supported by the lower sash window and comprising a tilt latch housing and a latch bolt, the latch bolt slidably supported by the tilt latch housing and moveable between an extended position and a retracted position; and a connector having a substantially rigid elongated body member, a first end operably connected to the pawl and a second end operably connected to the latch bolt, wherein the integrated assembly is moveable among a locked position, an unlocked position and a tiltable position, wherein the sash lock mechanism is adapted to engage the keeper in the locked position, and wherein the sash lock mechanism is adapted to be disengaged from the keeper in the unlocked position, and wherein the latch bolt is placed in the retracted position in the tiltable position, and wherein the actuator is moveable among a first position wherein the rotor does not abuttingly engage the pawl and the assembly is in the locked position, a second position wherein the assembly is in the unlocked position, and a third position wherein the rotor abuttingly engages the pawl and the assembly is in the tiltable position;

wherein the sash lock assembly further comprises an eccentric cap coupled to the actuator and the first end of the connector further comprises a curved arm, wherein movement of the actuator causes the eccentric cap to rotate and engage the curved arm, partially retracting the latch bolt prior to the rotor abuttingly engaging the pawl.

2. The integrated sash lock and tilt-latch assembly of claim 1 wherein the first end of the connector has a hitch and the appending member of the pawl has a hook, wherein the hook engages the hitch to connect the connector to the appending member.

3. The integrated sash lock and tilt-latch assembly of claim 1 wherein the second end of the connector has at least one flexible bracing arm that engages the latch bolt and exerts a torque on the connector for resisting vertical movement and pivoting of the connector while permitting lateral movement and pivoting of the connector.

4. The integrated sash lock and tilt-latch assembly of claim 1 wherein at least a portion of the tilt latch housing has a generally circular cross-section, and is adapted to be mounted within the lower sash window by inserting the housing into a substantially circular opening in the lower sash window.

5. The integrated sash lock and tilt-latch assembly of claim 1 wherein the tilt latch housing has a first engaging member adapted to engage an outer surface of the lower sash window and a second engaging member adapted to engage an inner surface of the lower sash window.

6. The integrated sash lock and tilt-latch assembly of claim 5 wherein the tilt latch mechanism is adapted to be supported by one of the stiles, the first engaging member adapted to engage an outer surface of the stile, and the second engaging member adapted to engage an inner surface of the stile.

7. The integrated sash lock and tilt-latch assembly of claim 5 wherein the first engaging member comprises a generally circular flange and the second engaging member comprises a flexible tab.

8. The integrated sash lock and tilt-latch assembly of claim 7 wherein the second engaging member further comprises a plurality of flexible tabs.

9. The integrated sash lock and tilt-latch assembly of claim 8 wherein the plurality of flexible tabs are arranged into at least one substantially linear row that is transverse to the flange.

10. The integrated sash lock and tilt-latch assembly of claim 1 wherein the tilt latch housing has a flange and a tab, and a gap is defined between the flange and the tab wherein the gap is adapted to receive a portion of the lower sash window.

11. The integrated sash lock and tilt-latch assembly of claim 10 wherein the tilt latch housing has a plurality of tabs, and a plurality of gaps are defined between the flange and the plurality of tabs, wherein each of the plurality of gaps is adapted to receive a portion of one of a plurality of stiles of a lower sash window having different thicknesses.

12. An integrated sash lock and tilt-latch assembly for a sash window assembly, the sash window assembly having a lower sash window having a top rail, a bottom rail, and a pair of stiles and an upper sash window having a keeper, the integrated assembly comprising:

a sash lock mechanism adapted to be supported by the top rail, wherein the sash lock mechanism further comprises:

an actuator movable to adjust the assembly among a locked position, an unlocked position, and a tiltable position, a sash lock housing adapted to be supported on a top surface of the top rail, the sash lock housing having an opening receiving the actuator therethrough, a rotor coupled to the actuator, such that movement of the actuator causes rotation of the rotor on an axis of rotation, over a range of rotation, and a pawl comprising a base and an appending member, the pawl being rotatable about the axis of rotation of the rotor, wherein the pawl rotates simultaneously with the rotor over at least a portion of the range of rotation of the rotor, wherein the rotor and the pawl are hung from the actuator opposite the sash lock housing, and, wherein at least a portion of the sash lock housing interposes the actuator and rotor;

a tilt-latch mechanism adapted to be supported by the lower sash window and comprising a tilt latch housing and a latch bolt, the latch bolt slidably supported by the tilt latch housing and moveable between an extended position and a retracted position; and a connector having a substantially rigid elongated body member, a first end operably connected to the pawl and a second end operably connected to the latch bolt, wherein the integrated assembly is moveable among a locked position, an unlocked position and a tiltable position, wherein the sash lock mechanism is adapted to engage the keeper in the locked position, and wherein the sash lock mechanism is adapted to be disengaged from the keeper in the unlocked position, and wherein the latch bolt is placed in the retracted position in the tiltable position, and wherein the actuator is moveable among a first position wherein the rotor does not abuttingly engage the pawl and the assembly is in the locked position, a second position wherein the assembly is in the unlocked position, and a third position wherein the rotor abuttingly engages the pawl and the assembly is in the tiltable position;

wherein at least a portion of the pawl is seated within a grooved formed on a surface of the rotor opposite the housing.

13. The integrated sash lock and tilt-latch assembly of claim 12 wherein at least a portion of the tilt latch housing has a generally circular cross-section, and is adapted to be mounted within the lower sash window by inserting the housing into a substantially circular opening in the lower sash window.

14. The integrated sash lock and tilt-latch assembly of claim 12 wherein the tilt latch housing has a first engaging member adapted to engage an outer surface of the lower sash window and a second engaging member adapted to engage an inner surface of the lower sash window.

15. The integrated sash lock and tilt-latch assembly of claim 14 wherein the tilt latch mechanism is adapted to be supported by one of the stiles, the first engaging member adapted to engage an outer surface of the stile, and the second engaging member adapted to engage an inner surface of the stile.

16. The integrated sash lock and tilt-latch assembly of claim 14 wherein the first engaging member comprises a generally circular flange and the second engaging member comprises a flexible tab.

17. The integrated sash lock and tilt-latch assembly of claim 16 wherein the second engaging member further comprises a plurality of flexible tabs.

18. The integrated sash lock and tilt-latch assembly of claim 17 wherein the plurality of flexible tabs are arranged into at least one substantially linear row that is transverse to the flange.

19. The integrated sash lock and tilt-latch assembly of claim 12 wherein the tilt latch housing has a flange and a tab, and a gap is defined between the flange and the tab wherein the gap is adapted to receive a portion of the lower sash window.

20. The integrated sash lock and tilt-latch assembly of claim 19 wherein the tilt latch housing has a plurality of tabs, and a plurality of gaps are defined between the flange and the plurality of tabs, wherein each of the plurality of gaps is adapted to receive a portion of one of a plurality of stiles of a lower sash window having different thicknesses.

* * * * *